US008864603B2

(12) United States Patent
Kumamoto et al.

(10) Patent No.: US 8,864,603 B2
(45) Date of Patent: Oct. 21, 2014

(54) GOLF CLUB HEAD

(75) Inventors: Tomio Kumamoto, Kobe (JP); Takashi Nakano, Kobe (JP); Yasushi Sugimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 644 days.

(21) Appl. No.: 12/501,172

(22) Filed: Jul. 10, 2009

(65) Prior Publication Data

US 2010/0056296 A1 Mar. 4, 2010

(30) Foreign Application Priority Data

Aug. 4, 2008 (JP) ..... 2008-200499
Nov. 12, 2008 (JP) ..... 2008-290231
Dec. 24, 2008 (JP) ..... 2008-327484

(51) Int. Cl.

*A63B 53/00* (2006.01)
*A63B 53/06* (2006.01)
*A63B 53/04* (2006.01)
*A63B 59/00* (2006.01)

(52) U.S. Cl.

CPC ..... *A63B 53/047* (2013.01); *A63B 2209/10* (2013.01); *A63B 53/06* (2013.01); *A63B 2053/0491* (2013.01); *A63B 59/0092* (2013.01)

USPC ..... 473/332; 473/350

(58) Field of Classification Search

USPC ..... 473/350, 331, 332, 334, 342, 347
See application file for complete search history.

(56) References Cited

U.S. PATENT DOCUMENTS 1,945,844 A * 2/1934 Young ..... 473/328
3,652,093 A * 3/1972 Reuter, Jr. ..... 473/340
4,398,965 A * 8/1983 Campau ..... 148/522
4,645,207 A * 2/1987 Teramoto et al. ..... 473/290
4,767,647 A * 8/1988 Bree ..... 428/14

(Continued)

FOREIGN PATENT DOCUMENTS

FR 2717702 A1 * 9/1995 ..... A63B 53/04
JP 61-56434 A 3/1986

(Continued)

OTHER PUBLICATIONS

Teraoka, JP Pub. No. 2000-293124, Machine Translation, pp. 1-4.*

(Continued)

*Primary Examiner* — Gene Kim
*Assistant Examiner* — Matthew B Stanczak
(74) *Attorney, Agent, or Firm* — Birch, Stewart, Kolasch & Birch, LLP

(57) ABSTRACT

A head of a first aspect is provided with a head body h1*x*, a double-stick tape t1, and an adherend s1*x* bonded to the head body h1*x* by the double-stick tape t1. The double-stick tape t1 has a first adhesive layer 30 provided as an innermost layer, a second adhesive layer 36 provided as an outermost layer, and intermediate layers 32 and 34 provided between the first adhesive layer 30 and the second adhesive layer 36. The intermediate layer includes a fiber layer 34 and/or a resin layer 32. The resin layer 32 is free of bubbles. In a head of a second aspect, a head body h1*y* or an adherend s1*y* has a recessed part 27*y*. In a head of a third aspect, an adherend s1 has a metal member 27 and an elastic member 29. The elastic member 29 has a peripheral part 29*a* directly or indirectly abutting on a side surface 31 of the metal member 27.

14 Claims, 37 Drawing Sheets

(56) References Cited

U.S. PATENT DOCUMENTS

| | | | | | |
|---|---|---|---|---|---|
| 4,811,950 | A * | 3/1989 | Kobayashi | 473/335 |
| 4,928,972 | A * | 5/1990 | Nakanishi et al. | 473/332 |
| 5,104,457 | A * | 4/1992 | Viljoen et al. | 473/350 |
| 5,409,229 | A | 4/1995 | Schmidt et al. | |
| 5,485,997 | A * | 1/1996 | Schmidt et al. | 473/251 |
| 5,522,593 | A * | 6/1996 | Kobayashi et al. | 473/349 |
| 5,536,011 | A * | 7/1996 | Gutowski | 473/350 |
| 5,586,947 | A * | 12/1996 | Hutin | 473/324 |
| 5,626,530 | A | 5/1997 | Schmidt et al. | |
| 5,704,849 | A | 1/1998 | Schmidt et al. | |
| 5,753,362 | A * | 5/1998 | Kawase et al. | 428/327 |
| 5,823,887 | A | 10/1998 | Mikame et al. | |
| 5,944,619 | A | 8/1999 | Cameron | |
| 6,231,458 | B1 | 5/2001 | Cameron et al. | |
| 6,334,818 | B1 | 1/2002 | Cameron et al. | |
| 6,484,424 | B1 * | 11/2002 | Peterson | 40/1.5 |
| 6,592,469 | B2 * | 7/2003 | Gilbert | 473/350 |
| 6,872,153 | B2 * | 3/2005 | Gilbert et al. | 473/332 |
| 6,913,545 | B2 * | 7/2005 | Jones et al. | 473/342 |
| 6,951,518 | B2 * | 10/2005 | Solheim et al. | 473/324 |
| 6,964,620 | B2 * | 11/2005 | Gilbert et al. | 473/332 |
| 6,976,924 | B2 * | 12/2005 | Gilbert et al. | 473/332 |
| 7,126,339 | B2 * | 10/2006 | Nagai et al. | 324/345 |
| 7,731,604 | B2 * | 6/2010 | Wahl et al. | 473/337 |
| 7,819,757 | B2 * | 10/2010 | Soracco et al. | 473/332 |
| 7,892,106 | B2 * | 2/2011 | Matsunaga | 473/290 |
| 7,927,697 | B2 * | 4/2011 | Nonaka et al. | 428/355 AC |
| 8,267,807 | B2 * | 9/2012 | Takechi et al. | 473/332 |
| 8,333,667 | B2 * | 12/2012 | Kumamoto et al. | 473/342 |
| 8,430,766 | B2 * | 4/2013 | Chick et al. | 473/335 |
| 2002/0098910 | A1 * | 7/2002 | Gilbert | 473/332 |
| 2002/0153840 | A1 | 10/2002 | Isohata et al. | |
| 2004/0092331 | A1 * | 5/2004 | Best | 473/332 |
| 2007/0281796 | A1 * | 12/2007 | Gilbert et al. | 473/332 |
| 2009/0075750 | A1 * | 3/2009 | Gilbert et al. | 473/332 |

FOREIGN PATENT DOCUMENTS

| | | | |
|---|---|---|---|
| JP | 6-346027 | A | 12/1994 |
| JP | 7-53926 | A | 2/1995 |
| JP | 7-28578 | U | 5/1995 |
| JP | 8-295856 | A | 11/1996 |
| JP | 9-666 | A | 1/1997 |
| JP | 9-75481 | A | 3/1997 |
| JP | 2792642 | B2 | 9/1998 |
| JP | 2000-73028 | A | 3/2000 |
| JP | 2000-293124 | A | 10/2000 |
| JP | 2001-212266 | A | 8/2001 |
| JP | 2001-259092 | A | 9/2001 |
| JP | 2002-102397 | A | 4/2002 |
| JP | 2002-533179 | A | 10/2002 |
| JP | 2002-323863 | A | 11/2002 |
| JP | 2006-435 | A | 1/2006 |
| JP | 2006-206621 | A | 8/2006 |
| JP | 2008-45347 | A | 2/2008 |
| JP | 2008-125811 | A | 6/2008 |

OTHER PUBLICATIONS

Patrice, Sep. 1995, FR Pat. No. 2,717,702, machine translastion, pp. 1-3.*

Japanese Office Action dated Mar. 29, 2011 for Application No. 2008-290231.

Office Action for corresponding Japanese Application No. 2008-327484 dated Apr. 26, 2011.

* cited by examiner

GOLF CLUB HEAD

The present application claims priorities on Japanese Patent Applications Nos. 2008-200499 filed on Aug. 4, 2008, 2008-290231 filed on Nov. 12, 2008, and 2008-327484 filed on Dec. 24, 2008. The whole contents of the Japanese Patent Applications are hereby incorporated by reference.

BACKGROUND OF THE INVENTION

1. Field of the Invention

The present invention relates to a golf club head.

2. Description of the Related Art

An adherend such as a weight member, a vibration absorbing member and a batch is sometimes attached to a golf club head. An adhesive or a double-stick tape is usually used for the attachment. The double-stick tape has a front surface and a reverse surface which have adhesiveness. Generally, the double-stick tape is referred to as a double-sided tape in Japan.

Japanese Patent Publication No. 2792642 discloses a golf club head having a face and a thin plate stuck on the back surface of the face by a double-stick tape. The double-stick tape has a tape base material and adhesive layers provided on both surfaces thereof. Japanese patent publication No. 2792642 (U.S. Pat. No. 5,409,229) describes that the tape base material can be made of paper.

A head impacts with a golf ball at the time of hitting the ball. Vibration is generated in the head by the impact. The vibration may be undesirable for a golf player. Particularly, the vibration in missed hit is undesirable. The adherend can absorb the vibration generated in hitting the ball.

SUMMARY OF THE INVENTION

In a golf club head, an impact force caused by hitting is great. In a conventional golf club head, the destruction of the double-stick tape itself and the separation of a bonded surface may be generated by the vibration caused by hitting.

A double-stick tape having a resin form layer has been commercially-supplied. The resin form layer is a resin layer having bubbles. The double-stick tape having the resin form layer is considered to be applied to the golf club head. The resin form layer can be easily deformed. Good adhesion can be obtained by the resin form layer even when unevenness exists on the surface of an adherend or the surface of the adherend is a curved surface.

However, it has been found that when the double-stick tape having the resin form layer is applied to the golf club head, a problem may be caused. Repeated hitting is performed with the golf club head. The vibration caused by the impact of the hitting is great. It has been found that the resin form layer is not necessarily suitable in repeating hitting. It also has been found that the repeating hitting may cause the separation of the bonded surface in the double-stick tape having the resin form layer.

On the other hand, as the case of the double-stick tape which is free of the resin form layer, for example, there is a double-stick tape having adhesive layers provided on both surfaces of paper. In this case, when the double-stick tape is stuck on the outer surface of the adherend, wrinkles are apt to be generated. In the double-stick tape, adhesion failure is apt to occur.

The impact force at the time of hitting may act in various directions. The present inventor directed attention to a shearing force which may act on the double-stick tape at the time of hitting. When the adherend is horizontally displaced, the shearing force acts on the double-stick tape. For example, a case where the double-stick tape bonds a plane of the head body and a plane of the adherend is considered. Hereinafter, a direction parallel to the plane of the head body and the plane of the adherend is referred to as an in-plane direction. In this case, a situation in which the head body attempts to move to one side of the in-plane direction and the adherend attempts to move to the other side of the in-plane direction may take place. In such case, the shearing force may act on the double-stick tape. Shear stress is generated in the double-stick tape by the shearing force. The shearing force may generate the shear deformation of the double-stick tape. The resin form layer may be greatly deformed by the shearing force. When the resin form layer is used, the shear deformation is great. The shear deformation may generate a separation. It has been found that the adhesiveness of the head body and the adherend can be enhanced by suppressing the shear deformation.

It is an object of a first aspect of the present invention to provide a golf club head having an adherend bonded by a double-stick tape, the adherend being less easily detached.

A golf club head according to the first aspect includes a head body; a double-stick tape; and an adherend bonded to the head body by the double-stick tape. The double-stick tape includes a first adhesive layer provided as an innermost layer, a second adhesive layer provided as an outermost layer, and an intermediate layer provided between the first adhesive layer and the second adhesive layer. The intermediate layer includes a fiber layer and/or a resin layer. The resin layer is free of bubbles.

In the first aspect, preferably, the fiber layer is a nonwoven fabric layer.

In the first aspect, preferably, the head body and the adherend have a bonded surface bonded to the double-stick tape. Preferably, the head body or the adherend has a recessed part. Preferably, an inner surface of the recessed part and the bonded surface are adjacent to each other. Preferably, a space exists between the double-stick tape and the recessed part.

In the first aspect, preferably, the head body has a face surface and a back surface located on a back of the face surface. Preferably, the adherend is bonded to the back surface. Preferably, the adherend has a metal member and an elastic member. Preferably, the elastic member has a peripheral part directly or indirectly abutting on a side surface of the metal member.

In the first aspect, preferably, the intermediate layer consists of only a nonwoven fabric layer and a resin layer free of bubbles. Preferably, the double-stick tape has a five-layered structure obtained by laminating the first adhesive layer, the resin layer free of bubbles, the nonwoven fabric layer, the resin layer free of bubbles and the second adhesive layer in this order.

In the first aspect, preferably, the intermediate layer consists of only a nonwoven fabric layer.

In the first aspect, preferably, the intermediate layer consists of only the resin layer free of bubbles.

In the first aspect, preferably, a thickness of the double-stick tape is equal to or less than 0.5 mm.

During the bonding work, air may enter between the double-stick tape and the adherend. Similarly, during the bonding work, air may enter between the double-stick tape and the head body. The air forms bubbles, which reduce the bonding strength of the double-stick tape.

In the golf club head, an impact force caused by hitting is great. The impact force may cause the separation of the bonded surface. Strong bonding strength capable of enduring the impact force is required.

It is an object of a second aspect of the present invention to provide a golf club head in which an adherend bonded by a double-stick tape is less likely to be separated.

A golf club head of the second aspect includes a head body; a double-stick tape; and an adherend bonded to the head body by the double-stick tape. The head body and the adherend have a bonded surface bonded to the double-stick tape. The head body or the adherend has a recessed part. An inner surface of the recessed part and the bonded surface are adjacent to each other. A space exists between the double-stick tape and the recessed part.

In the second aspect, preferably, the bonded surface of the head body is a back surface of the head body. Preferably, the adherend has an approximately plate shape. Preferably, the recessed part is formed on the adherend. Preferably, an existence region of the adherend includes a back surface point of a sweet spot.

In the second aspect, preferably, the recessed part is formed on the adherend. Preferably, the double-stick tape has a first adhesive layer, a second adhesive layer, and an intermediate layer provided between the first adhesive layer and the second adhesive layer. Preferably, the intermediate layer includes a fiber layer.

In the second aspect, preferably the space is in a closed state.

The vibration absorbing effect can be enhanced by increasing the thickness of the adhesive or the double-stick tape. However, when the thickness is great, the movable amount of the adherend is great. When the movement of the adherend is great, a probability that the adherend is separated is increased.

It is an object of a third aspect of the present invention to provide a golf club head having an adherend less likely to be separated and having a high vibration absorbing effect.

A golf club head of the third aspect includes a head body; and an adherend bonded to the head body. The head body has a face surface and a back surface located on a back of the face surface. The adherend is bonded to the back surface. The adherend has a metal member and an elastic member. The elastic member has a peripheral part directly or indirectly abutting on a side surface of the metal member.

In the third aspect, preferably, the elastic member has an interposition part interposed between the metal member and the back surface of the head body.

In the third aspect, preferably, the elastic member has a back surface having a recessed part (E). Preferably, the metal member is disposed inside the recessed part (E). Preferably, a peripheral wall of the recessed part (E) is the peripheral part. Preferably, a bottom part of the recessed part (E) is the interposition part.

In the third aspect, preferably, the metal member has a front surface having a recessed part (M). Preferably, the interposition part of the elastic member extends inside the recessed part (M).

In the third aspect, preferably, the peripheral part of the elastic member extends further backward relative to the side surface of the metal member.

In the third aspect, preferably, the adherend is bonded to the head body by a double-stick tape. Preferably, a thickness of the double-stick tape is equal to or less than 0.4 mm.

In the third aspect, preferably, the adherend is bonded to the head body by a double-stick tape. Preferably, the double-stick tape has a first adhesive layer, a second adhesive layer, and an intermediate layer provided between the first adhesive layer and the second adhesive layer. Preferably, the intermediate layer includes a fiber layer.

In the head of the first aspect, the double-stick tape provided with the fiber layer and/or the resin layer free of bubbles has high durability to the shearing force. The detachment of the adherend caused by repeated hitting is less likely to occur due to the double-stick tape.

The head of the second aspect can release the bubbles generated on the bonded surface into the recessed part and thereby enhancing the bonding strength.

In the head of the third aspect, the adherend has the metal member and the elastic member, and the elastic member is disposed on the side surface of the metal member. The vibration absorbing effect is enhanced by the constitution. The adherend is less likely to be separated due to the constitution.

DESCRIPTION OF THE PREFERRED EMBODIMENTS

Hereinafter, the present invention will be described in detail according to the preferred embodiments with appropriate references to the accompanying drawings.

Figure 1:
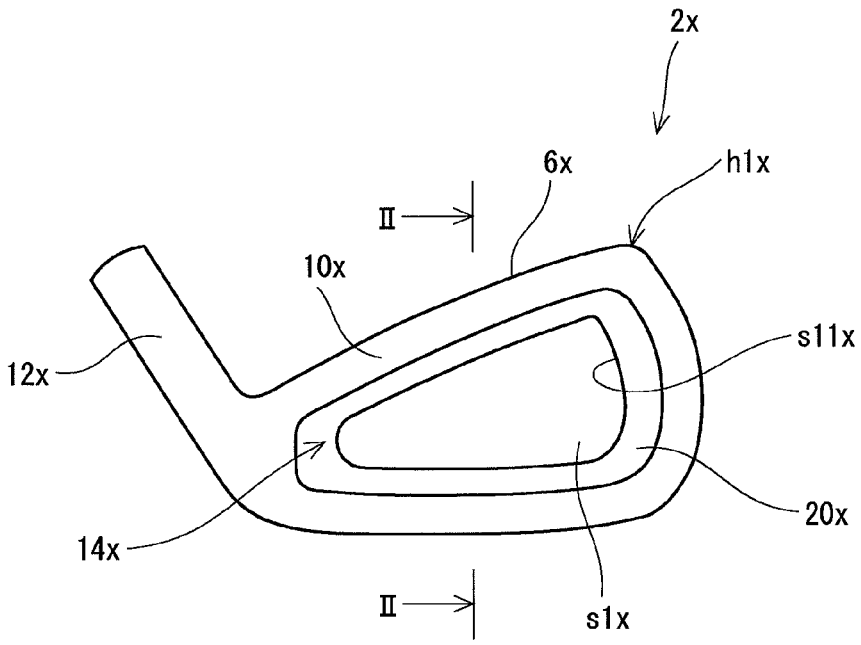
FIG. 1 is a view of a golf club head of a first embodiment as seen from a back surface side.
Figure 2:
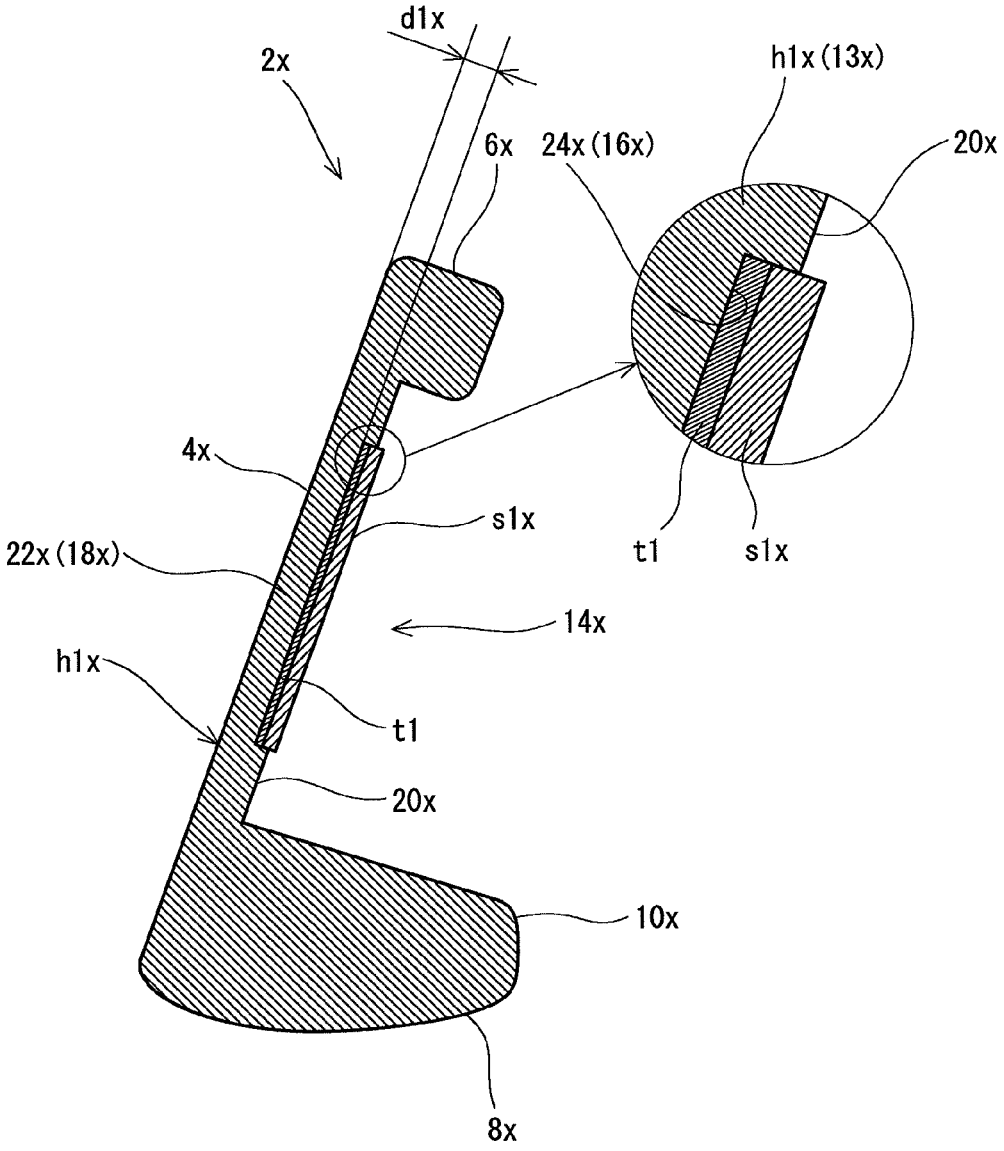
FIG. 2 is a cross sectional view taken along a line II-II in FIG. 1.

FIG. 1 is a view of a golf club head 2*x* of a first embodiment of the present invention as seen from a back surface side. FIG. 2 is a cross sectional view taken along a line II-II in FIG. 1. The head 2*x* is an iron type golf club head. The head 2*x* has a head body h1*x*, an adherend s1*x*, and a double-stick tape t1. The adherend s1*x* is a thin plate-shaped member. The adherend s1*x* is typically a badge. The adherend s1*x* is made of a metal and a resin or the like. Typically, logos and characters which represent product names or the like are indicated on the adherend s1*x*. A profile line s11*x* of the adherend s1*x* is shown in FIG. 1.

The double-stick tape t1 is interposed between the adherend s1*x* and the head body h1*x*. The adherend s1*x* is bonded to the head body h1*x* by the double-stick tape t1. The profile shape of the double-stick tape t1 and the profile shape of the adherend s1*x* are substantially equal.

The shape of the double-stick tape t1 is not limited. A width and a length of the double-stick tape t1 are not limited. The double-stick tape t1 is a sheet having both surfaces having adhesiveness.

The double-stick tape t1 is shown as a single layer in FIG. 2. However, in fact, the double-stick tape t1 is formed of a plurality of layers as described later.

The head body h1*x* has a face part 13*x* provided with a face surface 4*x*, a top surface 6*x*, a sole surface 8*x*, a back surface 10*x* and a hosel part 12*x*. The face part 13*x* has the face surface 4*x* as an outer surface. The face part 13*x* is solid. A recessed part 14*x* is formed on the back surface 10*x*. The recessed part 14*x* is formed on the reverse side of the face surface 4*x*. The head 2*x* having the recessed part 14*x* is generally referred to as a cavity back iron. The recessed part 14*x* forms a so-called cavity back. The face part is thinned by the recessed part 14*x*. A thin wall part (a first thin wall part) 18*x* is formed by the recessed part 14*x*. The thin wall part 18*x* is a part of the face part 13*x*. The thin wall part 18*x* is solid. The adherend s1*x* is stuck on the back surface of the thin wall part 18*x*. A front surface of the thin wall part 18*x* is the face surface 4*x*. The back surface of the thin wall part 18*x* is a bottom surface 20*x* of the recessed part 14*x*. A sweet spot of the head 2*x* is located in the thin wall part 18*x*. The sweet spot is a point of intersection between a line passing through the center of gravity of the head 2*x* and being perpendicular to the face surface 4*x* and the face surface 4*x*.

In light of the durability, the thickness of the thin wall part is preferably equal to or greater than 1.5 mm, and more preferably equal to or greater than 1.8 mm, and still more preferably equal to or greater than 2.0 mm. When the thin wall part is thin, the vibration of the face part at the time of hitting a ball is great. When the thin wall part is thin, a great impact force acts on a portion on which the double-stick tape is stuck. Therefore, in this case, the effect of the aspect may be actualized. From this viewpoint, the thickness of the thin wall part is preferably equal to or less than 3.0 mm, more preferably equal to or less than 2.7 mm, and still more preferably equal to or less than 2.4 mm.

Although illustration is omitted, an impact area marking (not shown) is formed on the face surface 4*x*. The impact area marking is typically a face line (face groove).

A recessed part 16*x* is further formed in the recessed part 14*x*. The recessed part (a second recessed part) 16*x* is formed on the bottom surface 20*x* of the recessed part (a first recessed part) 14*x*. The recessed part 16*x* is shallower than the recessed part 14*x*. A depth of the recessed part 16*x* is greater than the thickness of the double-stick tape t1. The recessed part 16*x* accommodates the whole of the double-stick tape t1. The profile shape of the recessed part 16*x* and the profile shape of the adherend s1*x* are substantially equal.

The face part is further thinned by the recessed part 16*x*. A second thin wall part 22*x* is formed by the recessed part 16*x*. The second thin wall part 22*x* is a part of the first thin wall part 18*x*. The second thin wall part 22*x* is solid. The adherend s1*x* is stuck on the back surface of the second thin wall part 22*x*. The sweet spot of the head 2*x* is located in the second thin wall part 22*x*. The front surface of the second thin wall part 22*x* is the face surface 4*x*. The back surface of the second thin wall part 22*x* is a bottom surface 24*x* of the recessed part 16*x*. The bottom surface 24*x* is a part of the bottom surface 20*x*.

Figure 3:
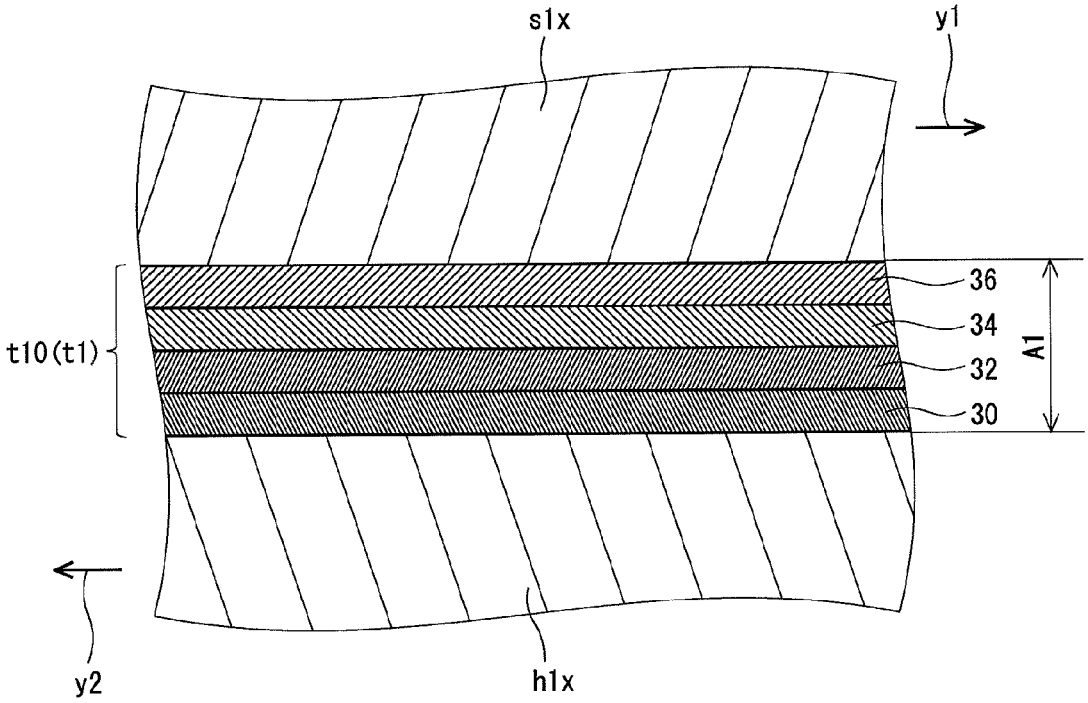
FIG. 3 is an expanded cross sectional view of the vicinity of a double-stick tape in a first embodiment.

FIG. 3 is an expanded cross sectional view of the vicinity of the double-stick tape t1. The double-stick tape t1 is a double-stick tape t10 having a four-layered structure. The four layers are a first layer 30, a second layer 32, a third layer 34 and a fourth layer 36 in order from the side of the head body h1*x*. The first layer 30 is an innermost layer of the double-stick tape t10. The first layer 30 is an adhesive layer. The first layer 30 is a first adhesive layer. The second layer 32 and the third layer 34 are intermediate layers. The fourth layer 36 is an adhesive layer. The fourth layer 36 is an outermost layer of the double-stick tape t10. The fourth layer 36 is a second adhesive layer. Although boundaries between the layers are flatly shown in FIG. 3, unevennesses may exist in the boundaries. Particularly, a boundary between a fiber layer (for example, a nonwoven fabric layer) to be described later and the other layer is usually uneven. The boundaries between the layers may be curved surfaces.

The first adhesive layer 30 is bonded to the head body h1*x*. The second adhesive layer 36 is bonded to the adherend s1*x*. The adherend s1*x* is bonded to head body h1*x* by the double-stick tape t10.

The first layer 30 and the fourth layer 36 are layers made of an adhesive compound. The adhesive compound is not limited. As the adhesive compound, an acrylic adhesive compound, an epoxy adhesive compound, and a urethane adhesive compound or the like are exemplified.

The second layer 32 is a resin layer which is free of bubbles. The second layer 32 is an unfoamed resin film. The second layer 32 is not a resin form layer. The kind of a resin forming the second layer 32 is not limited. As a base material resin of the resin layer, an acrylic resin and a polyester resin are exemplified.

The resin layer is apt to be deformed by the existence of the bubbles. The deformation of the resin layer 32 (resin film layer 32) which is free of bubbles caused by the shearing force is less than that of the resin layer having bubbles. The shearing force which acts on the double-stick tape t1 is generated, for example, when a force in an arrow y1 direction acts on the adherend s1*x* and a force in an arrow y2 direction acts on the head body h1*x* (see FIG. 3). The resin layer which is free of bubbles can reduce the deformation of the double-stick tape t10 caused by the shearing force. The resin layer which is free of bubbles has higher strength than that of the resin layer having bubbles. The resin layer which is free of bubbles can enhance the strength of the double-stick tape t10.

The third layer 34 is a fiber layer. Although not shown in the drawings, a empty space exists in the fiber layer. A part of the adhesive layer 36 adjacent to the third layer 34 enters the empty space. The entering suppresses the deformation of the double-stick tape t10 caused by the shearing force.

The fiber of the third layer 34 is a nonwoven fabric. That is, the third layer 34 is a nonwoven fabric layer. Although not shown in the drawings, a empty space exists in the nonwoven fabric. A part of the adhesive layer 36 adjacent to the third layer 34 enters the empty space. The entering suppresses the deformation of the double-stick tape t10 caused by the shearing force.

A empty space exists in the nonwoven fabric layer 34. A part of the resin layer 32 adjacent to the third layer 34 enters the empty space. The entering suppresses the deformation of the double-stick tape t10 caused by the shearing force.

A part of the adhesive layer 36 adjacent to the nonwoven fabric layer 34 enters the empty space of the nonwoven fabric layer 34. The entering enhances the strength of the double-stick tape t10 to the shearing force.

Unlike the embodiment, the second layer 32 may be the fiber layer, and the third layer 34 may be the resin layer which is free of bubbles. For example, the second layer 32 may be the nonwoven fabric layer, and the third layer 34 may be the resin layer which is free of bubbles.

The fiber layer 34 has excellent strength. The fiber layer 34 has reduced deformation caused by the shearing force. The fiber layer 34 can suppress the deformation of the double-stick tape t10 caused by the shearing force.

The fiber layer 34 functions as a support of the double-stick tape t10. When the double-stick tape t10 is stuck, wrinkles are less likely to be generated due to the fiber layer 34. The fiber layer 34 can facilitate the sticking work of the double-stick tape t1.

The fiber layer 34 can absorb shear stress. The fiber layer 34 can suppress the vibration caused by the shear stress. The fiber layer 34 can terminate the vibration caused by the shear stress in a short time. The effect of absorbing the shear stress can develop a vibration absorbing effect. The vibration absorbing effect can suppress the vibration transmitted to the adherend s1*x*. As a result, the separation of the adherend s1*x* can be suppressed.

The effect due to the fiber layer and the effect due to the resin layer which is free of bubbles can be simultaneously obtained by using the fiber layer 34 and the resin layer 32 which is free of bubbles together.

The nonwoven fabric layer 34 has excellent strength. The nonwoven fabric layer 34 has reduced deformation caused by the shearing force. The nonwoven fabric layer 34 can suppress the deformation of the double-stick tape t10 caused by the shearing force.

The nonwoven fabric layer 34 functions as the support of the double-stick tape t10. When the double-stick tape t10 is stuck, wrinkles are less likely to be generated due to the nonwoven fabric layer 34. The nonwoven fabric layer 34 can facilitate the sticking work of the double-stick tape t1.

The nonwoven fabric layer 34 can absorb shear stress. The nonwoven fabric layer 34 can suppress the vibration caused by the shear stress. The nonwoven fabric layer 34 can terminate the vibration caused by the shear stress in a short time. An effect of absorbing the shear stress can develop a vibration absorbing effect. The vibration absorbing effect can suppress the vibration transmitted to the adherend s1*x*. As a result, the separation of the adherend s1*x* can be suppressed.

The effect due to the nonwoven fabric layer and the effect due to the resin layer which is free of bubbles can be simultaneously obtained by using the nonwoven fabric layer 34 and the resin layer 32 which is free of bubbles together.

Figure 4:
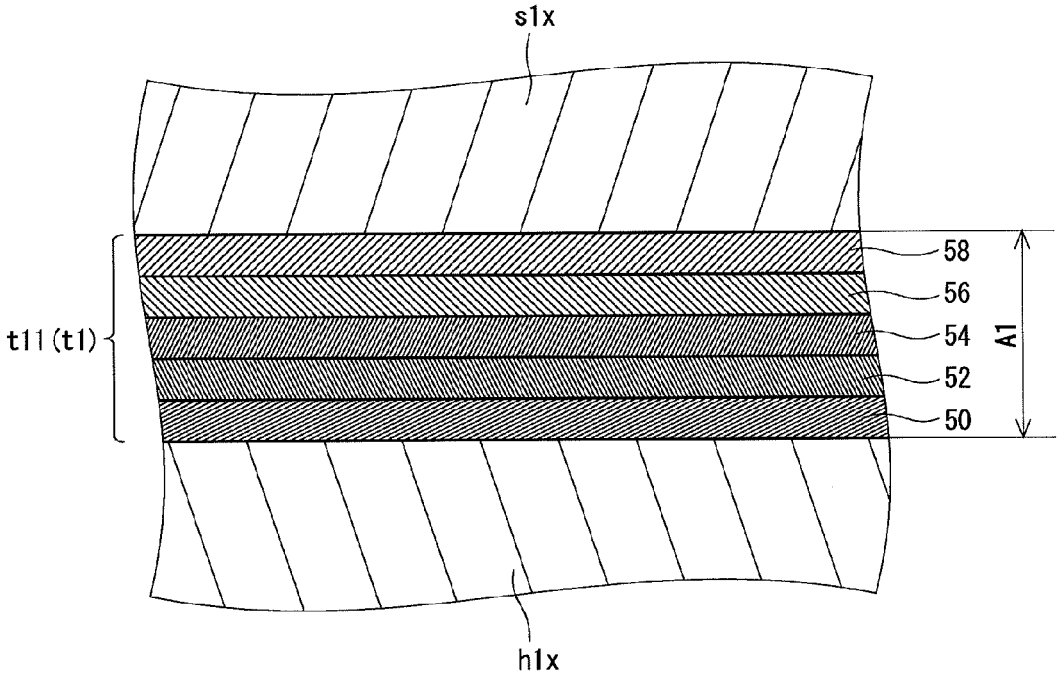
FIG. 4 is an expanded cross sectional view of the vicinity of a double-stick tape in a second embodiment.

FIG. 4 is an expanded cross sectional view of a double-stick tape t1 in a golf club head of a second embodiment. Although not shown in the drawings, a head body and an adherend in the second embodiment are the same as the head body h1*x* and the adherend s1*x* in the head 2*x*. In the second embodiment, the double-stick tape t1 is a double-stick tape t11 having a five-layered structure.

The five layers are a first layer 50, a second layer 52, a third layer 54, a fourth layer 56 and a fifth layer 58 in order from the side of the head body h1*x*. The first layer 50 is an innermost layer of the double-stick tape t11. The first layer 50 is an adhesive layer. The first layer 50 is a first adhesive layer. The second layer 52, the third layer 54 and the fourth layer 56 are intermediate layers. The fifth layer 58 is an adhesive layer. The fifth layer 58 is an outermost layer of the double-stick tape t11. The fifth layer 58 is a second adhesive layer. Although boundaries between the layers are flatly shown in FIG. 4, unevennesses may exist in the boundaries. Particularly, a boundary between the nonwoven fabric layer and the other layer is usually uneven.

The first adhesive layer 50 is bonded to the head body h1*x*. The second adhesive layer 58 is bonded to the adherend s1*x*. The adherend s1*x* is bonded to the head body h1*x* by the double-stick tape t11.

The first layer 50 and the fifth layer 58 are layers made of an adhesive compound. The adhesive compound is not limited. As the adhesive compound, an acrylic adhesive compound, an epoxy adhesive compound, and a urethane adhesive compound or the like are exemplified.

The second layer 52 and the fourth layer 56 are resin layers which are free of bubbles. The second layer 52 and the fourth layer 56 are an unfoamed resin film. The second layer 52 and the fourth layer 56 are not a resin form layer. The kind of a resin forming the resin layer which is free of bubbles is not limited. As a base material resin of the resin layer, an acrylic resin and a polyester resin are exemplified.

The third layer 54 is a fiber layer. A empty space exists in the fiber layer. A part of the resin layer 52 adjacent to the third layer 54 enters the empty space. A part of the resin layer 56 adjacent to the third layer 54 enters the empty space. The entering enhances the strength of the double-stick tape t11 to the shearing force.

The fiber layer 54 has excellent strength. The fiber layer 54 has reduced deformation caused by the shearing force. The fiber layer 54 can suppress the deformation of the double-stick tape t11 caused by the shearing force.

The fiber layer 54 functions as a support of the double-stick tape t1. When the double-stick tape t11 is stuck, wrinkles are less likely to be generated due to the fiber layer 54. The fiber layer 54 can facilitate the sticking work of the double-stick tape t11.

The fiber layer 54 can absorb shear stress. The fiber layer 54 can suppress the vibration caused by the shear stress. The fiber layer 54 can terminate the vibration caused by the shear stress in a short time. An effect of absorbing the shear stress can develop a vibration absorbing effect.

The effect due to the fiber layer 54 and the effect due to the resin layer which is free of bubbles can be simultaneously obtained by using the fiber layer 54 and the resin layer which is free of bubbles together.

The fiber of the third layer 54 is a nonwoven fabric. That is, the third layer 54 is a nonwoven fabric layer. A empty space exists in the nonwoven fabric. A part of the resin layer 52 adjacent to the third layer 54 enters the empty space. A part of the resin layer 56 adjacent to the third layer 54 enters the empty space. The entering enhances the strength of the double-stick tape t11 to the shearing force.

The nonwoven fabric layer 54 has excellent strength. The nonwoven fabric layer 54 has reduced deformation caused by the shearing force. The nonwoven fabric layer 54 can suppress the deformation of the double-stick tape t11 caused by the shearing force.

The nonwoven fabric layer 54 functions as the support of the double-stick tape t11. When the double-stick tape t11 is stuck, wrinkles are less likely to be generated due to the nonwoven fabric layer 54. The nonwoven fabric layer 54 can facilitate the sticking work of the double-stick tape t11.

The nonwoven fabric layer 54 may absorb shear stress. The nonwoven fabric layer 54 can suppress the vibration caused by the shear stress. The nonwoven fabric layer 54 can terminate the vibration caused by the shear stress for a short time. An effect of absorbing the shear stress can develop a vibration absorbing effect.

The resin layer which is free of bubbles can suppress the deformation of the double-stick tape t11 caused by the shearing force. The resin layer which is free of bubbles has higher strength than that of the resin layer having bubbles. The resin layer which is free of bubbles can enhance the strength of the double-stick tape t11.

The effect due to the nonwoven fabric layer and the effect due to the resin layer which is free of bubbles can be simultaneously obtained by using the nonwoven fabric layer and the resin layer which is free of bubbles together.

The resin layer is interposed between the nonwoven fabric layer and the adhesive layer, and thereby the separation of the nonwoven fabric layer in the boundary surface can be effectively suppressed. In the double-stick tape t11, the resin layer 52 is disposed on one surface of the nonwoven fabric layer 54, and the resin layer 56 is disposed on the other surface of the nonwoven fabric layer 54. Since the resin layers are disposed on both the surface of the nonwoven fabric layer 54, the separation of the nonwoven fabric layer 54 in the boundary surface can be effectively suppressed.

Figure 5:
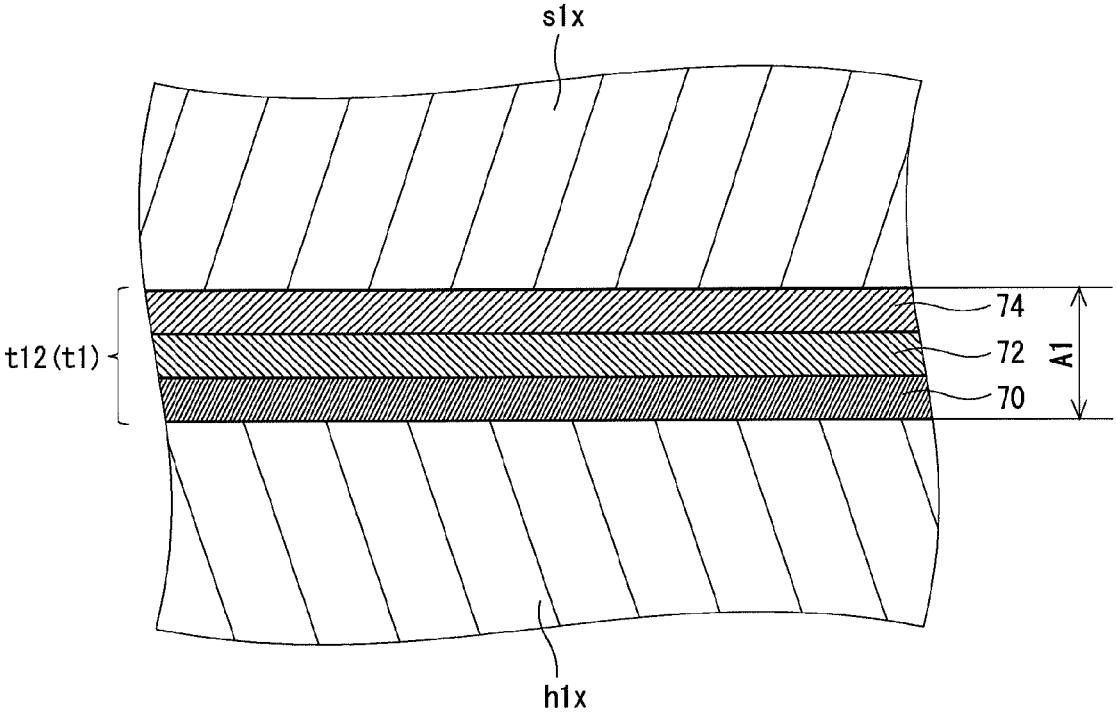
FIG. 5 is an expanded cross sectional view of the vicinity of a double-stick tape in a third embodiment.

FIG. 5 is an expanded cross sectional view of a double-stick tape t1 in a golf club head of a third embodiment. Although not shown in the drawings, a head body and an adherend in the third embodiment are the same as the head body h1*x* and the adherend s1*x* in the head 2*x*. In this third embodiment, the double-stick tape t1 is a double-stick tape t12 having a three-layered structure.

The three layers are a first layer 70, a second layer 72 and a third layer 74 in order from the side of the head body h1*x*. The first layer 70 is an innermost layer of the double-stick tape t12. The first layer 70 is an adhesive layer. The first layer 70 is a first adhesive layer. The second layer 72 is an intermediate layer. The third layer 74 is an adhesive layer. The third layer 74 is an outermost layer of the double-stick tape t12. The third layer 74 is a second adhesive layer. Although boundaries between the layers are flatly shown in FIG. 5, unevennesses may exist in the boundaries.

The first adhesive layer 70 is bonded to the head body h1*x*. The second adhesive layer 74 is bonded to the adherend s1*x*. The adherend s1*x* is bonded to the head body h1*x* by the double-stick tape t12.

The first layer 70 and the third layer 74 are layers made of an adhesive compound. The adhesive compound is not limited. As the adhesive compound, an acrylic adhesive compound, an epoxy adhesive compound, and a urethane adhesive compound or the like are exemplified.

The second layer 72 is a resin layer which is free of bubbles. The second layer 72 is an unfoamed resin film. The second layer 72 is not a resin form layer. The kind of a resin forming the second layer 72 is not limited. As a base material resin of the resin layer, an acrylic resin and a polyester resin are exemplified.

The resin layer which is free of bubbles can suppress the deformation of the double-stick tape t12 caused by the shearing force. The resin layer which is free of bubbles has higher strength than that of the resin layer having bubbles. The resin layer which is free of bubbles can enhance the strength of the double-stick tape t12.

Figure 6:
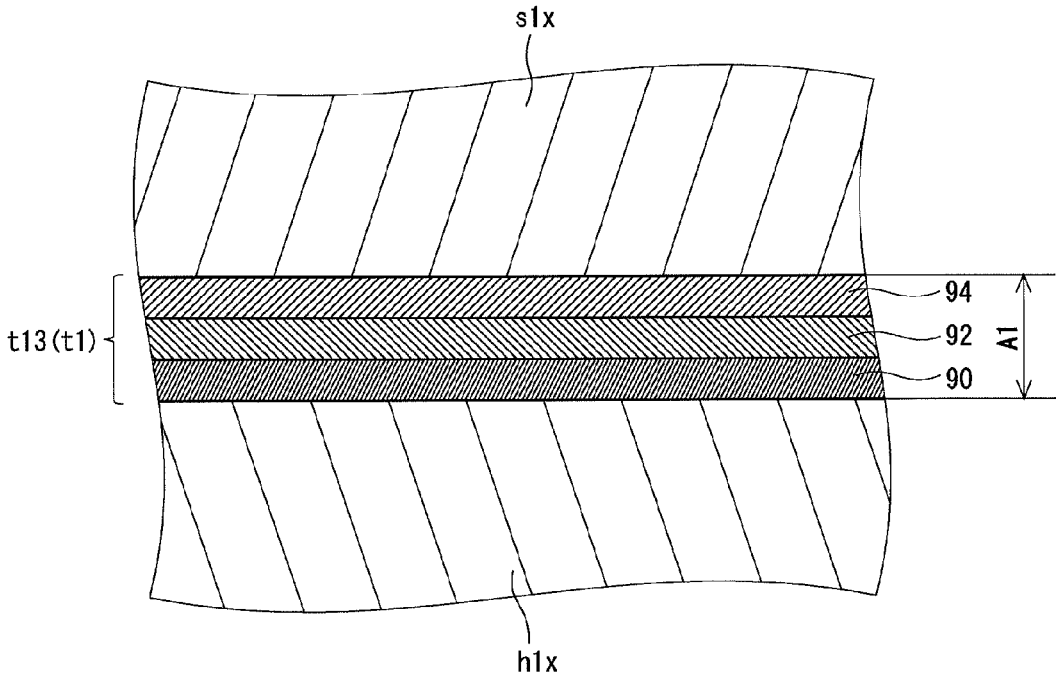
FIG. 6 is an expanded cross sectional view of the vicinity of a double-stick tape in a fourth embodiment.

FIG. 6 is an expanded cross sectional view of a double-stick tape t1 in a golf club head of a fourth embodiment. Although not shown in the drawings, a head body and an adherend in the fourth embodiment are the same as the head body h1*x* and the adherend s1*x* in the head 2*x*. In the fourth embodiment, the double-stick tape t1 is a double-stick tape t13 having a three-layered structure.

The three layers are a first layer 90, a second layer 92 and a third layer 94 in order from the side of the head body h1*x*. The first layer 90 is an innermost layer of the double-stick tape t13. The first layer 90 is an adhesive layer. The first layer 90 is a first adhesive layer. The second layer 92 is an intermediate layer. The third layer 94 is an adhesive layer. The third layer 94 is an outermost layer of the double-stick tape t13. The third layer 94 is a second adhesive layer. Although boundaries between the layers are flatly shown in FIG. 6, unevennesses may exist in the boundaries. A boundary between the nonwoven fabric layer and the other layer is usually uneven.

The first adhesive layer 90 is bonded to the head body h1*x*. The second adhesive layer 94 is bonded to the adherend s1*x*. The adherend s1*x* is bonded to the head body h1*x* by the double-stick tape t11.

The first layer 90 and the third layer 94 are layers made of an adhesive compound. The adhesive compound is not limited. As the adhesive compound, an acrylic adhesive compound, an epoxy adhesive compound, and a urethane adhesive compound or the like are exemplified.

The second layer 92 is a fiber layer. A empty space exists in the fiber layer. A part of the adhesive layer 90 adjacent to the second layer 92 enters the empty space. A part of the adhesive layer 94 adjacent to the second layer 92 enters the empty space. The entering enhances the strength of the double-stick tape t13 to the shearing force.

The fiber layer 92 has excellent strength. The fiber layer 92 has reduced deformation caused by the shearing force. The fiber layer 92 can suppress the deformation of the double-stick tape t13 caused by the shearing force.

The fiber layer 92 functions as a support of the double-stick tape t13. When the double-stick tape t13 is stuck, wrinkles are less likely to be generated due to the fiber layer 92. The fiber layer 92 can facilitate the sticking work of the double-stick tape t13.

The fiber layer 92 can absorb shear stress. The fiber layer 92 can suppress the vibration caused by the shear stress. The fiber layer 92 can terminate the vibration caused by the shear stress in a short time. An effect of absorbing the shear stress can develop a vibration absorbing effect. The double-stick tape t13 having the fiber layer 92 is less likely to be separated by repeated hitting.

The fiber of the second layer 92 is a nonwoven fabric. That is, the second layer 92 is a nonwoven fabric layer. A empty space exists in the nonwoven fabric. A part of the adhesive layer 90 adjacent to the second layer 92 enters the empty space. A part of the adhesive layer 94 adjacent to the second layer 92 enters the empty space. The entering enhances the strength of the double-stick tape t13 to the shearing force.

The nonwoven fabric layer 92 has excellent strength. The nonwoven fabric layer 92 has reduced deformation caused by the shearing force. The nonwoven fabric layer 92 can suppress the deformation of the double-stick tape t13 caused by the shearing force.

The nonwoven fabric layer 92 functions as a support of the double-stick tape t13. When the double-stick tape t13 is stuck, wrinkles are less likely to be generated due to the nonwoven fabric layer 92. The nonwoven fabric layer 92 can facilitate the sticking work of the double-stick tape t13.

The nonwoven fabric layer 92 can absorb shear stress. The nonwoven fabric layer 92 can suppress the vibration caused by the shear stress. The nonwoven fabric layer 92 can terminate the vibration caused by the shear stress for a short time. An effect of absorbing the shear stress can develop a vibration absorbing effect. The double-stick tape t13 having the nonwoven fabric layer 92 is less likely to be separated by repeated hitting.

A thickness of the double-stick tape t1 is shown by a double-pointed arrow A1 in FIG. 3 or the like. In light of suppressing the shear deformation, the thickness A1 is preferably thin. From this viewpoint, the thickness A1 is preferably equal to or less than 0.5 mm, more preferably equal to or less than 0.3 mm, and still more preferably equal to or less than 0.25 mm In light of the ease of the sticking work, of the productivity of the double-stick tape, and of the cost reduction, the thickness A1 is preferably equal to or greater than 0.1 mm, more preferably equal to or greater than 0.15 mm, and still more preferably equal to or greater than 0.2 mm.

In light of enhancing the adhesiveness of the adhesive layer and the resin layer, the kind of the base material resin of the adhesive layer is preferably the same as that of the resin layer which is free of bubbles. For example, when the base material resin of the adhesive layer is the acrylic resin, the base material resin of the resin layer which is free of bubbles is also preferably the acrylic resin. The enhancement of the adhesiveness suppresses the separation in the boundary surface between the layers. The enhancement of the adhesiveness can suppress the shear deformation of the double-stick tape t1.

The adherend s1*x* is preferably disposed on the back side of the face surface. The double-stick tape t1 is preferably disposed between the back surface of the face part and the adherend s1*x*. A ball impacts the face part directly. When the ball is hit, a great impact force acts on the face part. Therefore, when the double-stick tape t1 is disposed on the back side of the face surface, the effect of the aspect is significantly exhibited.

In the embodiment of FIG. 2, the head body h1*x* between the face surface 4*x* and the double-stick tape t1 is solid. When the head body h1*x* is solid, the impact shock on the face surface 4*x* is likely to be transmitted to the double-stick tape t1. Therefore, in this case, the effect of the aspect is significantly exhibited. From this viewpoint, the head body h1*x* between the face surface 4*x* and the double-stick tape t1 is preferably solid.

The material of the adhesive layer is not limited. When the adherend s1*x* is attached to the outer surface of the head, the double-stick tape t1 may be protruded from the outer edge of the adherend s1*x*. The protruded double-stick tape t1 is exposed to the outside. The protruded double-stick tape t1 may be visually recognized. The protruded double-stick tape t1 is preferably inconspicuous. Considering the case where the double-stick tape t1 is exposed to the outside, it is preferable that the adhesive layer has transparency and weatherability. From this viewpoint, the material of the adhesive layer is preferably the acrylic adhesive compound.

The material of the resin layer which is free of bubbles is not limited. As described above, the double-stick tape t1 may be exposed to the outside. Considering the case where the double-stick tape t1 is exposed to the outside, it is preferable that the resin layer which is free of bubbles has transparency and weatherability. From this viewpoint, the base material resin of the resin layer which is free of bubbles is preferably the acrylic resin. The polyester resin is also preferable as the base material resin of the resin layer which is free of bubbles. The polyester resin has weatherability and strength.

The material of a fiber which constitutes the fiber layer is not limited. As the material of the fiber, a natural fiber, a synthetic fiber and a regenerated fiber are exemplified. As the synthetic fiber, vinylon, polyester, polypropylene, polyethylene and nylon are exemplified. As the natural fiber, pulp and hemp are exemplified. As the regenerated fiber, rayon is exemplified. In light of the weatherability and the strength, the synthetic fiber is preferable, and polyester and nylon are more preferable. The fiber layer may be a layer produced by weaving fibers, or may be the nonwoven fabric layer.

When the fiber layer is the nonwoven fabric layer, the material of the nonwoven fabric which constitutes the nonwoven fabric layer is not limited. As the material of the nonwoven fabric, a natural fiber, a synthetic fiber and a regenerated fiber are exemplified. As the synthetic fiber, vinylon, polyester, polypropylene, polyethylene and nylon are exemplified. As the natural fiber, pulp and hemp are exemplified. As the regenerated fiber, rayon is exemplified. In light of the weatherability and the strength, the synthetic fiber is preferable, and polyester and nylon are more preferable.

The specific examples of the double-stick tapes which may be used for the aspect include "Y-4625" (trade name), "VHX-802" (trade name), "Y-9448HK" (trade name), "4393" (trade name), "Y-9448HK" (trade name), "Y-9448HKB" (trade name) and "Y-9448SK" (trade name). All of them are produced by the Sumitomo 3M Limited.

A thickness between the face surface 4*x* and the double-stick tape t1 is shown by a double-pointed arrow d1*x* in FIG. 2. In the embodiment, the thickness d1*x* is the thickness of the second thin wall part 22*x*. In light of the durability, the thickness d1*x* is preferably equal to or greater than 1.5 mm, more preferably equal to or greater than 1.8 mm, and still more preferably equal to or greater than 2.0 mm. When the thickness d1*x* is small, the vibration of the face part at the time of hitting the ball is great. When the thickness d1*x* is small, a great impact force acts on a portion on which the double-stick tape t1 is stuck. Therefore, when the thickness d1*x* is small, the effect of the aspect can be actualized. From this viewpoint, the thickness d1*x* is preferably equal to or less than 3.0 mm, more preferably equal to or less than 2.7 mm, and still more preferably equal to or less than 2.4 mm.

A contact area Sm1 of the double-stick tape t1 and the head is not limited. In light of actualizing the effect of the aspect, the contact area Sm1 is preferably equal to or greater than 900 $mm^2$, more preferably equal to or greater than 1000 $mm^2$, and still more preferably equal to or greater than 1100 $mm^2$. When the weight of the adherend s1*x* is excessive, a weight which can be distributed to the head body is reduced, and the strength of the head body is reduced. From this viewpoint, the contact area Sm1 is preferably equal to or less than 1700 $mm^2$, more preferably equal to or less than 1600 $mm^2$, and still more preferably equal to or less than 1500 $mm^2$.

The material of the adherend s1*x* is not limited. Examples of the materials of the adherend s1*x* include a metal, a resin and a viscoelastic material. The thickness of the adherend s1*x* is not limited. In light of enhancing hitting feeling while reducing the weight of the head, the thickness of the adherend s1*x* is preferably equal to or greater than 0.3 mm, more preferably equal to or greater than 0.5 mm, or preferably equal to or less than 2.0 mm, and more preferably equal to or less than 1.5 mm.

Usually, a golf player tries to hit the ball to the center of the face surface 4*x*. The ball is likely to be hit at the center of gravity of the area of the face surface 4*x*. When the double-stick tape t1 exists on the back surface of an hitting point, the impact shock transmitted to the double-stick tape t1 is great. In light of actualizing the effect of the aspect, it is preferable that the double-stick tape t1 exists on the back surface of the center of gravity of the area of the face surface 4*x*. That is, it is preferable that a straight line L1*x* passing through the center of gravity of the area of the face surface 4*x* and being perpendicular to the face surface 4*x* passes through the double-stick tape t1 and the adherend s1*x*.

The material of the head body is not limited. As the material of the head body, soft iron (low carbon steel having a carbon content of less than 0.3 wt %), CFRP (carbon fiber reinforced plastic), maraging steel, stainless steel, a titanium alloy, an aluminum alloy and a magnesium alloy are exemplified. The whole of the head body may be integrally formed, or may be produced by joining a plurality of members. Forging and casting are exemplified as a process for forming the head body.

The material of the face part is not limited. As the material of the face part, soft iron (low carbon steel having carbon content of less than 0.3 wt %), stainless steel, a titanium alloy, CFRP (carbon fiber reinforced plastic), maraging steel, an aluminum alloy and a magnesium alloy are exemplified.

The method for producing the nonwoven fabric which constitutes the nonwoven fabric layer is not limited. As the method for producing the nonwoven fabric, a thermal bond method, a chemical bond method, a needle punch method, a spunlace method (a water flow interlacing method), a stitch bond method and a steam jet method are exemplified. When polyester or nylon is used as the fiber, the nonwoven fabric produced by the thermal bond method is preferable in light of the productivity, the thickness accuracy and the strength.

Figure 7:
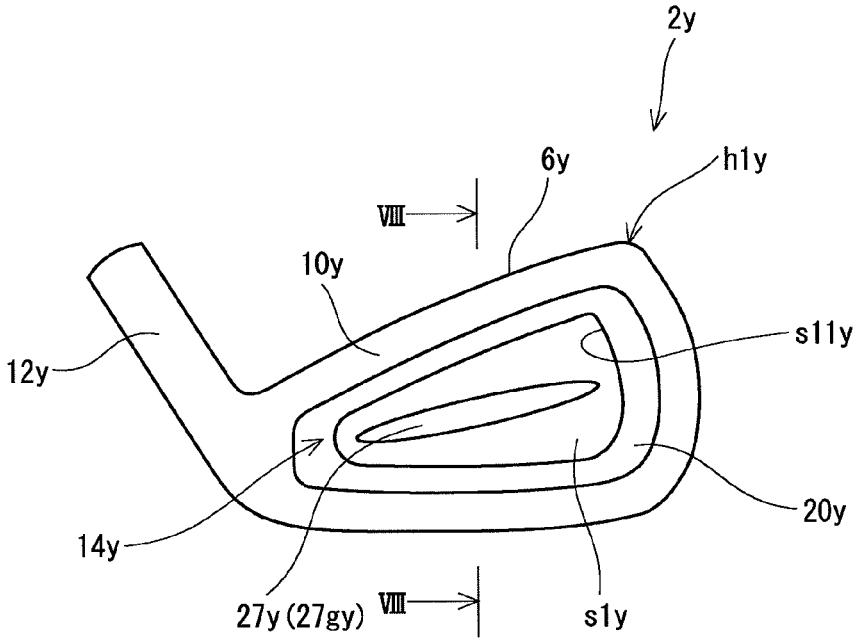
FIG. 7 is a view of a golf club head of a fifth embodiment as seen from a back surface side.
Figure 8:
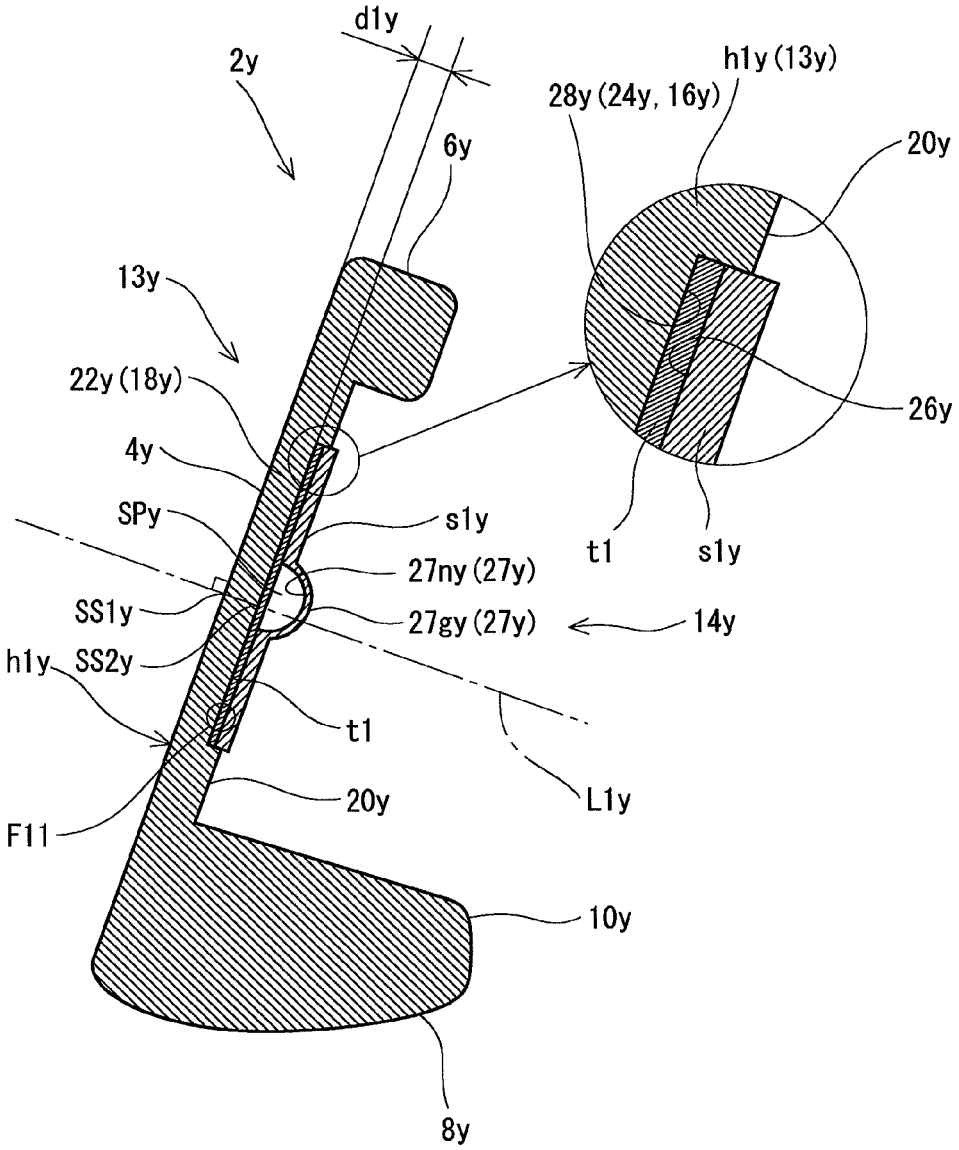
FIG. 8 is a cross sectional view taken along a line VIII-VIII in FIG. 7.

FIG. 7 is a view of a golf club head 2*y* according to a fifth embodiment as seen from a back surface side. FIG. 8 is a cross sectional view taken along a line VIII-VIII in FIG. 7. The head 2*y* is an iron type golf club head. The head 2*y* has a head body h1*y*, an adherend s1*y* and a double-stick tape t1. The adherend s1*y* is a thin plate-shaped member. The adherend s1*y* is typically a badge. The adherend s1*y* is made of a metal, a resin or the like. Typically, logos and characters which represent trade names or the like are indicated on the adherend s1*y*. A profile line s11*y* of the adherend s1*y* is shown in FIG. 7.

The double-stick tape t1 is interposed between the adherend s1*y* and the head body h1*y*. The adherend s1*y* is bonded to the head body h1*y* by the double-stick tape t1. The profile shape of the double-stick tape t1 and the profile shape of the adherend s1*y* are substantially equal.

The shape of the double-stick tape t1 is not limited. The width and length of the double-stick tape t1 are not limited. The double-stick tape t1 is a sheet having both surfaces having adhesiveness.

The double-stick tape t1 is shown as a single layer in FIG. 8. However, in fact, the double-stick tape t1 is formed of a plurality of layers as described later.

The head body h1*y* has a face part 13*y* provided with a face surface 4*y*, a top surface 6*y*, a sole surface 8*y*, a back surface 10*y* and a hosel part 12*y*. The face part 13*y* is a portion having the face surface 4*y* as an outer surface. The face part 13*y* is solid. A main body recessed part 14*y* is formed on the back surface 10*y*. The main body recessed part 14*y* is formed on the reverse side of the face surface 4*y*. The head 2*y* having the main body recessed part 14*y* is generally referred to as a cavity back iron. The main body recessed part 14*y* forms a so-called cavity back. The face part is thinned by the main body recessed part 14*y*. A thin wall part (a first thin wall part) 18*y* is formed by the main body recessed part 14*y*. The thin wall part 18*y* is a part of the face part 13*y*. The thin wall part 18*y* is solid. The adherend s1*y* is stuck on the back surface of the head 2*y*. The adherend s1*y* is stuck on the back surface of the thin wall part 18*y*. The front surface of the thin wall part 18*y* is the face surface 4*y*. The back surface of the thin wall part 18*y* is a bottom surface 20*y* of the main body recessed part 14*y*. A sweet spot SS1*y* of the head 2*y* is located in the thin wall part 18*y*. The sweet spot SS1*y* is a point of intersection between a line passing through the center of gravity of the head 2*y* and being perpendicular to the face surface 4*y* and the face surface 4*y*.

In light of the durability, the thickness of the thin wall part 18*y* is preferably equal to or greater than 1.5 mm, more preferably equal to or greater than 1.8 mm, and still more preferably equal to or greater than 2.0 mm. When the thin wall part 18*y* is thin, the vibration of the face part at the time of hitting a ball is great. When the thin wall part is thin, a great impact force acts on a portion on which a double-stick tape is stuck. Therefore, in this case, the effect of the aspect may be actualized. From this viewpoint, the thickness of the thin wall part is preferably equal to or less than 3.0 mm, more preferably equal to or less than 2.7 mm, and still more preferably equal to or less than 2.4 mm.

Although illustration is omitted, an impact area marking is formed on the face surface 4*y*. The impact area marking is typically a face line (face groove).

A recessed part 16*y* is further formed inside the main body recessed part 14*y*. The recessed part (the second recessed part) 16*y* is formed on the bottom surface 20*y* of the main body recessed part (the first recessed part) 14*y*. The second recessed part 16*y* is shallower than the main body recessed part 14*y*. The depth of the second recessed part 16*y* is greater than thickness of the double-stick tape t1. The second recessed part 16*y* accommodates the whole of the double-stick tape t1. The profile shape of the second recessed part 16*y* and the profile shape of the adherend s1*y* are substantially equal.

The face part is further thinned by the second recessed part 16*y*. A second thin wall part 22*y* is formed by the second recessed part 16*y*. The second thin wall part 22*y* is a part of the first thin wall part 18*y*. The second thin wall part 22*y* is solid. The adherend s1*y* is stuck on the back surface of the second thin wall part 22*y*. The sweet spot SS1*y* of the head 2*y* is located in the second thin wall part 22*y*. The front surface of the second thin wall part 22*y* is the face surface 4*y*. The back surface of the second thin wall part 22*y* is a bottom surface 24*y* of the second recessed part 16*y*. The bottom surface 24*y* is a part of the bottom surface 20*y*.

The second recessed part 16*y* may not be provided. That is, the whole of the bottom surface 20*y* of the main body recessed part 14*y* may be a plane. In the aspect, the shape of the bonded surface of the head body h1*y* is not limited.

Figure 9:
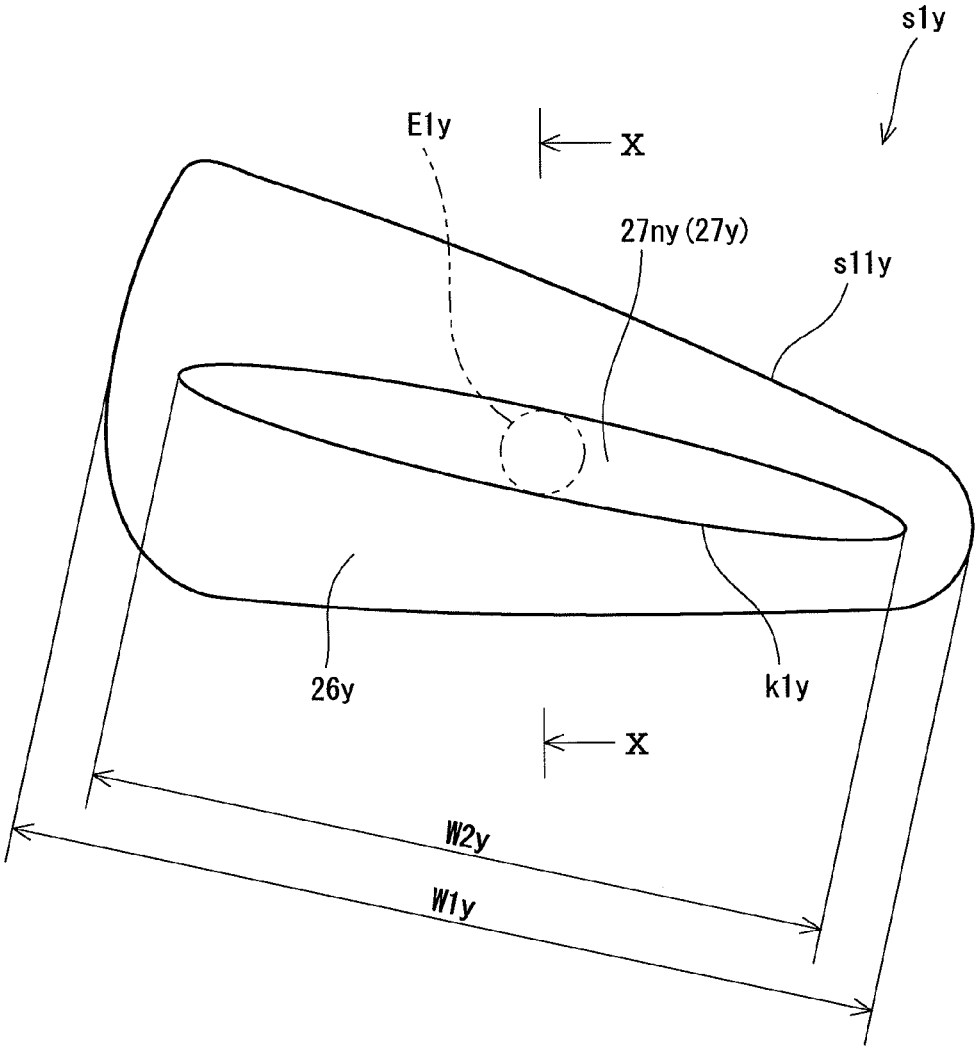
FIG. 9 is a view of an adherend used for the head of FIG. 7 as seen from a bonded surface side.
Figure 10:
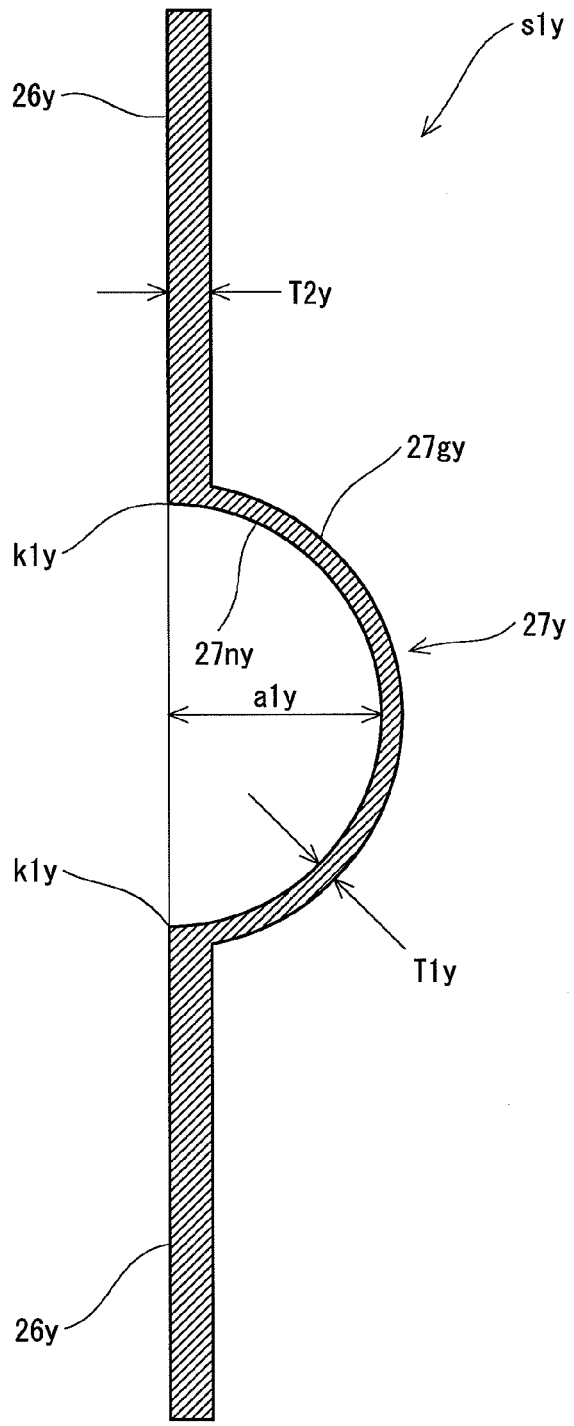
FIG. 10 is a cross sectional view taken along a line X-X in FIG. 9.

FIG. 9 is a plan view of the adherend s1*y*. FIG. 9 is a view of the adherend s1*y* as seen from the bonded surface side. FIG. 10 is a cross sectional view taken along a line X-X in FIG. 9.

The adherend s1*y* has an approximately plate shape as a whole. The adherend s1*y* has a bonded surface 26*y* and a recessed part 27*y*. In the existence region of the bonded surface 26*y*, the adherend s1*y* is a flat plate.

As shown in an enlarged part of FIG. 8, the bonded surface 26*y* is brought into contact with the double-stick tape t1. The bonded surface 26*y* adheres to the double-stick tape t1. The bonded surface 26*y* and a bonded surface 28*y* of the head body h1*y* are bonded with each other by the double-stick tape t1. The bonded surface 26*y* is a plane.

The head body h1*y* has the bonded surface 28*y*. The bonded surface 28*y* is the above-mentioned bottom surface 24*y*. The bonded surface 28*y* is a plane. The bonded surface 28*y* is brought into contact with the double-stick tape t1. The bonded surface 28*y* is a back surface of the head body h1*y*. The bonded surface 28*y* is a back surface of the face surface 4*y*.

As shown in FIGS. 7 and 9, the whole shape of the recessed part 27*y* is an elongated ellipse shape. The recessed part 27*y* extends so as to be closer to an upper side toward a toe side. As shown in FIG. 7, the recessed part 27*y* is recessed toward the outer side of the head.

The recessed part 27*y* has an outer surface 27*gy* and an inner surface 27*ny*. The bonded surface 26*y* and the inner surface 27*ny* are adjacent to each other. That is, the bonded surface 26*y* and the inner surface 27*ny* are continuous. The bonded surface 26*y* and the inner surface 27*ny* are adjacent to each other in a boundary k1*y*. The cross-section shape of the inner surface 27*ny* is an approximately circular arc. The cross-section shape of the outer surface 27*gy* is an approximately circular arc.

The cross-section shape of the recessed part 27*y* is not limited. As the section shape, a semicircle shape, a triangle shape and a square shape (rectangular shape) or the like are exemplified.

On the reverse surface of the recessed part 27*y*, a protruding part is formed. The recessed part 27*y* forms the protruding part toward the outside. The protruding part provides a three-dimensional image. The protruding part enhances the flexibility of the design of the head.

As shown in FIG. 8, the inner surface 27*ny* of the recessed part 27*y* is not brought into contact with the double-stick tape t1. A space SPy exists between the inner surface 27*ny* of the recessed part 27*y* and the double-stick tape t1. The space SPy is formed by the recessed part 27*y* and the double-stick tape t1.

The space SPy is in a closed state. The recessed part 27*y* does not reach the side surface of the adherend s1*y*. The circumference of the recessed part 27*y* is surrounded by the bonded surface 26*y*. That is, the circumference of the recessed part 27*y* is sealed. The opening of the recessed part 27*y* is closed by the double-stick tape t1 and the head body h1*y*. The recessed part 27*y* has no through-hole. The space SPy is not communicated with an outer space.

When water or the like enters the recessed part 27*y*, the bonding strength may be reduced. Since the space SPy is a closed state in the head 2*y*, water or the like does not enter the recessed part 27*y*.

When the double-stick tape t1 is stuck on the bonded surface 26*y*, air may enter between the double-stick tape t1 and the bonded surface 26*y*. The air may remain as bubbles. The bubbles weaken the bonding strength of the double-stick tape t1.

The bubbles form a clearance between the double-stick tape t1 and the bonded surface 26*y*. The clearance is narrow. This is because the double-stick tape t1 and the bonded surface 26*y* adhere to each other in a portion in which the bubbles do not exist. Since the distance of the clearance is narrow, the bubbles extend in a wide range even when the volume of bubbles is small. That is, the bubbles may extend as a thin air layer. In the present application, the "bubbles" include the air layer. The bubbles are apt to decrease the bonding strength. Layered bubbles reduce the bonding strength of the double-stick tape t1.

The recessed part 27*y* can take in the bubbles. The bubbles can be taken into the space SPy inside the recessed part 27*y*. Since the bonded surface 26*y* and the inner surface 27*ny* are adjacent to each other, the bubbles can move to the recessed part 27*y*. The recessed part 27*y* can decrease the bubbles.

The depth of the recessed part 27*y* is shown by a double-pointed arrow a1*y* in FIG. 10. In light of facilitating the release of the bubbles into the space SPy, the depth a1*y* is preferably equal to or greater than 0.5 mm, more preferably equal to or greater than 1.0 mm, and still more preferably equal to or greater than 1.5 mm. In light of the strength of the adherend s1*y*, the depth a1*y* is preferably equal to or less than 5 mm, more preferably equal to or less than 4 mm, still more preferably equal to or less than 3 mm, and particularly preferably equal to or less than 2 mm.

When the adherend s1*y* is attached to the head body h1*y*, for example, the adherend s1*y* is pressed against the head body h1*y*. The bubbles can flow into the space SPy according to the pressing force. The reduction in the bubbles increases the adhesion area to enhance the bonding strength.

The bubbles generated near the center of the adherend s1*y* are less likely to reach the side surface of the adherend s1*y*. The bubbles generated near the center of the adherend s1*y* are less likely to be discharged to the outside. In light of removing the bubbles generated near the center of the adherend s1*y*, the recessed part 27*y* is preferably provided near the center of the adherend s1*y*. From this viewpoint, a centroid of a figure drawn by the profile line s11*y* is preferably located inside the recessed part 27*y* in a plan view as shown in FIG. 9.

The recessed part 27*y* is not brought in contact with the double-stick tape t1. Therefore, the recessed part 27*y* is more likely to vibrate as compared with another portion of the adherend s1*y*. The vibration caused by the impact shock at the time of hitting the ball can be absorbed by the vibration of the recessed part 27*y*. The recessed part 27*y* can absorb the undesirable vibration at the time of hitting the ball. The vibrational absorption can attain a good hitting feeling.

The double-stick tape t1 is provided with an adhesive layer and a base material layer. The double-stick tape t1 has elasticity. The double-stick tape t1 has vibrational absorbability.

The head 2*y* can develop the vibrational absorbability due to the double-stick tape t1 in addition to the vibrational absorbability due to the recessed part 27*y*. The head 2*y* has high vibrational absorbability.

As shown in FIG. 8, in the embodiment, the existence region of the adherend s1*y* includes a back surface point SS2*y* of a sweet spot SS1*y*. That is, a straight line L1*y* passing through the center of gravity of the head 2*y* and the sweet spot SS1*y* intersects with the adherend s1*y*. The sweet spot SS1*y* is a point of intersection of a perpendicular line led to the face surface 4*y* from the center of gravity of the head 2*y* and the face surface 4*y*. The back surface point SS2*y* is a point of intersection of the straight line L1*y* and the back surface of the head body h1*y*. In FIG. 8, the straight line L1*y* is shown by a one-dotted chain line. The point of intersection of the straight line L1*y* and the adherend s1*y* may exist on the bonded surface 26*y*, or may exist in the recessed part 27*y*. In the embodiment of FIG. 8, the point of intersection of the straight line L1*y* and the adherend s1*y* exists in the recessed part 27*y*. The back surface point SS2*y* exists on the bonded surface 28*y*. In light of the effective absorption of the vibration at the time of hitting the ball at the sweet spot SS1*y*, it is preferable that the point of intersection of the straight line L1*y* and the adherend s1*y* exists in the recessed part 27*y*.

A thickness of the recessed part 27*y* is shown by a double-pointed arrow T1*y* in FIG. 10. A thickness of the adherend s1*y* other than the recessed part 27*y* is shown by a double-pointed arrow T2*y* in FIG. 10. In light of enhancing the vibrational absorbability, a constitution in which the recessed part 27*y* is likely to vibrate is preferable. From this viewpoint, when the average value of the thickness T2*y* is defined as T21 and the maximum value of the thickness T2*y* is defined as T22, the following item (a1) is preferable, more preferably the item (a2), still more preferably the item (a3), and particularly preferably the item (a4).

(a1) The thickness T1*y* is equal to or less than the thickness T22.

(a2) The thickness T1*y* is smaller than the thickness T22.

(a3) The thickness T1*y* is equal to or less than the thickness T21.

(a4) The thickness T1*y* is smaller than the thickness T21.

In light of the recessed part 27*y* being likely to vibrate, it is more preferable that the maximum value of the thickness T1*y* is smaller than the minimum value of the thickness T2*y*.

The adherend s1*y* and the double-stick tape t1 form a composite body. The composite body can exhibit a vibration absorbing effect. When the weight of the double-stick tape t1 is too small, the vibration absorbing effect of the composite body decreases. From this viewpoint, the weight of the double-stick tape t1 is preferably equal to or greater than 0.1 g, and more preferably equal to or greater than 0.2 g. In light of the weight saving, the weight of the double-stick tape t1 is preferably equal to or less than 2 g, and more preferably equal to or less than 1 g.

A ratio (T1*y*/T2*y*) of the thickness T1*y* to the thickness T2*y* is not limited. When the thickness T2*y* is too thin, the sticking workability is reduced, or the vibration absorbing effect of the composite body is reduced. On the other hand, the thinner thickness T1*y* can contribute to the weight saving. The recessed part and each of parts of the adherend s1*y* are easily deformed by thinning the thickness T1*y*. Particularly, when the thickness T1*y* is thinned, the adherend s1*y* is likely to be expanded or contracted in a direction (in-plane direction) parallel to the bonded surface 26*y*. The vibration absorbing effect can be enhanced by the deformation. From these viewpoints, the thickness T1*y* is preferably smaller than the thickness T2*y*. Furthermore, the ratio (T1*y*/T2*y*) is preferably equal to or less than 0.9, and more preferably equal to or less than 0.7. When the thickness T1*y* is too small, the producing failure of the double-stick tape t1 is apt to take place. When thickness T2*y* is too large, the weight increase is excessive. From these viewpoints, the ratio (T1*y*/T2*y*) is preferably equal to or greater than 0.2, and more preferably equal to or greater than 0.4.

The thickness T2*y* is not limited. The sticking workability is enhanced by enhancing the rigidity of the adherend s1*y* to suppress the generation of the bubbles. When the thickness T2*y* is too thin, the vibrational absorbability of the composite body is reduced. From this viewpoint, the thickness T2*y* is preferably equal to or greater than 0.5 mm, more preferably equal to or greater than 0.7 mm, and still more preferably equal to or greater than 1.0 mm. In light of the weight saving, the thickness T2*y* is preferably equal to or less than 2.0 mm, more preferably equal to or less than 1.7 mm, and still more preferably equal to or less than 1.5 mm.

The thickness T1*y* of the recessed part 27*y* is not limited. In light of the strength of the recessed part 27*y*, the thickness T1*y* is preferably equal to or greater than 0.3 mm, and more preferably equal to or greater than 0.4 mm. When the thickness T1*y* is thinned, the recessed part and the whole of the adherend s1*y* can be easily deformed to enhance the vibration absorbing effect. In light of the vibration absorbing effect and the weight saving, the thickness T1*y* is preferably equal to or less than 1.0 mm, more preferably equal to or less than 0.7 mm, and still more preferably equal to or less than 0.5 mm.

The projection area of the adherend s1*y* is defined as S1*y* ($cm^2$). The projection area S1*y* is an area of a figure drawn by the profile line s11*y* (see FIG. 9). The projection area of the recessed part 27*y* is defined as S2*y* ($cm^2$). The area S2*y* is an area of a figure drawn by the boundary k1*y*. When a plurality of recessed parts exist, the area S2*y* is the total of the projection areas of the recessed parts.

When the area S1*y* is great, the bubbles are less likely to be released to the outside. When the area S1*y* is great, the effect of the aspect can be actualized. From this viewpoint, the area S1*y* is preferably equal to or greater than 1 ($cm^2$), more preferably equal to or greater than 2 ($cm^2$), and still more preferably equal to or greater than 3 ($cm^2$). When the adherend s1*y* is formed on the back surface of the head, the area of the back surface is limited. From this viewpoint, in some cases, the area S1*y* may be preferably equal to or less than 20 ($cm^2$), and more preferably equal to or less than 15 ($cm^2$).

In light of facilitating the release of the bubbles into the recessed part, a ratio (S2*y*/S1*y*) of the area S2*y* to the area S1*y* is preferably equal to or greater than 0.1, and more preferably equal to or greater than 0.13. In light of increasing the adhesion area, the ratio (S2*y*/S1*y*) is preferably equal to or less than 0.5, and more preferably equal to or less than 0.4.

A maximum length of the adherend s1*y* is shown by a double-pointed arrow W1*y* in FIG. 9. The length W1*y* (mm) is a length of the longest line segment among line segments connecting two points on the profile line s11*y* with each other. A maximum length of the recessed part 27*y* is shown by a double-pointed arrow W2*y* in FIG. 9. The length W2*y* (mm) is a length of the longest line segment among line segments connecting two points on the boundary k1*y* with each other. In light of facilitating the movement of the bubbles in a wide range to the recessed part 27*y*, the ratio (W2*y*/W1*y*) is preferably equal to or greater than 0.4, and more preferably equal to or greater than 0.6. In light of the adhesion area, the ratio (W2*y*/W1*y*) is preferably equal to or less than 0.9, and more preferably equal to or less than 0.8.

An inscribed circle E1*y* having the maximum diameter among circles inscribed in the boundary k1*y* is drawn by a two-dotted chain line in FIG. 9. In light of combining the ease of the movement of the bubbles to the recessed part and a content of the contact area, it is preferable that the shape of the recessed part (the shape of the figure drawn by the boundary k1*y*) has a small width and is long. From this viewpoint, a diameter D1*y* of the maximum inscribed circle E1*y* is preferably equal to or less than 10 mm, more preferably equal to or less than 7 mm, and still more preferably equal to or less than 5 mm.

Figure 11:
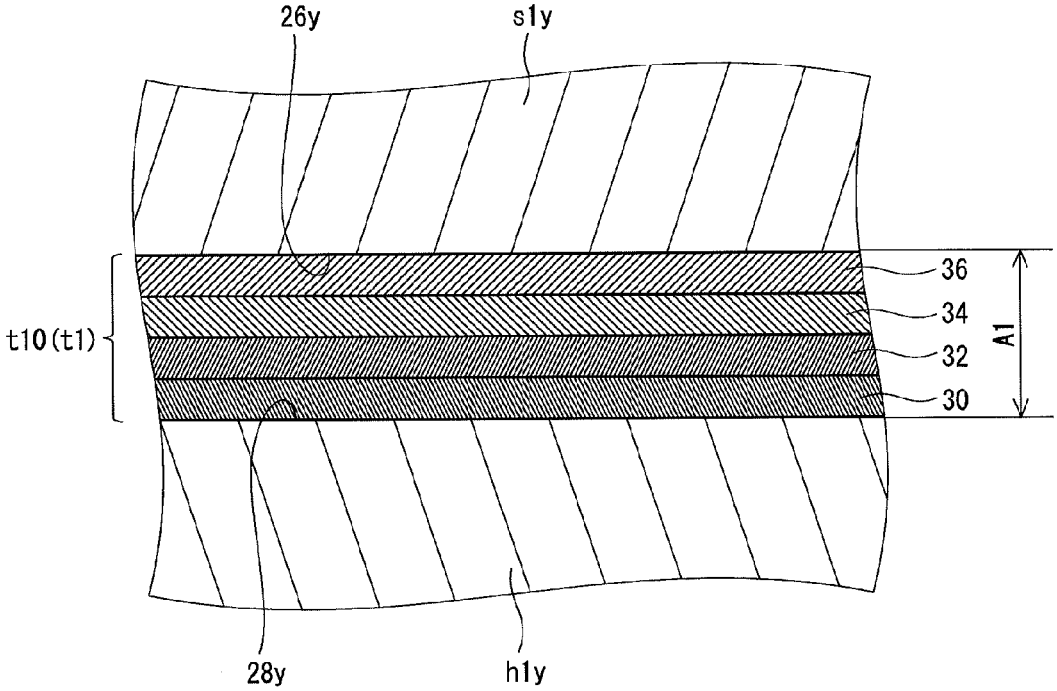
FIG. 11 is an expanded cross sectional view in a circle represented by reference numeral F11 in FIG. 8.

FIG. 11 is an expanded cross sectional view of the vicinity of the double-stick tape t1. FIG. 11 is a cross sectional view in a circle represented by reference numeral F11 in FIG. 8. The double-stick tape t1 is a double-stick tape t10 having a four-layered structure. The four layers are a first layer 30, a second layer 32, a third layer 34 and a fourth layer 36 in order from the side of the head body h1*y*. The first layer 30 is an innermost layer of the double-stick tape t10. The first layer 30 is an adhesive layer. The first layer 30 is a first adhesive layer. The second layer 32 and the third layer 34 are intermediate layers. The fourth layer 36 is an adhesive layer. The fourth layer 36 is an outermost layer of the double-stick tape t10. The fourth layer 36 is a second adhesive layer. Although boundaries between the layers are flatly shown in FIG. 11, unevennesses may exist in the boundaries. Particularly, a boundary between the nonwoven fabric layer to be described later and the other layer is usually uneven. The boundaries between the layers may be curved surfaces.

The first adhesive layer 30 abuts on a bonded surface 28 of the head body h1*y*. The second adhesive layer 36 is brought into contact with a bonded surface 26 of the adherend s1*y*.

The first layer 30 and the fourth layer 36 are layers made of an adhesive compound. The adhesive compound is not limited. As the adhesive compound, an acrylic adhesive compound, an epoxy adhesive compound, and a urethane adhesive compound or the like are exemplified.

The second layer 32 is a resin layer. The second layer 32 is a resin layer which is free of bubbles. The second layer 32 is an unfoamed resin film. The second layer 32 is not a resin form layer. The kind of a resin forming the second layer 32 is not limited. As a base material resin of the resin layer, an acrylic resin and a polyester resin are exemplified. The acrylic resin is preferable.

The resin layer is apt to be deformed by the existence of bubbles. In light of the durability and the bonding strength, the resin layer which is free of bubbles is preferable.

The third layer 34 is a fiber layer. The third layer 34 is a nonwoven fabric layer. Although not shown in the drawings, a empty space exists in the nonwoven fabric. Although not shown in the drawings, a part of the adhesive layer 36 adjacent to the third layer 34 enters the empty space. The empty space exists in the nonwoven fabric layer 34. A part of the resin layer 32 adjacent to the third layer 34 enters the empty space. Although not shown in the drawings, a part of the adhesive layer 36 adjacent to the third layer 34 enters the empty space of the nonwoven fabric layer 34.

Unlike the embodiment, the second layer 32 may be the fiber layer, and the third layer 34 may be the resin layer.

The nonwoven fabric layer 34 functions as a support of the double-stick tape t10. When the double-stick tape t10 is stuck, wrinkles are less likely to be generated due to the nonwoven fabric layer 34. The nonwoven fabric layer 34 can suppress the above-mentioned generation of bubbles.

As described above, one example of the fiber layer is the nonwoven fabric layer. However, the fiber layer is not limited to the nonwoven fabric layer. The fiber layer is a layer containing a fiber. In the fiber layer, the fiber contributes to the enhancement of tensile strength. The fiber layer can suppress the generation of wrinkles. The fiber layer can suppress the generation of bubbles.

A step of sticking the adherend s1*y* on the head body h1*y* includes, for example, a first step of sticking the double-stick tape t1 on the adherend s1*y*, and a second step of sticking the adherend s1*y* on which the double-stick tape t1 is stuck, on the head body h1*y*. When the recessed part is formed on the adherend s1*y*, the double-stick tape t1 at a position corresponding to the recessed part is in a state where the double-stick tape t1 does not abut on any part immediately after the first step. Hereinafter, the part which is not brought into contact with any part is referred to as a non-bonded part. In the second step, the whole of the double-stick tape t1 containing the non-bonded part is stuck on the head body h1*y*. In the second step, wrinkles, slacks or tears are apt to be generated in the non-bonded part. The wrinkles are apt reduce the bonding strength. The double-stick tape t1 having the fiber layer can eliminate the problems caused by the non-bonded part. The combination of the fiber layer with the resin layer can further enhance the effect.

As preferable fiber layers, for example, the following items (a), (b), (c) and (d) are exemplified.

(a) A layer containing woven fibers;

(b) A layer in which fibers are not woven but entangled with each other;

(c) A layer in which fibers are not woven but fused each other; and (d) A layer in which fibers are not woven but bonded to each other by an adhesive.

The fiber contained in the fiber layer is not limited. As the fiber, a synthetic fiber, a natural fiber and regenerated fiber are exemplified. As the synthetic fiber, a vinylon fiber, a polyester fiber, a polypropylene fiber, a polyethylene fiber and a nylon fiber are exemplified. As the natural fiber, a pulp fiber and a hemp fiber are exemplified. As the regenerated fiber, rayon is exemplified. In light of the suppression of bubbles, the synthetic fiber is preferable.

As the fiber layer, a woven fabric, a nonwoven fabric and paper are exemplified. In the present application, "paper" means Japanese paper or foreign paper. In the present application, "the nonwoven fabric" is defined as the concept which does not contain the paper.

As the materials of the Japanese paper, *Broussonetia kazinoki, Diplomorpha sikokiana* and *Edgeworthia papyrifera* are exemplified. In light of the strength, a fiber length of the Japanese paper is preferably equal to or greater than 3 mm, more preferably equal to or greater than 5 mm, still more preferably equal to or greater than 10 mm, and particularly preferably equal to or greater than 15 mm. A fiber length of the Japanese paper is usually equal to or less than 25 mm. The Japanese paper may be produced by hand-making or machine-making.

The material of the foreign paper is a broadleaf tree or a needle leaf tree. A fiber length of the foreign paper is usually 0.8 mm or greater and less than 5 mm. The foreign paper is obtained by machine-making.

As the nonwoven fabric, a wet nonwoven fabric and a dry nonwoven fabric are exemplified.

The method for producing the nonwoven fabric is not limited. As the method for producing the nonwoven fabric, a thermal bond method, a chemical bond method, a needle punch method, a spunlace method (water flow interlacing method), a stitch bond method and a steam jet method are exemplified. When the polyester fiber or the nylon fiber is used as the fiber, the nonwoven fabric produced by the thermal bond method is preferable in light of the productivity and the strength.

In light of suppressing the generation of the wrinkles or bubbles, the fiber layer is preferably the nonwoven fabric or the Japanese paper. In light of the vibrational absorbability, the nonwoven fabric is more preferable.

Figure 12:
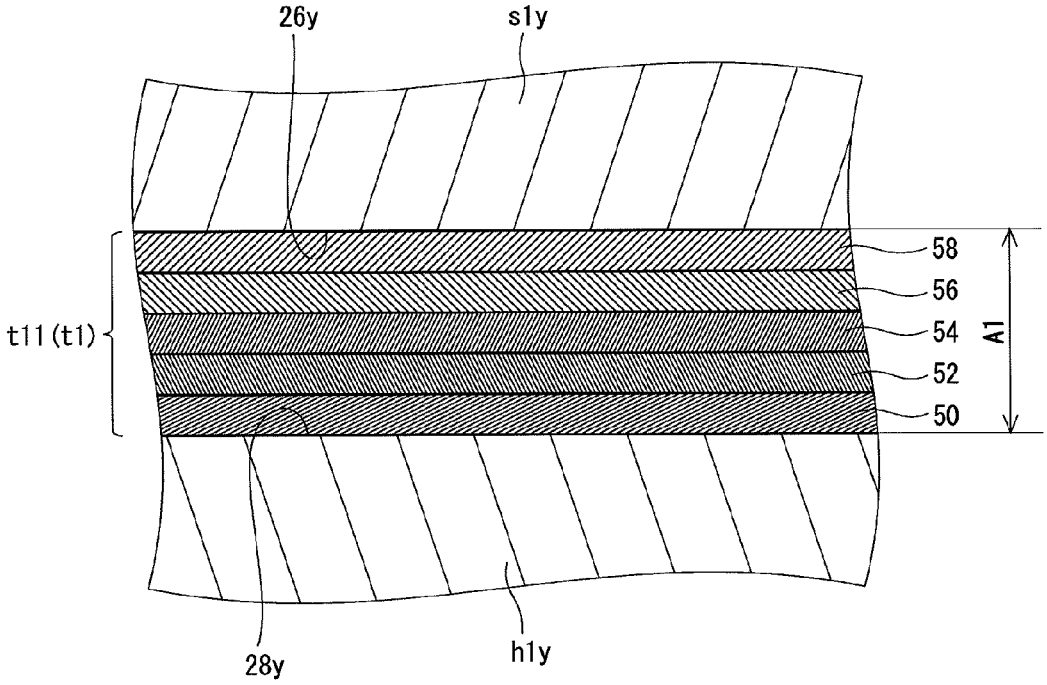
FIG. 12 is an expanded cross sectional view of a double-stick tape of a modification.

FIG. 12 is an expanded cross sectional view showing the type of usage of a double-stick tape t1 in a modification. Although not shown in the drawings, a head body h1*y* and an adherend s1*y* are the same as those of the head 2*y*. In the modification, the double-stick tape t1 is a double-stick tape t11 having a five-layered structure.

The five layers are a first layer 50, a second layer 52, a third layer 54, a fourth layer 56 and a fifth layer 58 in order from the side of the head body h1*y*. The first layer 50 is an innermost layer of the double-stick tape t11. The first layer 50 is an adhesive layer. The first layer 50 is a first adhesive layer. The second layer 52, the third layer 54 and the fourth layer 56 are intermediate layers. The fifth layer 58 is an adhesive layer. The fifth layer 58 is an outermost layer of the double-stick tape t11. The fifth layer 58 is a second adhesive layer. Although boundaries between the layers are flatly shown in FIG. 12, unevennesses may exist in the boundaries.

The first adhesive layer 50 is bonded to the head body h1*y*. The second adhesive layer 58 is bonded to the adherend s1*y*. The adherend s1*y* is bonded to the head body h1*y* by the double-stick tape t11.

The first layer 50 and the fifth layer 58 are layers made of an adhesive compound. The adhesive compound is not limited. As the adhesive compound, an acrylic adhesive compound, an epoxy adhesive compound, and a urethane adhesive compound or the like are exemplified.

The second layer 52 and the fourth layer 56 are resin layers. The second layer 52 and the fourth layer 56 are unfoamed resin films.

The third layer 54 is a fiber layer. Preferably, the fiber layer is a nonwoven fabric or Japanese paper.

Figure 13:
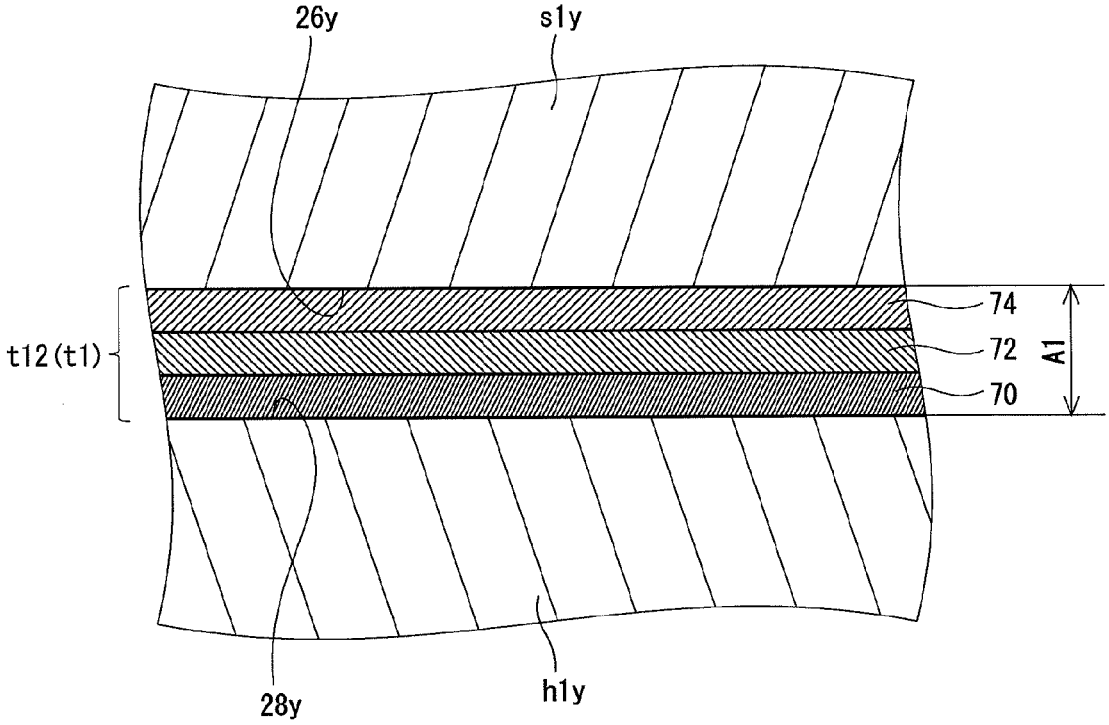
FIG. 13 is an expanded cross sectional view of a double-stick tape of another modification.

FIG. 13 is an expanded cross sectional view showing the type of usage of a double-stick tape t1 in another modification. Although not shown in the drawings, a head body h1*y* and an adherend s1*y* are the same as those of the head 2*y*. In the modification, the double-stick tape t1 is a double-stick tape t12 having a three-layered structure.

The three layers are a first layer 70, a second layer 72 and a third layer 74 in order from the side of the head body h1*y*. The first layer 70 is an innermost layer of the double-stick tape t12. The first layer 70 is an adhesive layer. The first layer 70 is a first adhesive layer. The second layer 72 is an intermediate layer. The third layer 74 is an adhesive layer. The third layer 74 is an outermost layer of the double-stick tape t12. The third layer 74 is a second adhesive layer.

The first adhesive layer 70 is bonded to the head body h1*y*. The second adhesive layer 74 is bonded to the adherend s1*y*. The adherend s1*y* is bonded to the head body h1*y* by the double-stick tape t12.

The second layer 72 is a resin layer. The second layer 72 is an unfoamed resin film.

In the aspect, the double-stick tape t1 which is free of the fiber layer can be also used. However, as described above, the double-stick tape t1 having the fiber layer is preferable.

Figure 14:
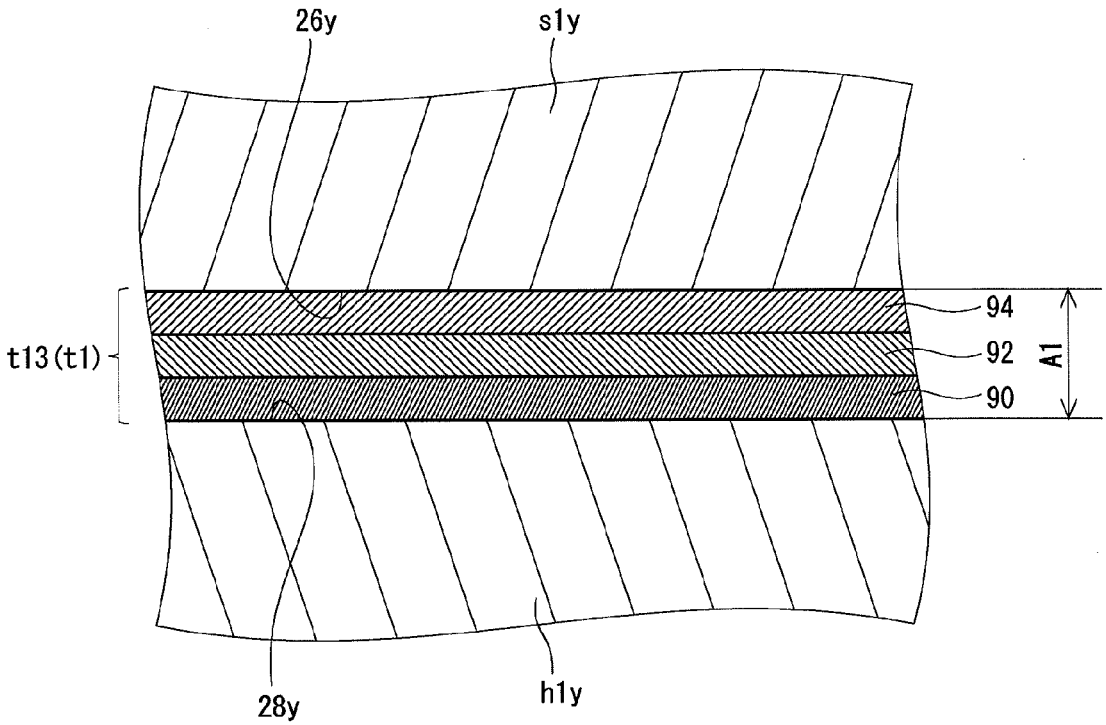
FIG. 14 is an expanded cross sectional view of a double-stick tape of another modification.

FIG. 14 is an expanded cross sectional view showing the type of usage of a double-stick tape t1 in another modification. Although not shown in the drawings, a head body h1*y* and an adherend s1*y* are the same as those of the head 2*y*. In the modification, the double-stick tape t1 is a double-stick tape t13 having a three-layered structure.

The three layers are a first layer 90, a second layer 92 and a third layer 94 in order from the side of the head body h1*y*. The first layer 90 is an innermost layer of the double-stick tape t13. The first layer 90 is an adhesive layer. The first layer 90 is a first adhesive layer. The second layer 92 is an intermediate layer. The third layer 94 is an adhesive layer.

The first adhesive layer 90 is bonded to the head body h1*y*. The second adhesive layer 94 is bonded to the adherend s1*y*. The adherend s1*y* is bonded to the head body h1*y* by the double-stick tape t11.

The first layer 90 and the third layer 94 are layers made of an adhesive compound. The second layer 92 is a fiber layer. In the aspect, the double-stick tape t1 having the three-layered structure can be also suitably used.

A thickness of the double-stick tape t1 is shown by a double-pointed arrow A1 in FIG. 11 or the like. When the double-stick tape t1 is too thin, the rigidity of the double-stick tape t1 is insufficient, and wrinkles and bubbles are apt to be generated. In light of suppressing the generation of the wrinkles and bubbles, the thickness A1 is preferably equal to or greater than 0.1 mm, and more preferably equal to or greater than 0.2 mm. In light of the ease of the movement of the bubbles to the recessed part 27*y*, the thickness A1 is preferably equal to or less than 0.4 mm, and more preferably equal to or less than 0.3 mm.

The adherend s1*y* is preferably disposed on the back surface of the face surface 4*y*. The double-stick tape t1 is preferably disposed between the back surface of the face surface 4*y* and the adherend s1*y*. A ball impacts the face surface 4*y* directly. When the face surface 4*y* hits the ball, a great impact force acts on the face surface 4*y*. Therefore, when the double-stick tape t1 is disposed on the back surface (reverse side) of the face surface 4*y*, the vibration absorbing effect is significantly exhibited.

In the embodiment of FIG. 8, the head body h1*y* between the face surface 4*y* and the double-stick tape t1 is solid. When the head body h1*y* is solid, the impact shock on the face surface 4*y* is likely to be transmitted to the double-stick tape t1. Therefore, in this case, the vibration absorbing effect is significantly exhibited. From this viewpoint, the head body h1*y* between the face surface 4*y* and the double-stick tape t1 is preferably solid.

The material of the adhesive layer is not limited. When the adherend s1*y* is attached to the outer surface of the head, the double-stick tape t1 may be protruded from the outer edge of the adherend s1*y*. The protruded double-stick tape t1 is exposed to the outside. The protruded double-stick tape t1 may be visually recognized. The protruded double-stick tape t1 is preferably inconspicuous. Considering the case where double-stick tape t1 is exposed to the outside, it is preferable that the adhesive layer has transparency and weatherability. From this viewpoint, the material of the adhesive layer is preferably the acrylic adhesive compound.

The material of the resin layer which is free of bubbles is not limited. As described above, the double-stick tape t1 may be exposed to the outside. Considering the case where double-stick tape t1 is exposed to the outside, it is preferable that the resin layer which is free of bubbles has transparency and weatherability. From this viewpoint, the base material resin of the resin layer which is free of bubbles is preferably the acrylic resin.

When the fiber layer is the nonwoven fabric layer, the material of a nonwoven fabric which constitutes the nonwoven fabric layer is not limited. As the material of the nonwoven fabric, a natural fiber, a synthetic fiber and a regenerated fiber are exemplified. As the synthetic fiber, vinylon, polyester, polypropylene, polyethylene and nylon are exemplified. As the natural fiber, pulp and hemp are exemplified. As the regenerated fiber, rayon is exemplified. In light of the weatherability and the strength, the synthetic fiber is preferable, and polyester and nylon are more preferable.

The specific examples of the double-stick tapes which may be used for the aspect include "Y-4625" (trade name), "VHX-802" (trade name), "Y-9448HK" (trade name), "4393" (trade name), "Y-9448HK" (trade name), "Y-9448HKB" (trade name) and "Y-9448SK" (trade name). All of them are produced by the Sumitomo 3M Limited.

The material of the adherend s1*y* is not limited. Examples of the materials of the adherend s1*y* include a metal, a resin and a viscoelastic material. The plurality of materials may be combined.

The material of the head body h1*y* is not limited. As the material of the head body h1*y*, soft iron (low carbon steel having a carbon content of less than 0.3 wt %), CFRP (carbon fiber reinforced plastic), maraging steel, stainless steel, a titanium alloy, an aluminium alloy and a magnesium alloy are exemplified. The whole of the head body h1*y* may be integrally formed, or may be produced by joining a plurality of members. For example, the head body may be produced by combining a flat plate-shaped face member with a face opening member. In this case, as the face member, a titanium alloy is suitable. As the face opening member, stainless steel is suitable. Forging and casting are exemplified as a method for forming the head body or a component thereof.

The material of the face part is not limited. As the material of the face part, soft iron (low carbon steel having a carbon content of less than 0.3 wt %), stainless steel, a titanium alloy, CFRP (carbon fiber reinforced plastic), maraging steel, an aluminium alloy and a magnesium alloy are exemplified.

The embodiment is an example in which the recessed part is formed on the adherend s1*y*. The recessed part may be formed on the head body h1*y*. The bubbles can move into the recessed part formed on the head body h1*y*. The bubbles can move into a space formed by the recessed part formed on the head body h1*y*. In this case, the whole of the adherend s1*y* may have a flat plate shape.

Figure 25:
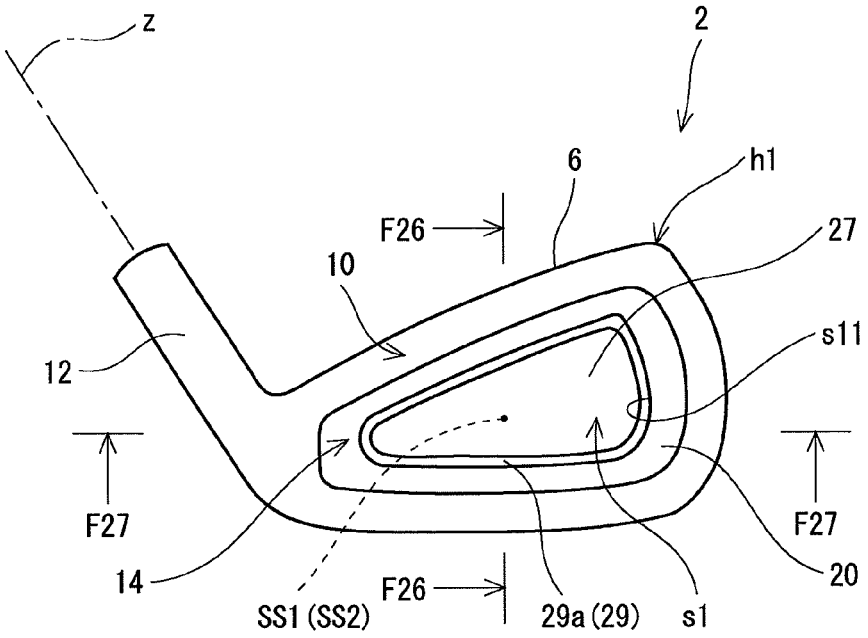
FIG. 25 is a view of a golf club head of a sixth embodiment as seen from a back surface side.
Figure 26:
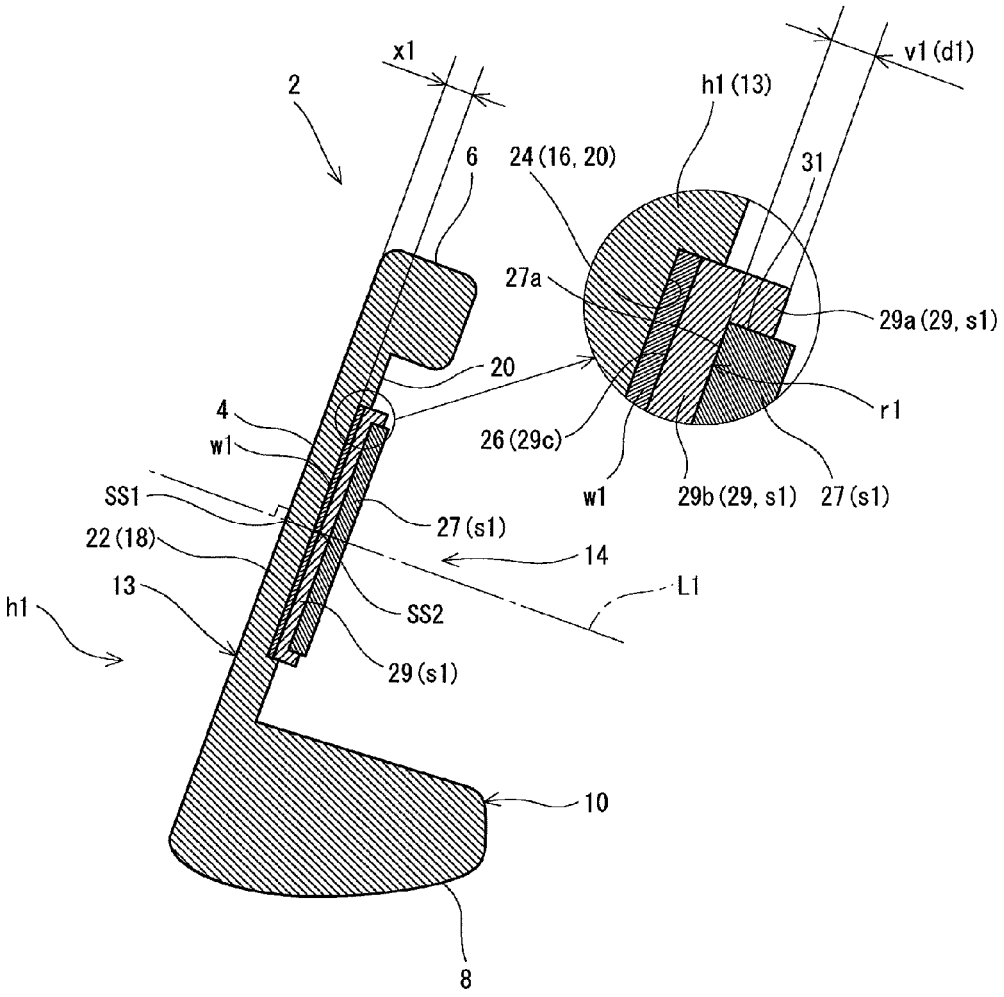
FIG. 26 is a cross sectional view taken along a line F26-F26 in FIG. 25.
Figure 27:
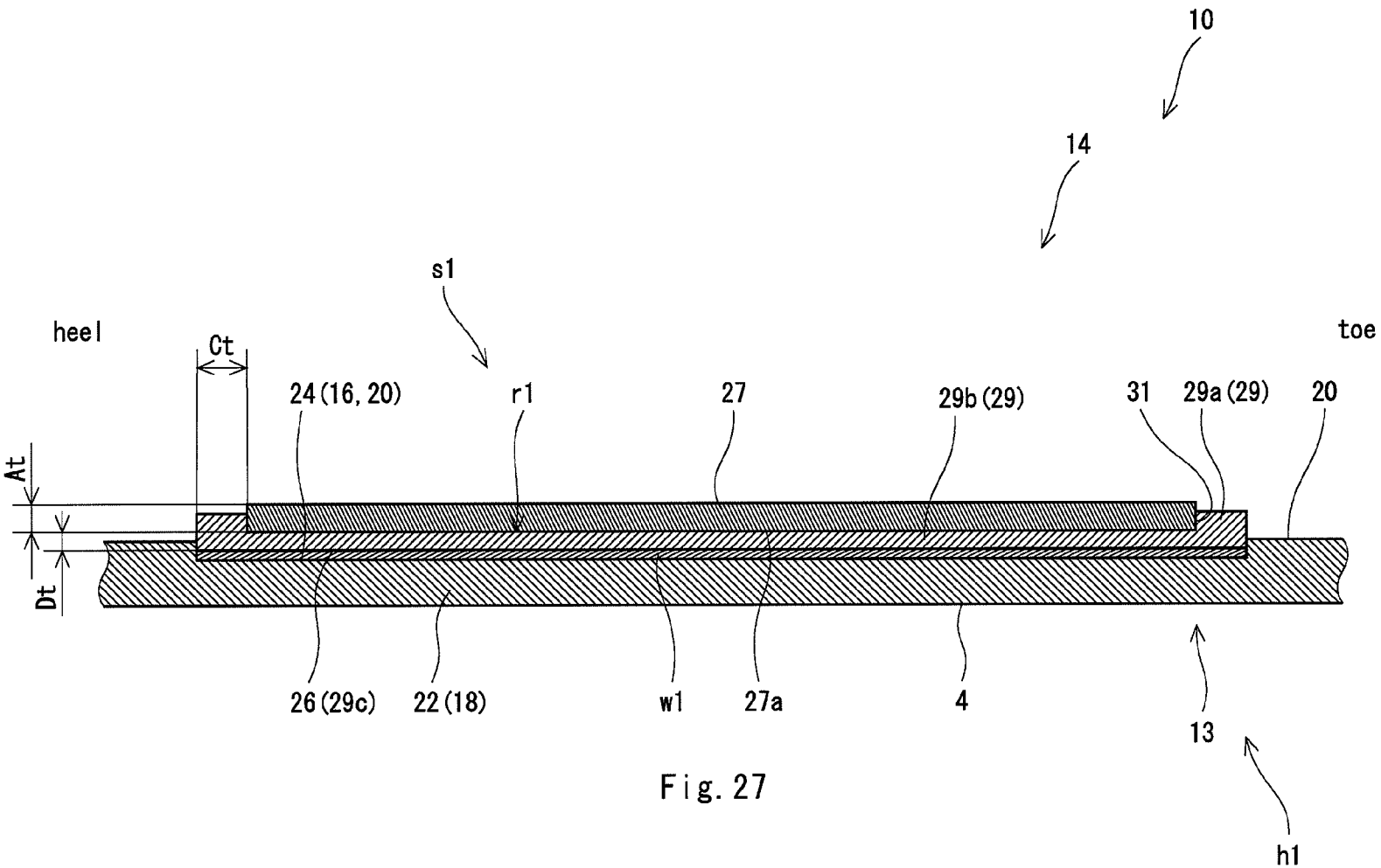
FIG. 27 is a cross sectional view taken along a line F27-F27 in FIG. 25.

FIG. 25 is a view of a golf club head 2 of a sixth embodiment as seen from a back surface side. FIG. 26 is a cross sectional view taken along a line F26-F26 in FIG. 25. FIG. 27 is a cross sectional view taken along a line F27-F27 in FIG. 25. The head 2 is an iron type golf club head. The head 2 has a head body h1, an adherend s1 and a double-stick tape w1. The adherend s1 has an approximately flat plate shape as a whole. The adherend s1 is typically a badge. Logos and characters which represent product names or the like may be indicated on the adherend s1. A profile line s11 of the adherend s1 is shown in FIG. 25.

In FIG. 27, the back (back side) of the head 2 is located on the upper side in the drawing, and the front (face side) of the head 2 is located on the lower side in the drawing.

The double-stick tape w1 is interposed between the adherend s1 and the head body h1. The adherend s1 is bonded to the head body h1 by the double-stick tape w1. The profile shape of the double-stick tape w1 and the profile shape s11 of the adherend s1 are substantially equal.

The shape of the double-stick tape w1 is not limited. The width and length of the double-stick tape w1 are not limited. The double-stick tape w1 is a sheet having both surfaces having adhesiveness.

The double-stick tape w1 is shown as a single layer in FIGS. 26 and 27. However, in fact, the double-stick tape w1 is formed of a plurality of layers as described later.

A method for fixing the adherend s1 to the head body h1 is not limited. The double-stick tape w1 may not be used. An adhesive may be used instead of the double-stick tape w1.

The head body h1 has a face part 13 provided with a face surface 4, a top surface 6, a sole surface 8, a back surface 10 and a hosel part 12. The face part 13 has the face surface 4 as an outer surface. The face part 13 is solid. A main recessed part 14 is formed on the back surface 10. The main recessed part 14 is formed on the reverse side of the face surface 4. The head 2 having the main recessed part 14 is generally referred to as a cavity back iron. The main recessed part 14 forms a so-called cavity back. The face part is thinned by the main recessed part 14. A thin wall part (a first thin wall part) 18 is formed by the main recessed part 14. The thin wall part 18 is a part of the face part 13. The thin wall part 18 is solid. The adherend s1 is stuck on the back surface 10 of the head 2. The adherend s1 is stuck on the back surface of the thin wall part 18. That is, the adherend s1 is stuck on a bottom surface 20 of the main recessed part 14. The front surface of the thin wall part 18 is the face surface 4. The back surface of the thin wall part 18 is the bottom surface 20 of the main recessed part 14.

As shown in FIGS. 25 and 26, a sweet spot SS1 of the head 2 is located in the thin wall part 18. The sweet spot SS1 is a point of intersection between a line L1 (see FIG. 26) passing through the center of gravity (not shown) of the head 2 and being perpendicular to the face surface 4 and the face surface 4.

In light of the durability, a thickness x1 (see FIG. 26) of the head body h1 on the front side of the adherend s1 is preferably equal to or greater than 1.5 mm, more preferably equal to or greater than 1.8 mm, and still more preferably equal to or greater than 2.0 mm. When the thickness x1 is small, the vibration of the face part at the time of hitting a ball is great. When the thickness x1 is small, a great impact force acts on the adherend s1. Therefore, in this case, the effect of the aspect may be actualized. From this viewpoint, the thickness x1 is preferably equal to or less than 3.0 mm, more preferably equal to or less than 2.7 mm, and still more preferably equal to or less than 2.4 mm.

Although illustration is omitted, an impact area marking is formed on the face surface 4. The impact area marking is typically a face line (face groove).

A recessed part 16 is further formed in the main recessed part 14. The recessed part (a second recessed part) 16 is formed on the bottom surface 20 of the main recessed part (a first recessed part) 14. The second recessed part 16 is shallower than the main recessed part 14. The depth of the second recessed part 16 is greater than the thickness of the double-stick tape w1. The second recessed part 16 accommodates the whole of the double-stick tape w1. The profile shape of the second recessed part 16 and the profile shape s11 of the adherend s1 are substantially equal.

The face part 13 is further thinned by the second recessed part 16. A second thin wall part 22 is formed by the second recessed part 16. The second thin wall part 22 is a part of the first thin wall part 18. The second thin wall part 22 is solid. The adherend s1 is stuck on the back surface of the second thin wall part 22. The sweet spot SS1 of the head 2 is located in the second thin wall part 22. The front surface of the second thin wall part 22 is the face surface 4. The back surface of the second thin wall part 22 is a bottom surface 24 of the second recessed part 16. The bottom surface 24 is a part of the bottom surface 20.

The second recessed part 16 may not be provided. For example, the whole of the bottom surface 20 of the main recessed part 14 may be a plane. In the aspect, the shape of the bonded surface of the head body h1 is not limited.

The adherend s1 has a bonded surface 26, a metal member 27 and an elastic member 29. The bonded surface 26 is the front surface of the elastic member 29. The bonded surface 26 is a plane.

The metal member 27 is joined to the elastic member 29. The joining method is not limited. The joining is attained by, for example, an adhesive, fitting and a double-stick tape or the like. As the fitting, fitting using the plastic deformation of the elastic member 29 is exemplified. In light of the vibration absorbing effect, the joining using the adhesive is preferable.

The metal member 27 is set to a mold, the elastic member 29 may be formed by the mold, and meanwhile, the elastic member 29 and the metal member 27 may be joined. In this case, a method for forming the elastic member 29 is not limited, and injection forming, cast forming and vulcanization forming are exemplified. In this case, the needs for the adhesive and the double-stick tape can be eliminated.

The same double-stick tape as the double-stick tape w1 may be used for adhesion between the metal member 27 and the elastic member 29. The detail of the double-stick tape will be described later.

The material of the metal member 27 is a metal. The metal is not limited. As the metal, an aluminium alloy, a stainless alloy, a nickel alloy, a titanium alloy and a magnesium alloy are exemplified. In light of the vibration absorbing effect and the ease of processing, the aluminium alloy and the stainless alloy are preferable.

The elastic member 29 is a nonmetal. As the material of the elastic member 29, a polymer containing a resin or a vulcanization rubber as main material is exemplified. As the resin, a polyurethane resin, an epoxy resin, a polypropylene resin, a phenol resin and a silicone resin are exemplified. In light of the vibrational absorbability and the strength, the polyurethane resin or the epoxy resin is preferable. The resin may be a thermoplastic resin and may be a thermosetting resin. The thermoplastic resin contains a thermoplastic elastomer having a hard segment and a soft segment. The thermosetting resin contains a thermosetting elastomer having a hard segment and a soft segment. The vulcanization rubber is a rubber obtained by crosslinking a base material rubber using a crosslinking agent. The base material rubber, which is not limited, is preferably at least one selected from the group consisting of SBR (a styrene-butadiene rubber), BR (a butadiene rubber), NR (a natural rubber) and a silicone rubber. The "main material" means that the content thereof to a base material polymer is equal to or greater than 50% by mass. The content is preferably equal to or greater than 70% by mass, and more preferably equal to or greater than 80% by mass, and particularly preferably equal to or greater than 100% by mass. The elastic member 29 may contain a metal powder.

The hardness of the elastic member 29 is not limited. In light of the strength, the Shore D hardness H1 of the elastic member 29 is preferably equal to or greater than 40, more preferably equal to or greater than 45, and still more preferably equal to or greater than 50. In light of the vibration absorbing effect, the hardness H1 is preferably equal to or less than 80, more preferably equal to or greater than 75, and still more preferably equal to or greater than 70.

The hardness H1 is measured in accordance with a standard of "ASTM-D 2240-68" by using a Shore D spring type hardness scale attached to an automated rubber hardness measuring device (trade name "P1", available from Koubunshi Keiki Co., Ltd.). For the measurement, a slab formed by hot pressing to have a thickness of about 2 mm is used. For the measurement, a slab stored at a temperature of 23° C. for two weeks is used. When the measurement is carried out, three pieces of the slab are overlaid. A slab having the same composition as that of the elastic member 29 is used for the measurement.

In the head 2 of the sixth embodiment, the elastic member 29 has a recessed part r1. The recessed part r1 is formed on the reverse surface of the elastic member 29. In light of clearly discriminating the recessed part r1 from the other recessed part, in the present application, the recessed part r1 is also referred to as a recessed part (E). The recessed part (E) r1 is opened to the back of the head 2.

As shown in FIGS. 26 and 27, the metal member 27 is disposed in the recessed part (E) r1. The metal member 27 is fitted into the recessed part (E) r1.

The elastic member 29 has a peripheral part 29*a* and an interposition part 29*b*. The peripheral part 29*a* abuts on a side surface 31 of the metal member 27. The abutment may be direct or indirect. The indirect abutment means that the other member (adhesive or the like) is interposed between the side surface 31 and the peripheral part 29*a*.

As shown in FIG. 25, the peripheral part 29*a* is located around the metal member 27. The peripheral part 29*a* is formed over all the periphery of the metal member 27. Since the peripheral part 29*a* is formed over all the periphery of the metal member 27, the vibration absorbing effect due to the elastic member 29 is high.

The peripheral part 29*a* and the interposition part 29*b* may be separately formed respectively. In this case, the peripheral part 29*a* and the interposition part 29*b* are preferably bonded by an adhesive or the like. In light of the strength and productivity of the adherend s1, it is preferable that the elastic member 29 including the peripheral part 29*a* and the interposition part 29*b* is integrally formed.

The depth d1 (see FIG. 26) of the recessed part (E) r1 is smaller than the thickness of the metal member 27. The thickness v1 (see FIG. 26) of the peripheral part 29*a* is smaller than the thickness of the metal member 27.

The interposition part 29*b* is located between the head body h1 and the metal member 27. The interposition part 29*b* is located between the back surface 10 of the head body h1 and the metal member 27. The interposition part 29*b* is located between the bottom surface 20 of the main recessed part 14 and the metal member 27. The interposition part 29*b* is located between the bottom surface 24 of the second recessed part 16 and the metal member 27.

The double-stick tape w1 is disposed between the back surface 10 of the head body h1 and the interposition part 29*b*. The front surface of the interposition part 29*b* and the back surface 10 are bonded by the double-stick tape w1.

The interposition part 29*b* has a flat plate shape. The profile shape of the interposition part 29*b* is equal to the profile line s11 of the adherend s1. The interposition part 29*b* covers the whole of the front surface 27*a* of the metal member 27. The interposition part 29*b* abuts on the whole of the front surface 27*a* directly or indirectly. In the constitution, the vibration absorbing effect due to the elastic member 29 is high.

In the embodiment, the bottom part of the recessed part (E) r1 is the interposition part 29*b*. In the embodiment, a peripheral wall of the recessed part (E) r1 is the peripheral part 29*a*.

The elastic member 29 is constituted by only the peripheral part 29*a* and the interposition part 29*b*. The whole of the elastic member 29 is integrally formed. The peripheral part 29*a* and the interposition part 29*b* are integrally formed.

The profile shape of the double-stick tape w1 and the profile shape of a front surface 29*c* of the elastic member 29 are substantially equal. The double-stick tape w1 directly abuts on the whole of the front surface 29*c*. The front surface 29*c* of the elastic member 29 is the bonded surface 26.

As shown in FIGS. 25 and 26, in the embodiment, the existence region of the adherend s1 includes a back surface point SS2 of a sweet spot SS1. That is, a straight line L1 passing through the center of gravity of the head 2 and the sweet spot SS1 intersects with the adherend s1. The sweet spot SS1 is a point of intersection of a perpendicular line led to a face surface 4 from the center of gravity of the head 2 and the face surface 4. The back surface point SS2 is a point of intersection of the straight line L1 and the back surface 10 of the head body h1. In FIG. 26, the straight line L1 is shown by a one-dotted chain line. The point of intersection of the straight line L1 and the adherend s1 may exist on the bonded surface 26. The straight line L1 passes through the elastic member 29. The straight line L1 passes through the interposition part 29*b*. The straight line L1 passes through the metal member 27. The vibration at the time of hitting the ball at the sweet spot SS1 or near sweet spot SS1 can be effectively absorbed by the constitution.

A golf player tends to try to hit the ball to the sweet spot SS1. A probability that a hitting point (a position where the ball is hit) is the sweet spot SS1 or near the sweet spot SS1 is high. In the embodiment, the vibration absorbing effect when the hitting point is the sweet spot SS1 or near the sweet spot SS1 is high.

Figure 28:
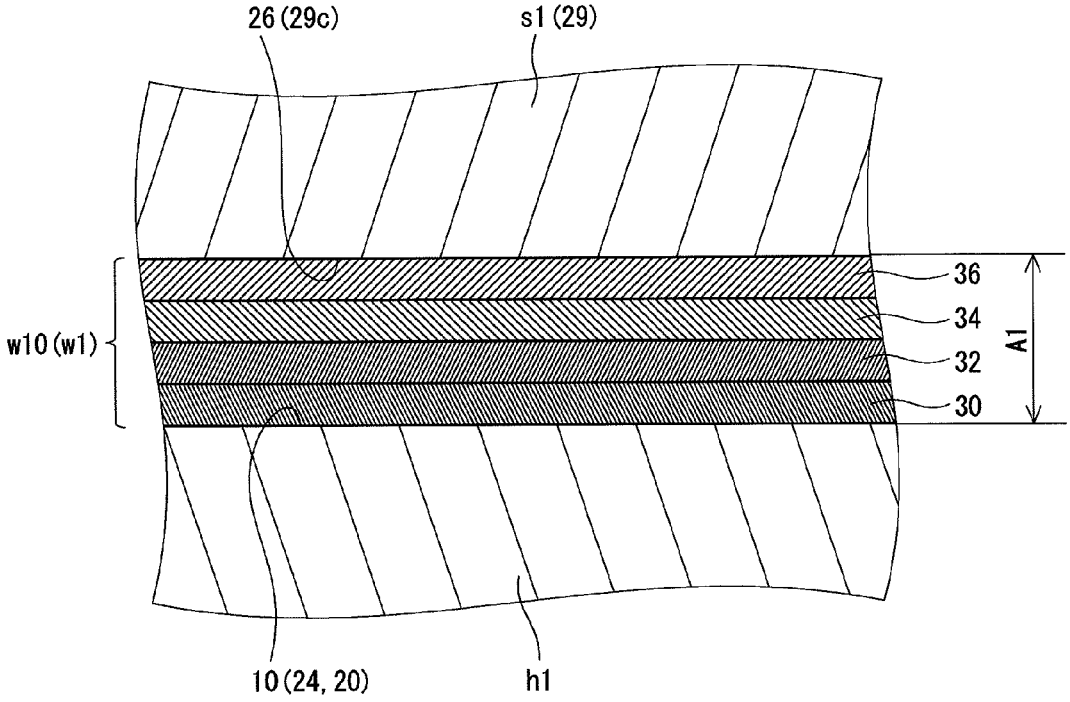
FIG. 28 is an expanded cross sectional view of the vicinity of a double-stick tape.

FIG. 28 is an expanded cross sectional view of the vicinity of the double-stick tape w1. The double-stick tape w1 is a double-stick tape w10 having a four-layered structure. The four layers are a first layer 30, a second layer 32, a third layer 34 and a fourth layer 36 in order from the side of the head body h1. The first layer 30 is an innermost layer of the double-stick tape w10. The first layer 30 is an adhesive layer. The first layer 30 is a first adhesive layer. The second layer 32 and the third layer 34 are intermediate layers. The fourth layer 36 is an adhesive layer. The fourth layer 36 is an outermost layer of the double-stick tape w10. The fourth layer 36 is a second adhesive layer. Although boundaries between the layers are flatly shown in FIG. 28, unevennesses may exist in the boundaries. Particularly, a boundary between a nonwoven fabric layer to be described later and the other layer is usually uneven. The boundaries between the layers may be curved surfaces.

The first adhesive layer 30 is brought into contact with the back surface 10 of the head body h1. The second adhesive layer 36 is brought into contact with the bonded surface 26 of the adherend s1. That is, the second adhesive layer 36 is brought into contact with the front surface 29*c* of the elastic member 29.

The first layer 30 and the fourth layer 36 are layers made of an adhesive compound. The adhesive compound is not limited. As the adhesive compound, an acrylic adhesive compound, an epoxy adhesive compound, and a urethane adhesive compound or the like are exemplified.

The second layer 32 is a resin layer. The second layer 32 is a resin layer which is free of bubbles. The second layer 32 is an unfoamed resin film. The second layer 32 is not a resin form layer. The kind of a resin forming the second layer 32 is not limited. As a base material resin of the resin layer, an acrylic resin and a polyester resin are exemplified. The acrylic resin is preferable.

The resin layer is apt to be deformed by the existence of bubbles. In light of the durability and the bonding strength, the resin layer which is free of bubbles is preferable.

The third layer 34 is a fiber layer. The third layer 34 is a nonwoven fabric layer. Although not shown in the drawing, a empty space exists in the nonwoven fabric. A part of the adhesive layer 36 adjacent to the third layer enters the empty space. The empty space exists in the nonwoven fabric layer 34. Although not shown in the drawing, a part of the resin layer 32 adjacent to the third layer 34 enters the empty space. Although not shown in the drawing, a part of the adhesive layer 36 adjacent to the third layer 34 enters the empty space.

Unlike the embodiment, the second layer 32 may be the fiber layer, and the third layer 34 may be the resin layer.

The nonwoven fabric layer 34 functions as a support of the double-stick tape w10. When the double-stick tape w10 is stuck, wrinkles are less likely to be generated due to the nonwoven fabric layer 34. The nonwoven fabric layer 34 can suppress bubbles between the bonded surface 26 and a tape w1.

As described above, one example of the fiber layer is the nonwoven fabric layer. However, the fiber layer is not limited to the nonwoven fabric layer. The fiber layer is a layer containing a fiber. In the fiber layer, the fiber contributes to the enhancement of tensile strength. The fiber layer can suppress the generation of wrinkles. The fiber layer can suppress the generation of bubbles. Even when the thickness A1 is small, the fiber layer suppresses wrinkles and bubbles at the time of sticking the tape. Therefore, the adherend s1 is less likely to be separated due to the fiber layer.

A step of sticking the adherend s1 on the head body h1 includes, for example, a first step of sticking the double-stick tape w1 on the adherend s1, and a second step of sticking the adherend s1 on which the double-stick tape w1 is stuck, on the head body h1. In the first step or the second step, wrinkles are sometimes generated on the tape w1. The wrinkles reduce the bonding strength. The double-stick tape w1 having the fiber layer suppresses the generation of the wrinkles.

As preferable fiber layers, for example, the following items (a), (b), (c) and (d) are exemplified.

(a) A layer containing woven fibers;

(b) A layer in which fibers are not woven but entangled with each other;

(c) A layer in which fibers are not woven but fused to each other; and (d) A layer in which fibers are not woven but bonded to each other by an adhesive.

The fiber contained in the fiber layer is not limited. As the fiber, a synthetic fiber, a natural fiber and regenerated fiber are exemplified. As the synthetic fiber, a vinylon fiber, a polyester fiber, a polypropylene fiber, a polyethylene fiber and a nylon fiber are exemplified. As the natural fiber, a pulp fiber and a hemp fiber are exemplified. As the regenerated fiber, rayon is exemplified. In light of the suppression of bubbles, the synthetic fiber is preferable.

As the fiber layer, a woven fabric, a nonwoven fabric and paper are exemplified. In the present application, "paper" means Japanese paper or foreign paper. In the present application, the "nonwoven fabric" is defined as the concept which does not contain the paper.

As the materials of the Japanese paper, *Broussonetica kazinoki, Diplomorpha sikokiana* and *Edgeworthia papyrifera* are exemplified. In light of the strength, the fiber length of the Japanese paper is preferably equal to or greater than 3 mm, more preferably equal to or greater than 5 mm, still more preferably equal to or greater than 10 mm, and particularly preferably equal to or greater than 15 mm. The fiber length of Japanese paper is usually equal to or less than 25 mm. The Japanese paper may be produced by hand-making or machine-making.

The material of the foreign paper is a broadleaf tree or a needle-leaf tree. The fiber length of the foreign paper is usually 0.8 mm or greater and less than 5 mm. The foreign paper is obtained by machine-making.

As the nonwoven fabric, a wet nonwoven fabric and a dry nonwoven fabric are exemplified.

The method for producing the nonwoven fabric is not limited. As the method for producing the nonwoven fabric, a thermal bond method, a chemical bond method, a needle punch method, a spunlace method (water flow interlacing method), a stitch bond method and a steam jet method are exemplified. When a polyester fiber or a nylon fiber is used as the fiber, the nonwoven fabric produced by the thermal bond method is preferable in light of the productivity and the strength.

In light of suppressing the generation of the wrinkles or bubbles, the fiber layer is preferably a nonwoven fabric or Japanese paper. In light of the vibrational absorbability, the nonwoven fabric is more preferable.

Figure 29:
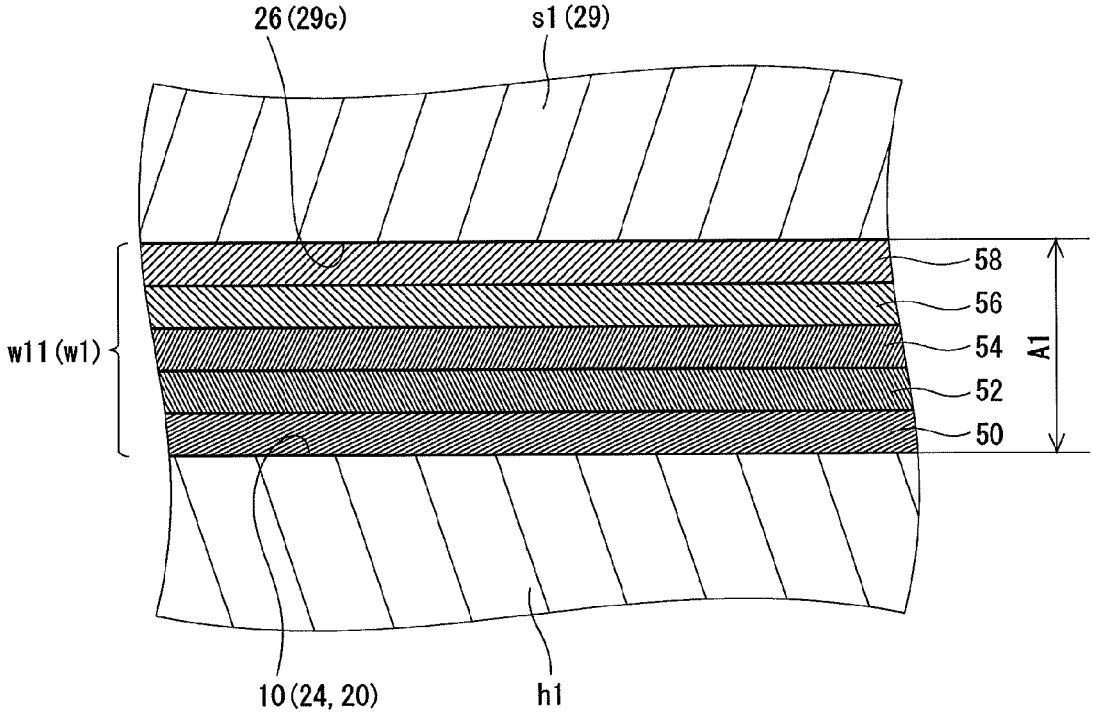
FIG. 29 is an expanded cross sectional view of a double-stick tape of a modification.

FIG. 29 is an expanded cross sectional view showing a double-stick tape w1 in a deformation. Although not shown in the drawing, a head body h1 and an adherend s1 are the same as those of the head 2. In the modification, the double-stick tape w1 is a double-stick tape w11 having a five-layered structure.

The five layers are a first layer 50, a second layer 52, a third layer 54, a fourth layer 56 and a fifth layer 58 in order from the side of the head body h1. The first layer 50 is an innermost layer of the double-stick tape w11. The first layer 50 is an adhesive layer. The first layer 50 is a first adhesive layer. The second layer 52, the third layer 54 and the fourth layer 56 are intermediate layers. The fifth layer 58 is an adhesive layer. The fifth layer 58 is an outermost layer of the double-stick tape w11. The fifth layer 58 is a second adhesive layer. Although boundaries between the layers are flatly shown in FIG. 29, unevennesses may exist in the boundaries.

The first adhesive layer 50 is bonded to the head body h1. The second adhesive layer 58 is bonded to the adherend s1. That is, the second adhesive layer 58 is brought into contact with the front surface 29*c* of the elastic member 29. The adherend s1 is bonded to the head body h1 by the double-stick tape w11.

The first layer 50 and the fifth layer 58 are layers made of an adhesive compound. The adhesive compound is not limited. As the adhesive compound, an acrylic adhesive compound, an epoxy adhesive compound, and a urethane adhesive compound or the like are exemplified.

The second layer 52 and the fourth layer 56 are resin layers. The second layer 52 and the fourth layer 56 are unfoamed resin films.

The third layer 54 is a fiber layer. Preferably, the fiber layer is a nonwoven fabric or Japanese paper.

Figure 30:
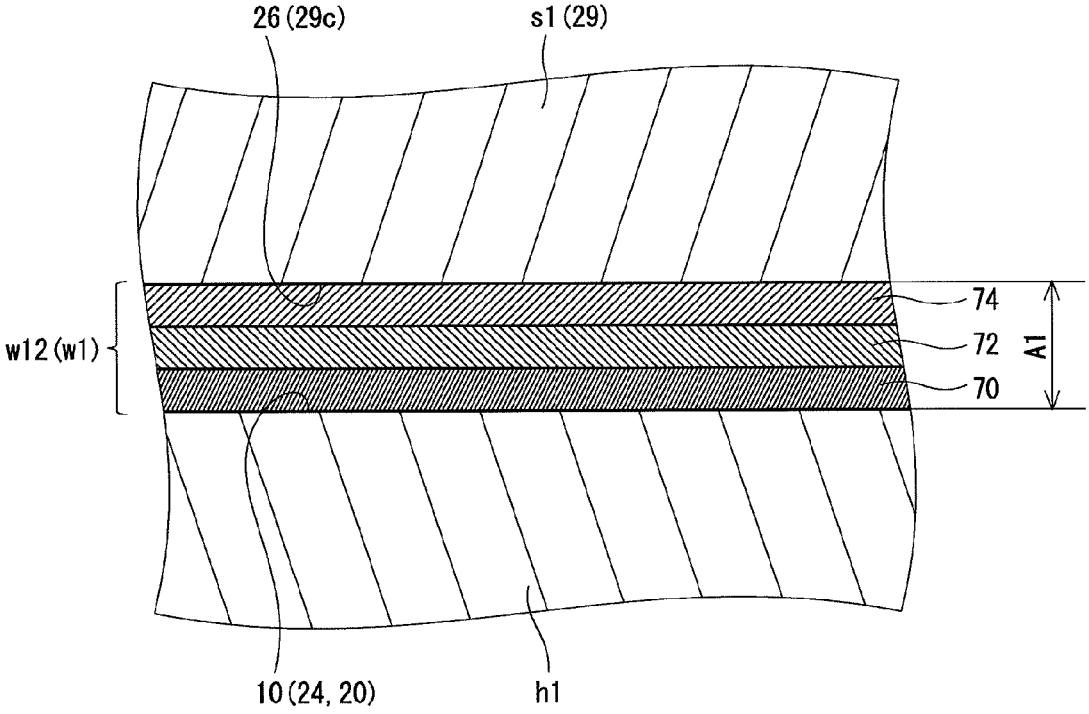
FIG. 30 is an expanded cross sectional view of a double-stick tape of another modification.

FIG. 30 is an expanded cross sectional view showing a double-stick tape w1 in another modification. Although not shown in the drawing, a head body h1 and an adherend s1 are the same as those of the head 2. In the modification, the double-stick tape w1 is a double-stick tape t12 having a three-layered structure.

The three layers are a first layer 70, a second layer 72 and a third layer 74 in order from the side of the head body h1. The first layer 70 is an innermost layer of the double-stick tape w12. The first layer 70 is an adhesive layer. The first layer 70 is a first adhesive layer. The second layer 72 is an intermediate layer. The third layer 74 is an adhesive layer. The third layer 74 is an outermost layer of the double-stick tape w12. The third layer 74 is a second adhesive layer.

The first adhesive layer 70 is bonded to the head body h1. The second adhesive layer 74 is bonded to the adherend s1. That is, the second adhesive layer 74 is brought into contact with the front surface 29*c* of the elastic member 29. The adherend s1 is bonded to the head body h1 by the double-stick tape w12.

The second layer 72 is a resin layer. The second layer 72 is an unfoamed resin film.

Thus, in the aspect, the double-stick tape w1 which does not have the fiber layer can be also used. However, as described above, the double-stick tape w1 having the fiber layer is preferable.

Figure 31:
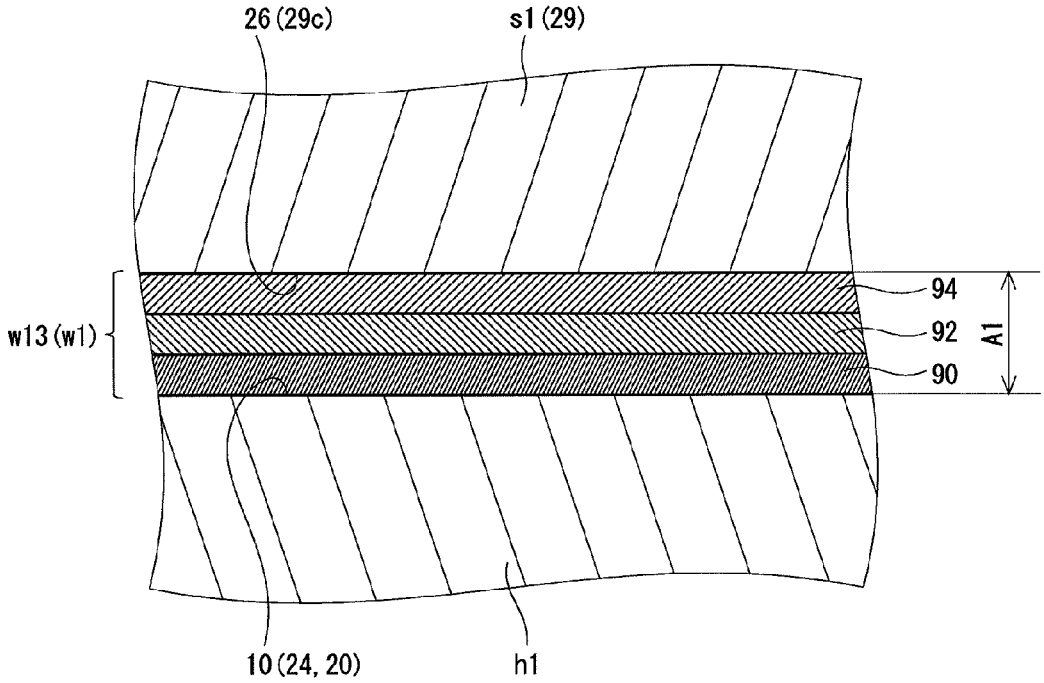
FIG. 31 is an expanded cross sectional view of a double-stick tape of another modification.

FIG. 31 is an expanded cross sectional view showing a double-stick tape w1 in another modification. Although not shown in the drawing, a head body h1 and an adherend s1 are the same as those of the head 2. In the modification, the double-stick tape w1 is a double-stick tape w13 having a three-layered structure.

The three layers are a first layer 90, a second layer 92 and a third layer 94 in order from the side of the head body h1. The first layer 90 is an innermost layer of the double-stick tape w13. The first layer 90 is an adhesive layer. The first layer 90 is a first adhesive layer. The second layer 92 is an intermediate layer. The third layer 94 is an adhesive layer.

The first adhesive layer 90 is bonded to the head body h1. The second adhesive layer 94 is bonded to the adherend s1. The adherend s1 is bonded to the head body h1 by the double-stick tape w13.

The first layer 90 and the third layer 94 are layers made of an adhesive compound. The second layer 92 is a fiber layer. The fiber layer is preferably a nonwoven fabric or Japanese paper. In the aspect, the double-stick tape w1 having the three-layered structure can be also suitably used.

A thickness of the double-stick tape w1 is shown by a double-pointed arrow A1 in FIG. 28 or the like. In the aspect, it is preferred that thickness A1 is preferably smaller than that of the conventional one. Since the vibration absorbing effect due to the elastic member is high in the aspect, the vibration absorbing effect is obtained even when the double-stick tape w1 is thin. When the thickness A1 is small, the movable amount of the adherend s1 is suppressed, and the adherend s1 is less likely to be separated. From these viewpoints, the thickness A1 is preferably equal to or less than 0.4 mm, and more preferably equal to or less than 0.3 mm. When the double-stick tape w1 is too thin, the rigidity of the double-stick tape w1 is insufficient, and wrinkles and bubbles are apt to be generated at the time of sticking the tape. In light of suppressing the generation of the wrinkles and bubbles, the thickness A1 is preferably equal to or greater than 0.1 mm, and more preferably equal to or greater than 0.2 mm.

Even when the double-stick tape w1 is thinned, the generation of the wrinkles is effectively suppressed by providing the fiber layer as the intermediate layer. The adherend s1 is less likely to be separated due to the suppressing effect.

The double-stick tape w1 can exhibit the vibration absorbing effect. The adherend s1 is disposed on the back surface 10 of the face surface 4. The double-stick tape w1 is disposed between the back surface of the face surface 4 and the adherend s1. A ball impacts the face surface 4 directly. When the ball is hit, a great impact force acts on the face surface 4. Therefore, when the double-stick tape w1 is disposed on the back surface 10 of the face surface 4, the effect of the aspect is significantly exhibited. The vibration absorbing effect due to the elastic member 29 and the vibration absorbing effect due to the double-stick tape w1 can act synergistically.

The material of the adhesive layer is not limited. When the adherend s1 is attached to the outer surface of the head, the double-stick tape w1 may be protruded from the outer edge of the adherend s1. The protruded double-stick tape w1 is exposed to the outside. The protruded double-stick tape w1 may be visually recognized. The protruded double-stick tape w1 is preferably inconspicuous. Considering the case where the double-stick tape w1 is exposed to the outside, it is preferable that the adhesive layer has transparency and weatherability. From this viewpoint, the material of the adhesive layer is preferably the acrylic adhesive compound.

The material of the resin layer which is free of bubbles is not limited. As described above, the double-stick tape w1 may be exposed to the outside. Considering the case where the double-stick tape w1 is exposed to the outside, it is preferable that the resin layer which is free of bubbles has transparency and weatherability. From this viewpoint, the base material resin of the resin layer which is free of bubbles is preferably the acrylic resin.

When the fiber layer is the nonwoven fabric layer, the material of the nonwoven fabric which constitutes the nonwoven fabric layer is not limited. As the material of the nonwoven fabric, a natural fiber, a synthetic fiber and a regenerated fiber are exemplified. As the synthetic fiber, vinylon, polyester, polypropylene, polyethylene and nylon are exemplified. As the natural fiber, hemp is exemplified. As the regenerated fiber, rayon is exemplified. In light of the weatherability and the strength, the synthetic fiber is preferable, and polyester and nylon are more preferable.

The specific examples of the double-stick tapes which may be used for the embodiment include "Y-4625" (trade name), "VHX-802" (trade name), "Y-9448HK" (trade name), "4393" (trade name), "Y-9448HK" (trade name), "Y-9448HKB" (trade name) and "Y-9448SK" (trade name). All of them are produced by the Sumitomo 3M Limited.

In the exhibition of the vibration absorbing effect, the elastic member 29 and the double-stick tape w1 can act synergistically. The vibration absorbing effect is enhanced by providing the elastic member 29 and the double-stick tape w1 between the head body h1 and the metal member 27.

In the embodiment of FIG. 26, the head body h1 between the face surface 4 and the double-stick tape w1 is solid. When the head body h1 is solid, the impact shock on the face surface 4 is likely to be transmitted to the double-stick tape w1. Therefore, in this case, the vibration absorbing effect due to the double-stick tape w1 is significantly exhibited. From this viewpoint, the head body h1 between the face surface 4 and the double-stick tape w1 is preferably solid.

In the embodiment of FIG. 26, the head body h1 between the face surface 4 and the elastic member 29 is solid. When the head body h1 is solid, the impact shock on the face surface 4 is likely to be transmitted to the elastic member 29. Therefore, in this case, the vibration absorbing effect due to the elastic member 29 and the metal member 27 is significantly exhibited. From this viewpoint, the head body h1 between the face surface 4 and the adherend s1 is preferably solid.

Figure 32:
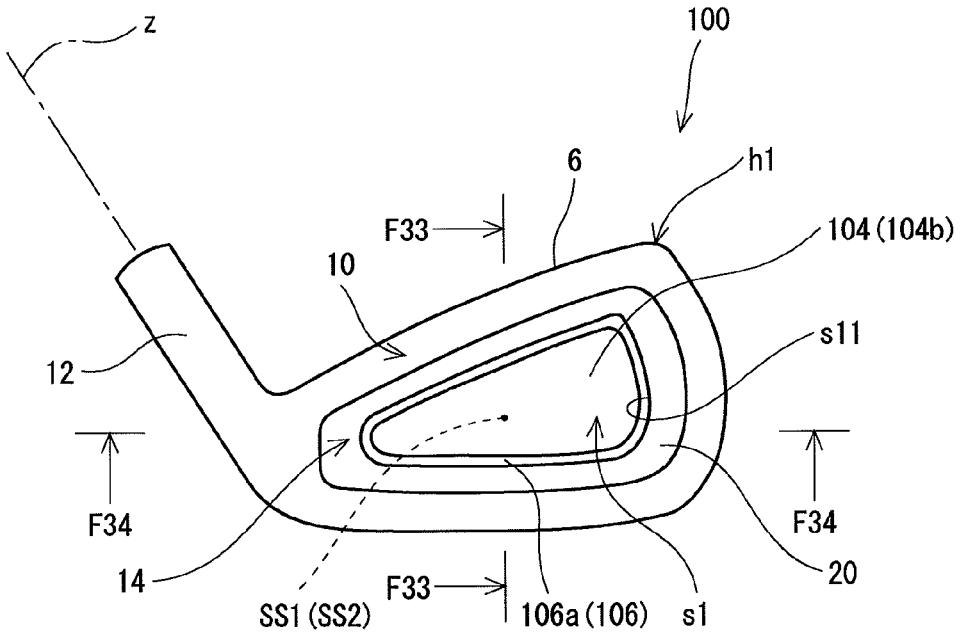
FIG. 32 is a view of a golf club head of a seventh embodiment as seen from a back surface side.
Figure 33:
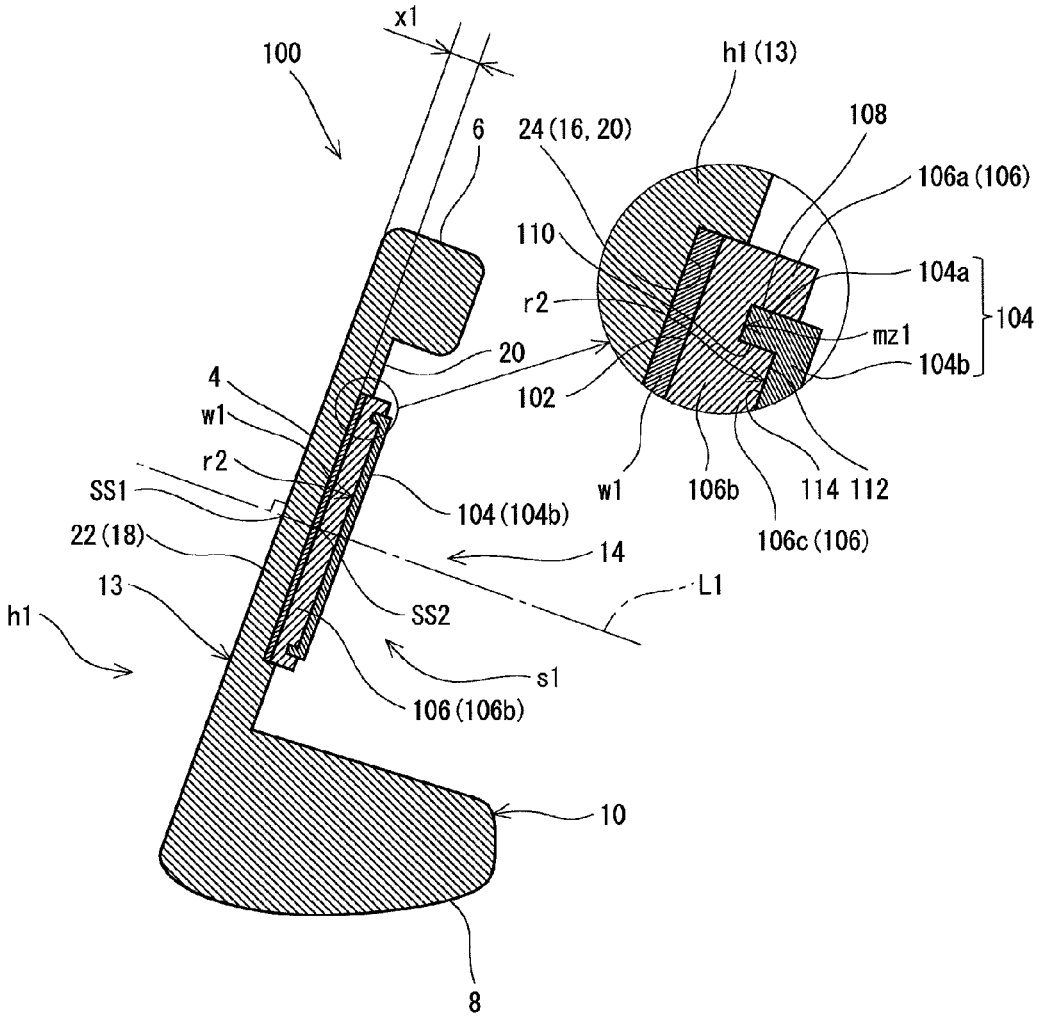
FIG. 33 is a cross sectional view taken along a line F33-F33 in FIG. 32.
Figure 34:
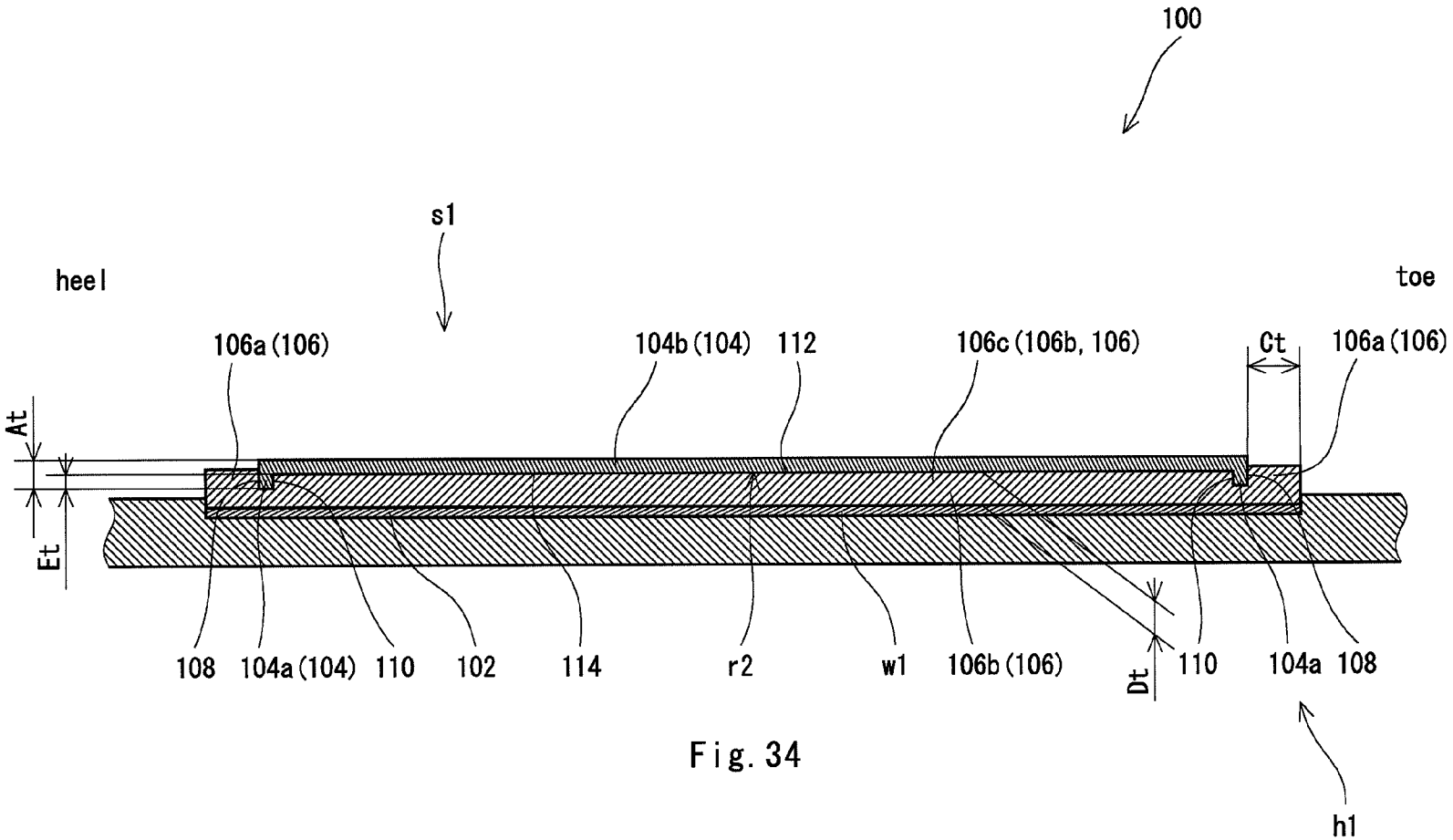
FIG. 34 is a cross sectional view taken along a line F34-F34 in FIG. 32.

FIG. 32 is a view of a golf club head 100 of a seventh embodiment as seen from a back surface side. FIG. 33 is a cross sectional view taken along a line F33-F33 in FIG. 32. FIG. 34 is a cross sectional view taken along a line F34-F34 in FIG. 32. The head 100 is an iron type golf club head. The head 100 has a head body h1, an adherend s1 and a double-stick tape w1. The adherend s1 has an approximately flat plate shape as a whole. The profile line s11 of the adherend s1 is shown in FIG. 32.

In FIG. 34, the back (back side) of the head 100 is located on the upper side in the drawing, and the front (face side) of the head 100 is located on the lower side in the drawing.

The head body h1 of the head 100 is the same as the head body h1 of the head 2. The double-stick tape w1 of the head 100 is the same as the double-stick tape w1 of the head 2. The profile line s11 of the adherend s1 in the head 100 is the same as the profile line s11 of the head 2.

The double-stick tape w1 is interposed between the adherend s1 and the head body h1. The adherend s1 is bonded to the head body h1 by the double-stick tape w1. The profile shape of the double-stick tape w1 and the profile shape s11 of the adherend s1 are substantially equal.

The adherend s1 has a bonded surface 102, a metal member 104 and an elastic member 106. The bonded surface 102 is a front surface of the elastic member 106. The bonded surface 102 is a plane.

The metal member 104 is joined to the elastic member 106. The joining method is not limited. The joining is attained by, for example, an adhesive, fitting, a double-stick tape or the like. As the fitting, fitting using the plastic deformation of the elastic member 106 is exemplified. In light of the vibration absorbing effect, the joining using the adhesive is preferable.

The metal member 104 is set to a mold, the elastic member 106 may be formed by the mold, and meanwhile, the elastic member 106 and the metal member 104 may be joined. In this case, a method for forming the elastic member 106 is not limited, and injection forming, cast forming and vulcanization forming are exemplified. In this case, the needs for the adhesive and the double-stick tape can be eliminated.

In the head 100 of the seventh embodiment, the metal member 104 has a recessed part r2. The recessed part r2 is provided on the front surface of the metal member 104. In light of clearly discriminating the recessed part r2 from the other recessed part, in the present application, the recessed part r2 is also referred to as a recessed part (M). The recessed part (M) r2 is opened to the front of the head 100.

As shown in FIGS. 33 and 34, an interposition part 106*b* of the elastic member 106 is protruded toward the back of the head 100. The interposition part 106*b* extends in the recessed part (M) r2. That is, the interposition part 106*b* has an inner side extending part 106*c* extending in the recessed part (M) r2.

The inner side extending part 106*c* may be formed separately from the other portion of the elastic member 106. In this case, the inner side extending part 106*c* is preferably bonded to the other portion of the an elastic member 106 by an adhesive or the like. In light of the productivity and strength of the adherend s1, the whole of the interposition part 106*b* including the inner side extending part 106*c* is preferably integrally formed and the whole of the elastic member 106 having the interposition part 106*b* including the inner side extending part 106*c*, and having a peripheral part 106*a* is more preferably integrally formed.

The metal member 104 has a periphery wall part 104*a* and a main part 104*b*. The periphery wall part 104*a* is circular. The main part 104*b* has a flat plate shape. The metal member 104 consists of the periphery wall part 104*a* and the main part 104*b*. The recessed part (M) r2 is formed by the main part 104*b* and the periphery wall part 104*a*. The main part 104*b* constitutes a bottom part of the recessed part (M) r2.

The elastic member 106 has the peripheral part 106*a* and the interposition part 106*b*. The peripheral part 106*a* abuts on a side surface 108 of the metal member 104. The abutment may be direct or indirect.

The thickness of the interposition part 106*b* is greater than the depth of the recessed part (M) r2. The recessed part (M) r2 is filled with the interposition part 106*b*. The interposition part 106*b* is fitted into the recessed part (M) r2.

As shown in FIG. 33, the peripheral part 106*a* is located around the metal member 104. The peripheral part 106*a* is provided over all the periphery of the metal member 104. Since the peripheral part 106*a* is formed over all the periphery of the metal member 104, the vibration absorbing effect due to the elastic member 106 is high.

The inner surface 110 of the periphery wall part 104*a* abuts on the interposition part 106*b* directly. The inner side extending part 106*c* is fitted to the recessed part (M) r2. The side surface of the inner side extending part 106*c* abuts on the inner surface 110 directly. The abutment may be direct or indirect. The whole surface of the inner surface 110 abuts on the inner side extending part 106*c*. The abutment enhances the vibration absorbing effect of the adherend s1.

The back surface 112 of the interposition part 106*b* abuts on the front surface 114 of the main part 104*b*. The whole of the front surface 114 abuts on the interposition part 106*b* directly. The abutment may be direct or indirect. The abutment enhances the vibration absorbing effect of the adherend s1.

A groove mz1 is formed in the elastic member 106 by the peripheral part 106*a* and the inner side extending part 106*c* (see an enlarged part of FIG. 33). The groove mz1 is endless. The groove mz1 is circular. The groove mz1 is disposed inside of the profile line s11 approximately along the profile line s11 of the adherend s1. The periphery wall part 104*a* is disposed in the groove mz1. The periphery wall part 104*a* is fitted into the groove mz1. The periphery wall part 104*a* is pinched by the elastic member 106. The constitution enhances the vibration absorbing effect of the adherend s1.

Figure 35:
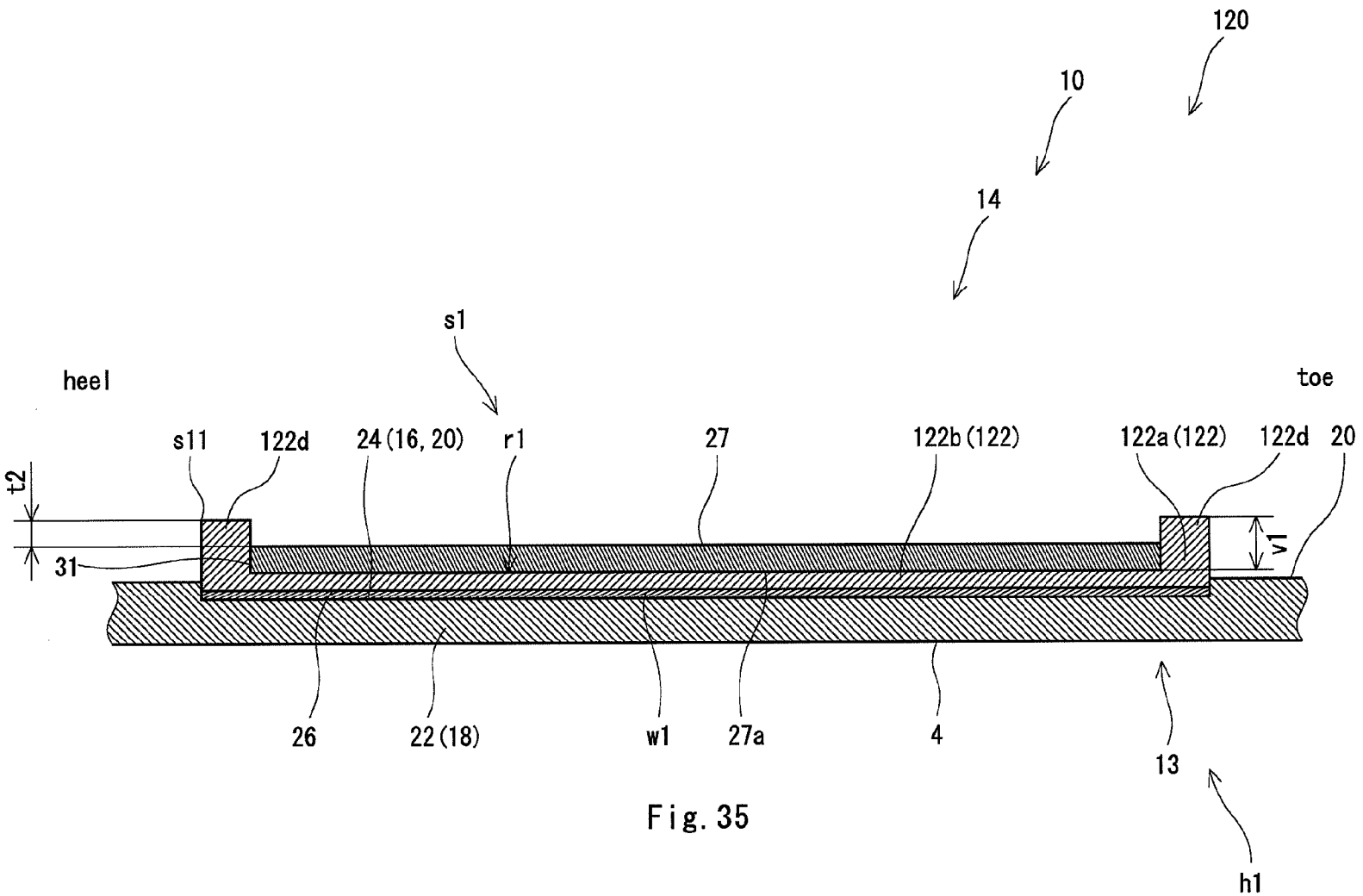
FIG. 35 is a cross sectional view of a golf club head of an eighth embodiment, the position of the cross sectional line of the cross sectional view being the same as that of FIG. 27 in the sixth embodiment.

FIG. 35 is a cross sectional view of a golf club head 120 according to an eighth embodiment. The cross sectional position of the cross sectional view is the same as that of FIG. 27 in the sixth embodiment. The head 120 is an iron type golf club head. The head 120 has a head body h1, an adherend s1 and a double-stick tape w1. The adherend s1 has an approximately flat plate shape as a whole.

In FIG. 35, the back (back side) of the head 120 is located on the upper side in the drawing, and the front (face side) of the head 120 is located on the lower side in the drawing.

The head body h1 of the head 120 is the same as the head body h1 of the head 2. The double-stick tape w1 of the head 120 is the same as the double-stick tape w1 of the head 2. The profile line s11 of the adherend s1 in the head 120 is the same as the profile line s11 of the head 2.

The double-stick tape w1 is interposed between the adherend s1 and the head body h1. The adherend s1 is bonded to the head body h1 by the double-stick tape w1. The profile shape of the double-stick tape w1 and the profile shape s11 of the adherend s1 are substantially equal.

The adherend s1 has a metal member 27 and an elastic member 122.

The metal member 27 of the head 120 is the same as the metal member 27 of the head 2. Except for the elastic member 122, the head 120 is the same as the head 2.

The elastic member 122 of the head 120 is different from the elastic member 29 of the head 2. The difference is only the thickness v1 of the peripheral part. That is, the thickness v1 of a peripheral part 122*a* in the elastic member 122 is greater than the thickness v1 of the peripheral part 29*a* in the head 2. An interposition part 122*b* of the elastic member 122 is the same as the interposition part 29*b* of the elastic member 29.

The thickness v1 of the peripheral part 122*a* is greater than that of the metal member 27. In the head 120, the peripheral part 122*a* of the elastic member 122 extends further backward relative to the back of the side surface 31 of the metal member 27. That is, the peripheral part 122*a* has a back extending part 122*d* extending further backward relative to the back of the side surface 31 of the metal member 27. The back extending part 122*d* exists over all the periphery of the metal member 27. The back extending part 122*d* is likely to vibrate. The vibration absorbing effect can be further enhanced by the back extending part 122*d*.

The thickness of the back extending part 122*d* is shown by a double-pointed arrow t2 in FIG. 35. In light of the vibration absorbing effect, the thickness t2 is preferably equal to or greater than 0.5 mm, and more preferably equal to or greater than 1.0 mm. When the thickness t2 is excessive, the back extending part 122*d* may hit something. For example, there is a possibility that the back extending part 122*d* hits the heads of the other clubs in a golf bag or the like. When the thickness t2 is excessive, the weight of the adherend s1 increases. The increase of the weight reduces the design flexibility of the head body h1. From these viewpoints, the thickness t2 is preferably equal to or less than 5 mm, more preferably equal to or less than 3 mm, and still more preferably equal to or less than 2 mm.

Figure 36:
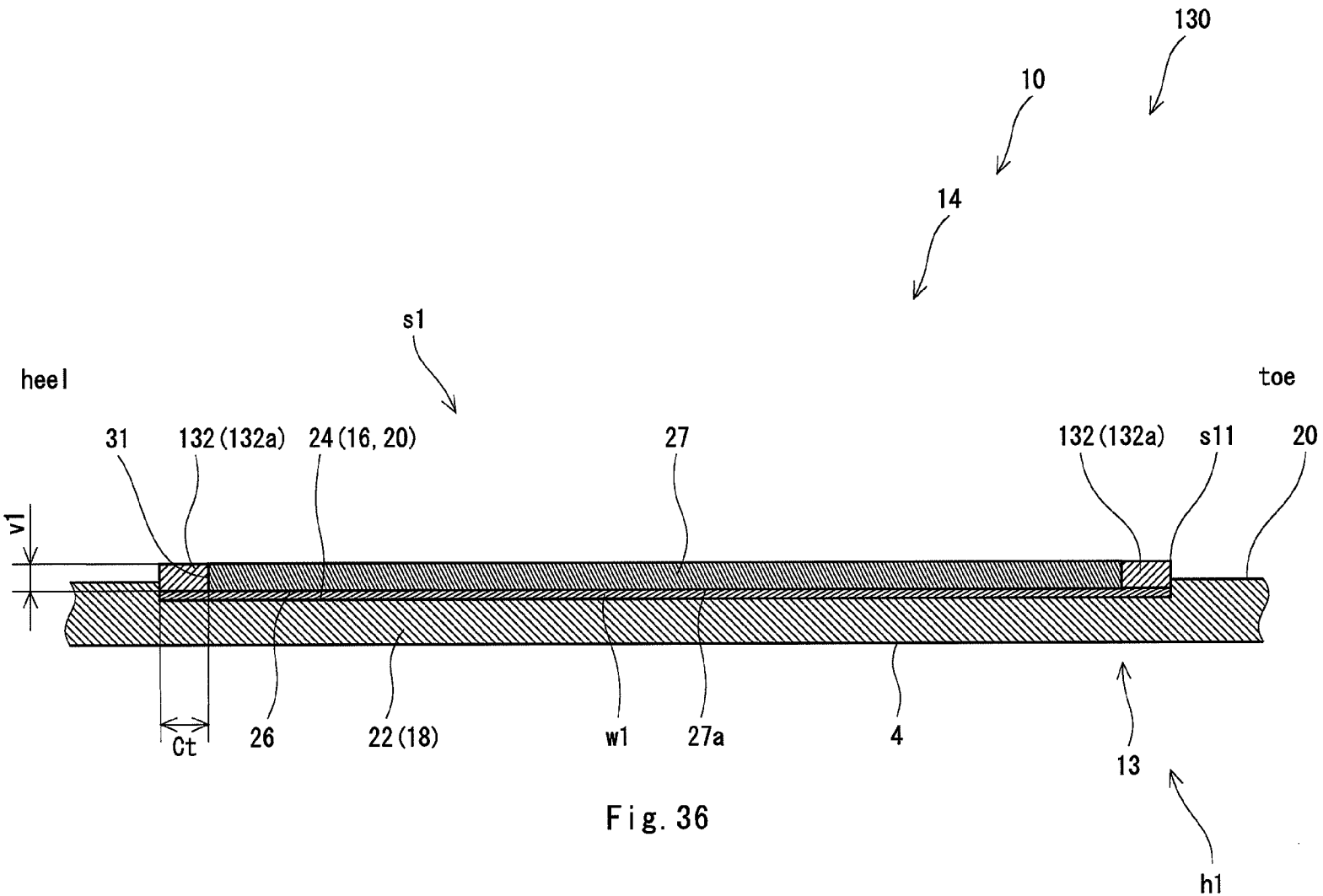
FIG. 36 is a cross sectional view of a golf club head of a ninth embodiment, the position of the cross sectional line of the cross sectional view being the same as that of FIG. 27 in the sixth embodiment.

FIG. 36 is a cross sectional view of a golf club head 130 according to a ninth embodiment. The cross sectional position of the cross sectional view is the same as that of FIG. 27 in the sixth embodiment. The head 130 is an iron type golf club head. The head 130 has a head body h1, an adherend s1 and a double-stick tape w1. The adherend s1 has an approximately flat plate shape as a whole.

In FIG. 36, the back (back side) of the head 130 is located on the upper side in the drawing, and the front (face side) of the head 130 is located on the lower side in the drawing.

The head body h1 of the head 130 is the same as the head body h1 of the head 2. The double-stick tape w1 of the head 130 is the same as the double-stick tape w1 of the head 2. The profile line s11 of the adherend s1 in the head 130 is the same as the profile line s11 of the head 2.

The double-stick tape w1 is interposed between the adherend s1 and the head body h1. The adherend s1 is bonded to the head body h1 by the double-stick tape w1. The profile shape of the double-stick tape w1 and the profile shape s11 of the adherend s1 are substantially equal.

The adherend s1 has a metal member 27 and an elastic member 132.

The metal member 27 of the head 130 is the same as the metal member 27 of the head 2. Except for the elastic member 132, the head 130 is the same as the head 2.

The elastic member 132 of the head 130 is different from the elastic member 29 of the head 2. The difference is the nonexistence of the interposition part. That is, the elastic member 132 does not have the interposition part. The elastic member 132 has only a peripheral part 132*a* directly or indirectly abutting on the side surface 31 of the metal member 27. That is, the elastic member 132 consists of only the peripheral part 132*a*. The elastic member 132 is a circular member. The front surface 27*a* of the metal member 27 is directly brought into contact with the double-stick tape w1.

In the head 130, the adherend s1 can absorb the vibration in a direction parallel to the face surface 4 effectively. The vibration in a direction perpendicular to the face surface 4 can be mainly absorbed by the double-stick tape w1.

The material of the head body h1 is not limited. As the material of the head body h1, soft iron (low carbon steel having a carbon content of less than 0.3 wt %), CFRP (carbon fiber reinforced plastic), maraging steel, stainless steel, a titanium alloy, an aluminium alloy and a magnesium alloy are exemplified. The whole of the head body h1 may be integrally formed, or the head body h1 may be produced by joining a plurality of members. For example, the head body may be produced by combining a flat plate—shaped face member with a face opening member. In this case, as the face member, a titanium alloy is suitable. In this case, as the face opening member, stainless steel is suitable. Forging and casting are exemplified as a method for forming the head body or a component thereof.

The material of the face part 13 is not limited. As the material of the face part 13, soft iron (low carbon steel having a carbon content of less than 0.3 wt %), stainless steel, a titanium alloy, CFRP (carbon fiber reinforced plastic), maraging steel, an aluminium alloy and a magnesium alloy are exemplified.

The adherend s1 and the double-stick tape w1 form a composite body. The composite body can exhibit a vibration absorbing effect. When the weight of the double-stick tape w1 is too small, the vibration absorbing effect of the composite body decreases. From this viewpoint, the weight of the double-stick tape w1 is preferably equal to or greater than 0.1 g, and more preferably equal to or greater than 0.2 g. In light of the weight saving, the weight of the double-stick tape w1 is preferably equal to or less than 2 g, and more preferably equal to or less than 1 g.

The area St of the projection image Tz1 of the adherend s1 is not limited. In light of enhancing the vibrational absorbability when the hitting points vary, the area St is preferably equal to or greater than 600 $mm^2$, more preferably equal to or greater than 800 $mm^2$, and still more preferably equal to or greater than 1000 $mm^2$. When the area St is too large, the adherend s1 is difficult to follow the deformation of the head body, and the separation is likely to occur. From this viewpoint, the area St is preferably equal to or less than 1700 $mm^2$, more preferably equal to or less than 1600 $mm^2$ and still more preferably equal to or less than 1500 $mm^2$.

The maximum thickness of the metal member is shown by a double-pointed arrow At in FIG. 27 or the like. In light of the vibration absorbing effect, the thickness At is preferably equal to or greater than 0.5 mm, more preferably equal to or greater than 1.0 mm, and still more preferably equal to or greater than 1.5 mm. When the weight of the adherend s1 is excessive, the design flexibility of the head body h1 is limited. When the weight of the metal member is excessive, the metal member and the elastic member may be separated from each other. From these viewpoints, the thickness At is preferably equal to or less than 4.0 mm, more preferably equal to or less than 3.5 mm, and still more preferably equal to or less than 3.0 mm.

In light of the vibration absorbing effect, the thickness v1 (see FIG. 26) of the peripheral part is preferably equal to or greater than 0.5 mm, more preferably equal to or greater than 1.0 mm, and still more preferably equal to or greater than 1.5 mm. When the weight of the adherend s1 is excessive, the design flexibility of the head body h1 is limited. From this viewpoint, the thickness v1 is preferably equal to or less than 7.0 mm, more preferably equal to or less than 6.0 mm, and still more preferably equal to or less than 5.0 mm.

The width of the peripheral part is shown by a double-pointed arrow Ct in FIG. 27 or the like. In light of the vibration absorbing effect, the width Ct is preferably equal to or greater than 0.5 mm, preferably equal to or greater than 0.7 mm, and still more preferably equal to or greater than 1.0 mm. When the width Ct is excessive and the size of the metal member is excessively reduced, the vibration absorbing effect decreases. From this viewpoint, the width Ct is preferably equal to or less than 4.0 mm, more preferably equal to or less than 3.5 mm, and still more preferably equal to or less than 3.0 mm.

The thickness of the interposition part is shown by a double-pointed arrow Dt in FIG. 27 or the like. In light of the vibration absorbing effect, the thickness Dt is preferably equal to or greater than 0.3 mm, more preferably equal to or greater than 0.5 mm, still more preferably equal to or greater than 0.7 mm, and particularly preferably equal to or greater than 1.0 mm. When the weight of the adherend s1 is excessive, the design flexibility of the head body h1 is limited. From this viewpoint, the thickness Dt is preferably equal to or less than 5.0 mm, more preferably equal to or less than 4.0 mm, still more preferably equal to or less than 3.0 mm, still yet more preferably equal to or less than 2.0 mm, and particularly preferably equal to or less than 1.5 mm.

The thickness of the inner side extending part 106*c* is shown by a double-pointed arrow Et in FIG. 34. In light of the vibration absorbing effect, the thickness Et is preferably equal to or greater than 0.3 mm, more preferably equal to or greater than 0.5 mm, and still more preferably equal to or greater than 0.7 mm. When the thickness Et is excessive and thickness At is too thin, the strength of the metal member is reduced. From this viewpoint, the thickness Et is preferably equal to or less than 3.5 mm, more preferably equal to or less than 3.0 mm, and still more preferably equal to or less than 2.5 mm.

In light of the vibration absorbing effect, a ratio (Et/At) of the thickness Et (mm) to the thickness At (mm) is preferably equal to or greater than 0.2, more preferably equal to or greater than 0.3, and still more preferably equal to or greater than 0.4. When the thickness At is too small, the vibration absorbing effect is reduced, and the strength of the metal member is reduced. From this viewpoint, the ratio (Et/At) is preferably equal to or less than 0.8, and more preferably equal to or less than 0.7.

In the head 2 of the sixth embodiment, the head 100 of the seventh embodiment and the head 120 of the eighth embodiment, the whole of the front surface of the metal member is covered with the elastic member. On the other hand, in the head 130 of the ninth embodiment, the front surface of the metal member is not covered with the elastic member. In the head 130, the front surface of the metal member is directly brought into contact with the double-stick tape. In Comparative Example 2 (FIG. 37) to be described later, an end face 143 of the front surface of the metal member 142 is not covered with the elastic member. In light of the vibration absorbing effect, the whole of the front surface of the metal member is preferably covered with the elastic member.

EXAMPLES

Hereinafter, the effects of the present invention will be clarified by Examples. However, the present invention should not be interpreted in a limited way based on the description of Examples. Evaluation was carried out by the following Test 1, Test 2 and Test 3.

Test 1

Example 1x

A head having a shape shown in FIGS. 1 and 2 was produced. However, a head body was formed by joining a face opening member and a flat plate-shaped face member. The joining was carried out by press fitting and swaging. As the material of the face opening member, SUS630 stainless steel was used. As the material of the face member, 6-4 Titanium (Ti-6A1-4V) was used. The face opening member was produced by lost-wax precision casting. The face member was obtained by punching out a plate material and further subjecting the plate material to NC processing. The weight of the face opening member was 175 g. The weight of the face member was 75 g. A batch was used as an adherend s1*x*. The material of the badge was SUS304 stainless steel, and the weight of the badge was 4.5 g. As a double-stick tape, "Y-4625" (trade name) produced by Sumitomo 3M Limited was used. The thickness of "Y-4625" was 0.25 mm. The thickness d1*x* was 2.2 mm. A hitting point was set to the center of gravity of the area of the face surface. The double-stick tape and the badge were disposed on the reverse side of the hitting point. The head was attached to the tip part of a shaft made of CFRP. As the shaft, MP-400 produced by SRI Sports Limited was used. A grip was attached to the back end part of the shaft to obtain a golf club according to Example 1. "Y-4625" has a five-layered structure. The five layers are an acrylic adhesive layer, an acrylic resin layer which is free of bubbles, a nonwoven fabric layer, an acrylic resin layer which is free of bubbles and an acrylic adhesive layer in this order from an innermost layer.

Example 2x

A head and a club according to Example 2x were obtained in the same manner as in Example 1x except that the double-stick tape was changed to "VHX-802" (trade name) produced by Sumitomo 3M Limited. The thickness of "VHX-802" was 0.25 mm. The "VHX-802" has a four-layered structure. The four layers are an acrylic adhesive layer, an acrylic resin layer which is free of bubbles, a nonwoven fabric layer and an acrylic adhesive layer in this order from an innermost layer.

Example 3x

A head and a club according to Example 3x were obtained in the same manner as in Example 1x except that the double-stick tape was changed to "4393" (trade name) produced by Sumitomo 3M Limited. The thickness of "4393" was 0.20 mm. "4393" has a three-layered structure. The three layers are an acrylic adhesive layer, a polyester film layer and an acrylic adhesive layer in this order from an innermost layer.

Comparative Example 1x

A head and a club according to Comparative Example 1x were obtained in the same manner as in Example 1x except that the double-stick tape was changed to "Y-4914" (trade name) produced by Sumitomo 3M Limited. The thickness of "Y-4914" was 0.25 mm. "Y-4914" has a three-layered structure. The three layers are an acrylic adhesive layer, an acrylic form layer and an acrylic adhesive layer in this order from an innermost layer. The acrylic form layer is a resin layer having bubbles.

[Evaluation of Durability]

Each of the clubs was attached to a swing robot produced by Miyamae Kabushiki Kaisha and made to hit golf balls at a head speed of 54 m/s. The state of the head was visually observed every 500 hittings, and the state of the bonded surface of the badge was confirmed. The hitting was finished when the separation was confirmed.

[Results of Evaluation of Durability]

In Example 1x, a part of the bonded surface of the badge was separated when the club is subjected to 9500 times of hitting. In Example 2x, a part of the bonded surface of the badge was separated when the club is subjected to 7000 times of hitting. In Example 3x, a part of the bonded surface of the badge was separated when the club is subjected to 5500 times of hitting. In Comparative Example 1x, a part of the bonded surface of the badge was separated when the club is subjected to 2500 times of hitting.

Test 2

Example 1y

A head having a shape shown in FIGS. 7 and 8 was produced. However, a head body was formed by joining a face opening member and a flat plate-shaped face member. The joining was carried out by press fitting and swaging. As the material of the face opening member, SUS630 stainless steel was used. As the material of the face member, 6-4 Titanium (Ti-6A1-4V) was used. The face opening member was produced by lost-wax precision casting. The face member was obtained by punching out a plate material and further subjecting the plate material to NC processing. The weight of the face opening member was 175 g. The weight of the face member was 75 g. A batch was used as an adherend s1*y*. The material of the badge was SUS304 stainless steel, and the weight of the badge was 4.5 g. As a double-stick tape, "Y-4625" (trade name) produced by Sumitomo 3M Limited was used. The double-stick tape formed into the same shape as that of the batch was stuck on the batch, and the batch was stuck on the head body. Then, the batch was pressed to the head body for 10 seconds to obtain the head with the batch. The thickness of "Y-4625" was 0.25 mm. The head was a five-iron. The head was attached to the tip part of a shaft made of CFRP. As the shaft, "MP-400" (trade name) produced by SRI Sports Limited was used. A grip was attached to the back end part of the shaft to obtain a golf club according to Example 1y. "Y-4625" has a five-layered structure. The five layers are an acrylic adhesive layer, an acrylic resin layer which is free of bubbles, a nonwoven fabric layer, an acrylic resin layer which is free of bubbles and an acrylic adhesive layer in this order from an innermost layer.

In Example 1y, the depth a1*y* of the recessed part was set to 4 mm, and the thickness T1*y* of the recessed part was constantly set to 0.5 mm. The thickness T2*y* of a portion (flat plate part) other than the recessed part was constantly set to 1.0 mm. The projection area S1*y* of the adherend s1*y* was set to 15 $cm^2$, and the projection area S2*y* of the recessed part was set to 5 $cm^2$. The diameter D1*y* of the maximum inscribed circle was set to 10 mm. The specifications and evaluation results of Example 1y are shown in the following Table 1.

Example 2y

Figure 15:
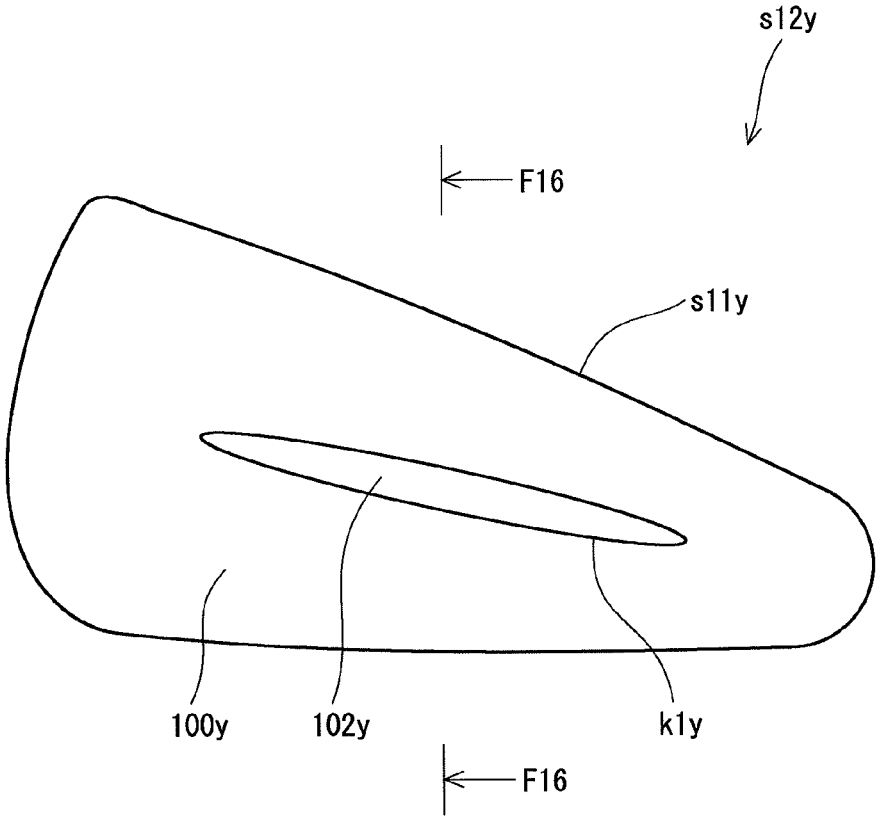
FIG. 15 is a view of an adherend used for Example 2y as seen from a bonded surface side.
Figure 16:
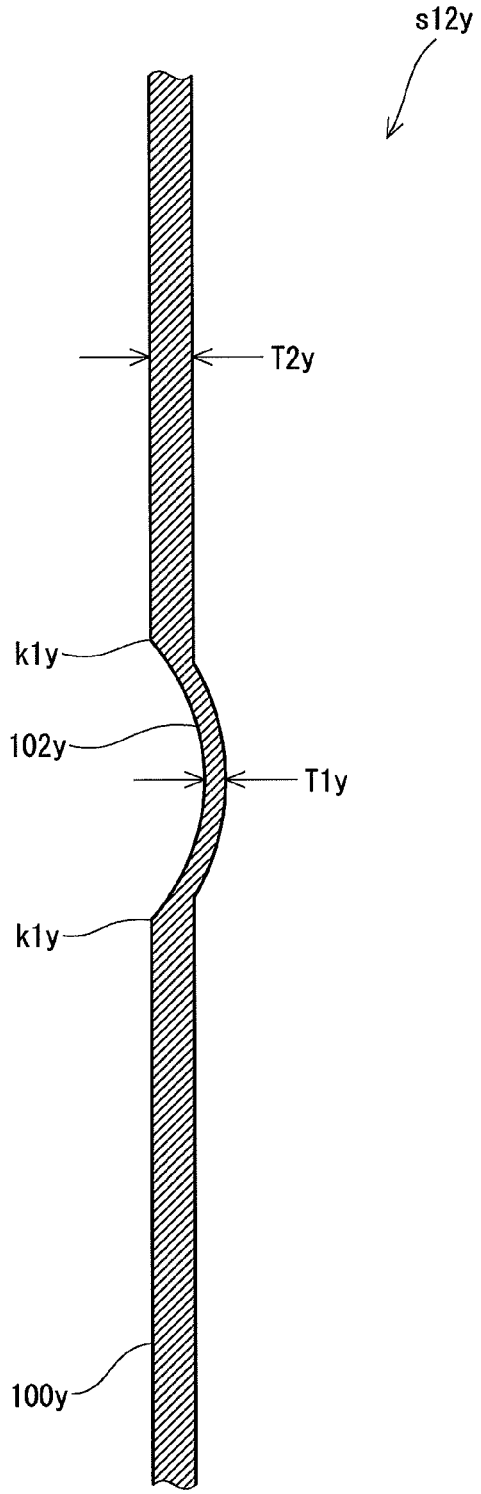
FIG. 16 is a cross sectional view taken along a line F16-F16 in FIG. 15.

FIG. 15 is a view of an adherend s12*y* used for Example 2y as seen from a bonded surface 100*y* side. FIG. 16 is a cross sectional view taken along a line F16-F16 in FIG. 15. The adherend s12*y* has one recessed part 102*y*. A golf club head and a golf club of Example 2y were obtained in the same manner as in Example 1y except that the size of the recessed part was changed. The specifications and evaluation results of Example 2y are shown in the following Table 1.

Example 3y

Figure 17:
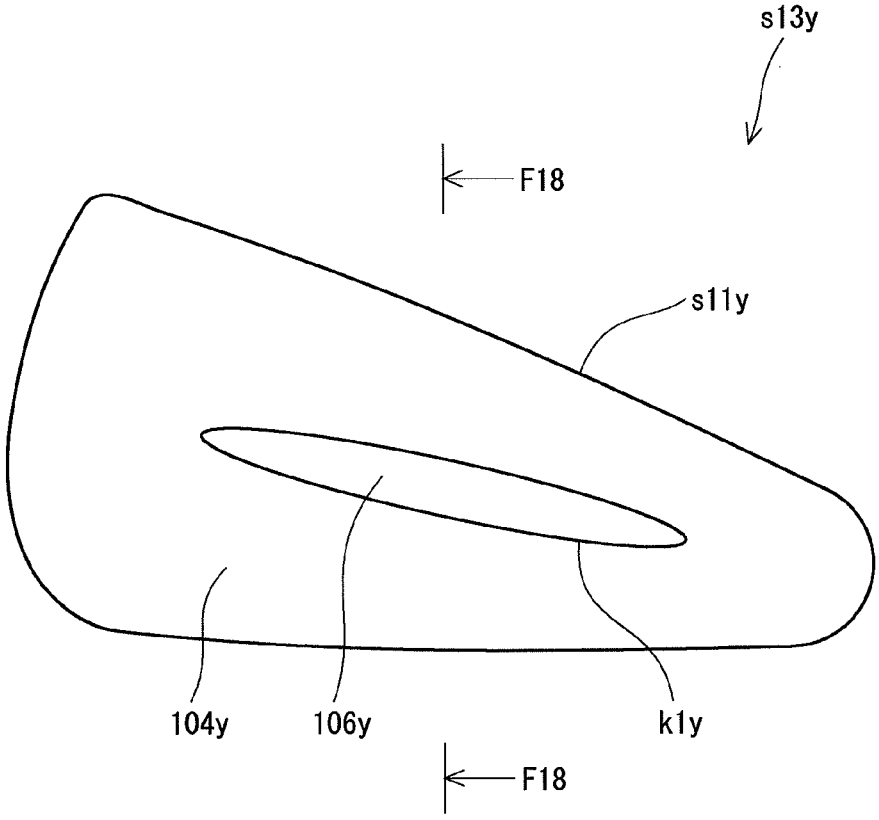
FIG. 17 is a view of an adherend used for Example 3y as seen from a bonded surface side.
Figure 18:
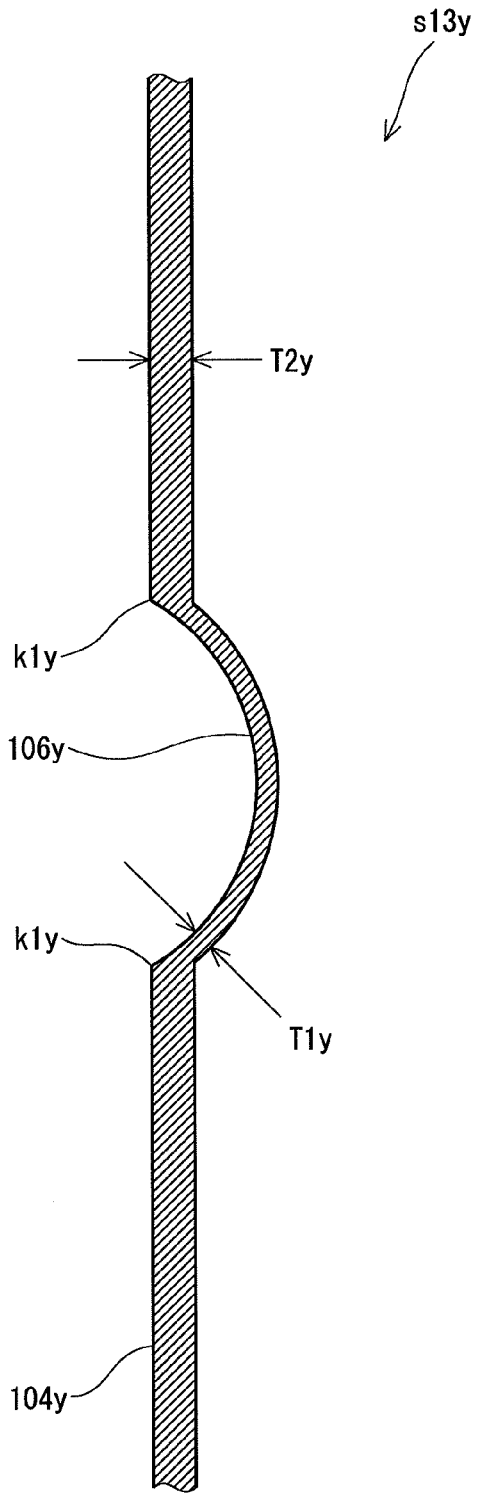
FIG. 18 is a cross sectional view taken along a line F18-F18 in FIG. 17.

FIG. 17 is a view of an adherend s13*y* used for Example 3y as seen from a bonded surface 104*y* side. FIG. 18 is a cross sectional view taken along a line F18-F18 in FIG. 17. The adherend s13*y* has one recessed part 106*y*. A golf club head and a golf club of Example 3y were obtained in the same manner as in Example 1y except that the size of the recessed part was changed. The specifications and evaluation results of Example 3y are shown in the following Table 1.

Example 4y

Figure 19:
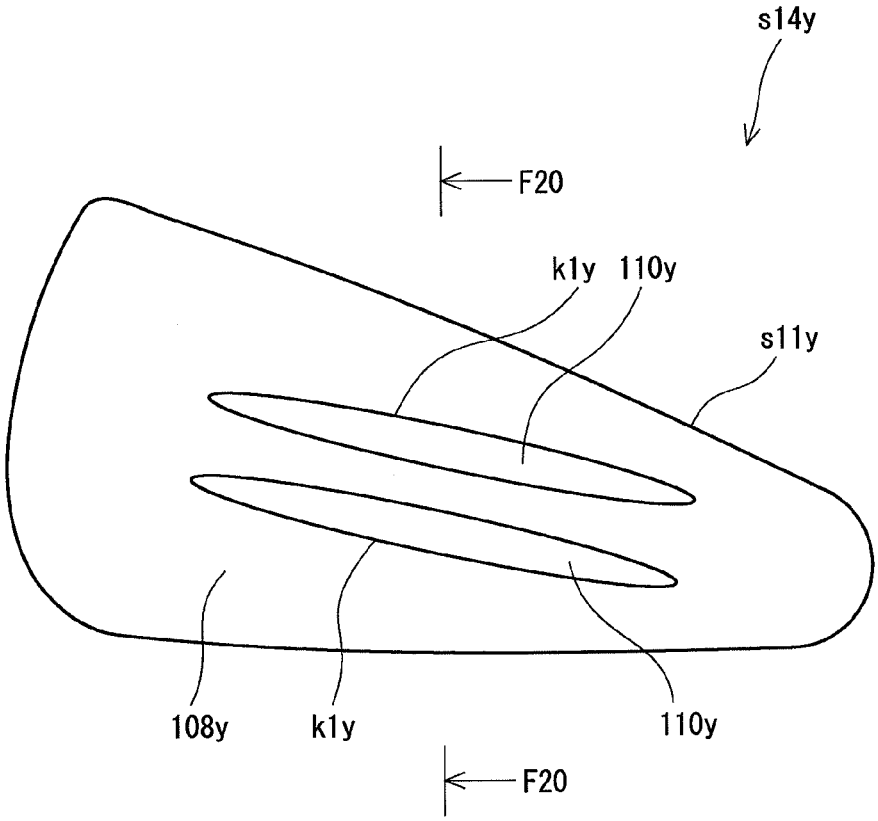
FIG. 19 is a view of an adherend used for Example 4y as seen from a bonded surface side.
Figure 20:
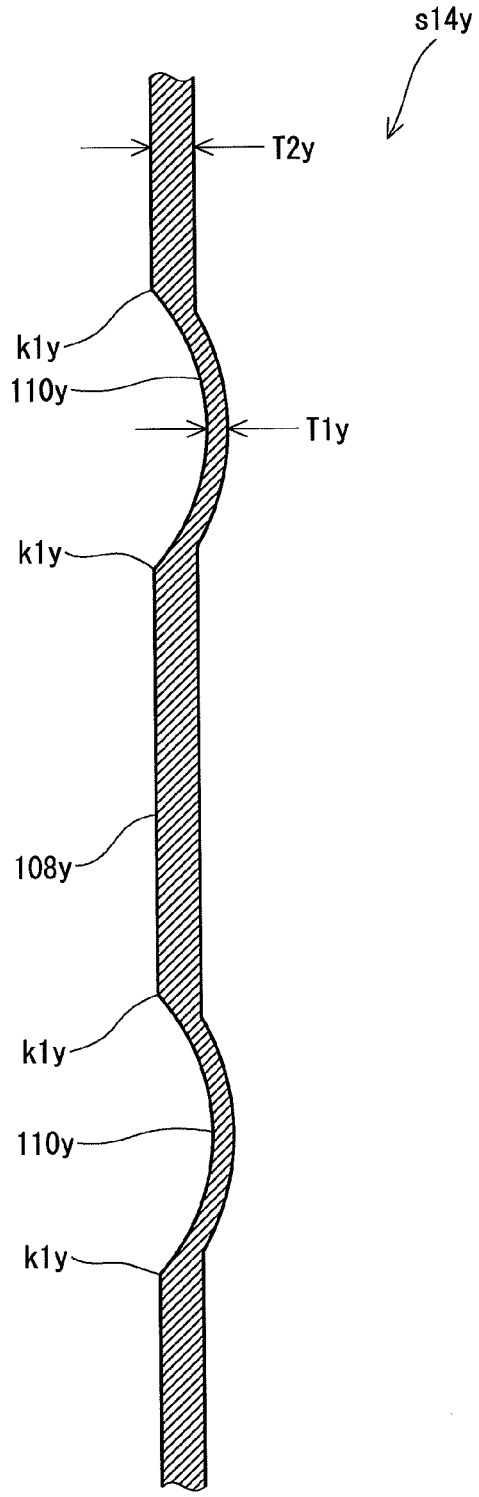
FIG. 20 is a cross sectional view taken along a line F20-F20 in FIG. 19.

FIG. 19 is a view of an adherend s14*y* used for Example 4y as seen from a bonded surface 108*y* side. FIG. 20 is a cross sectional view taken along a line F20-F20 in FIG. 19. The adherend s14*y* has two recessed parts 110*y*. A golf club head and a golf club of Example 4y were obtained in the same manner as in Example 1y except that the number and size of the recessed part were changed. The specifications and evaluation results of Example 4y are shown in the following Table 1.

Example 5y

Figure 21:
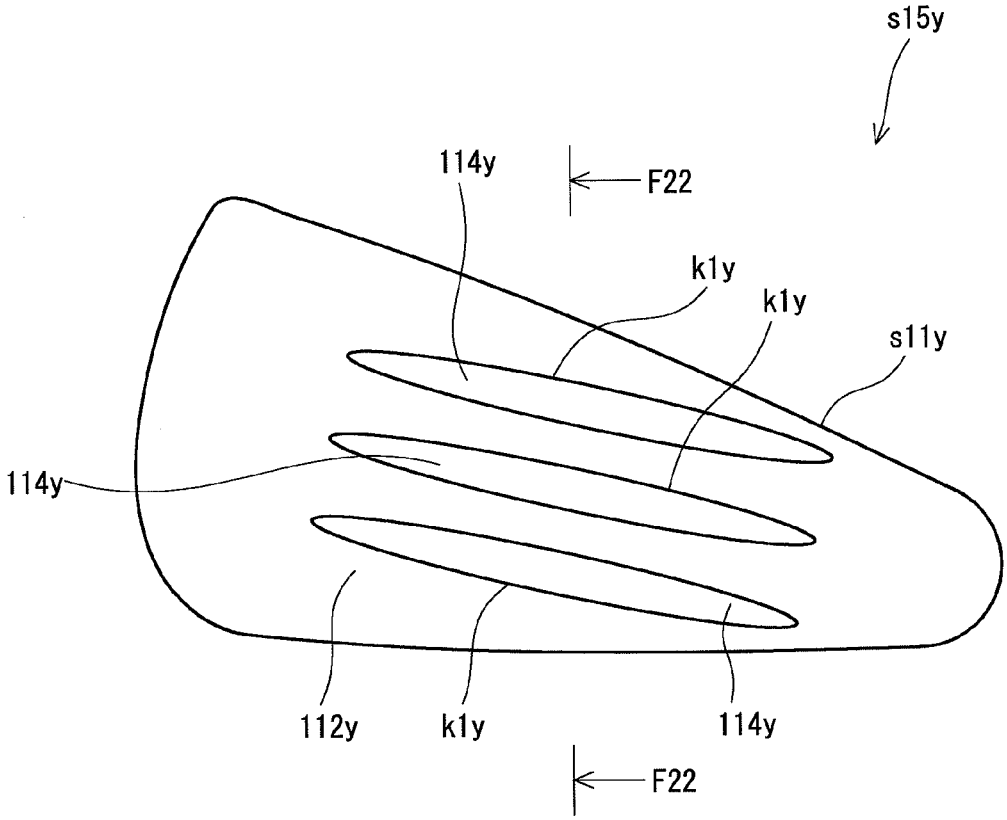
FIG. 21 is a view of the adherend used for Example 5y as seen from a bonded surface side.
Figure 22:
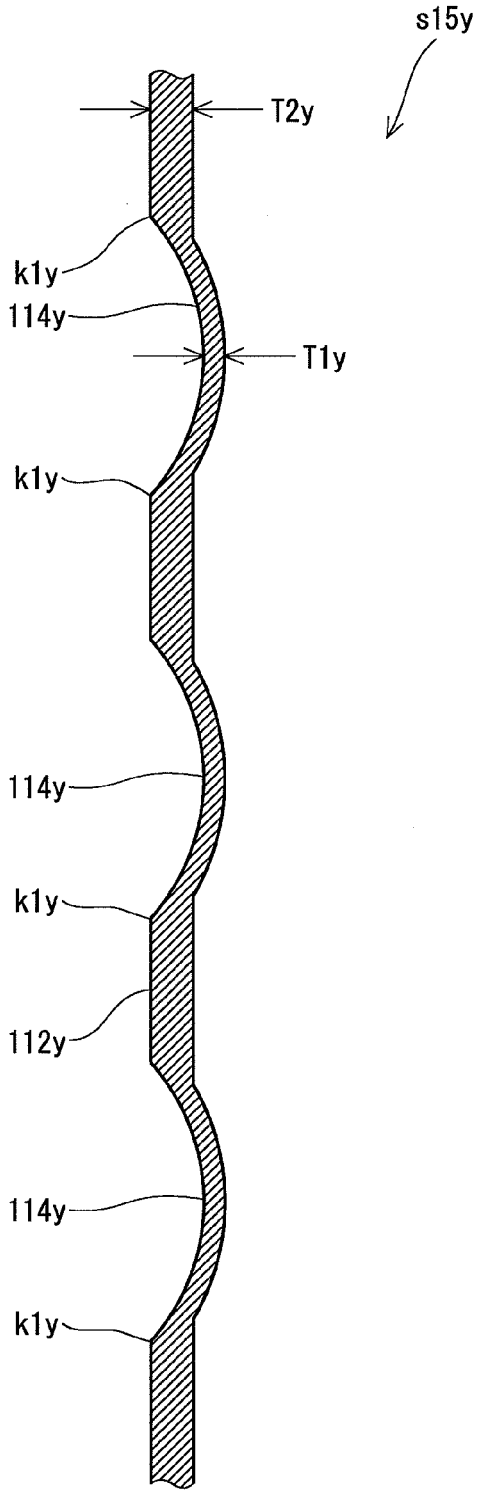
FIG. 22 is a cross sectional view taken along a line F22-F22 in FIG. 21.

FIG. 21 is a view of an adherend s15*y* used for Example 5y as seen from a bonded surface 112*y* side. FIG. 22 is a cross sectional view taken along a line F22-F22 in FIG. 21. The adherend s15*y* has three recessed parts 114*y*. A golf club head and a golf club of Example 5y were obtained in the same manner as in Example 1y except that the number and size of the recessed part were changed. The specifications and evaluation results of Example 5y are shown in the following Table 1.

Comparative Example 1y

Figure 23:
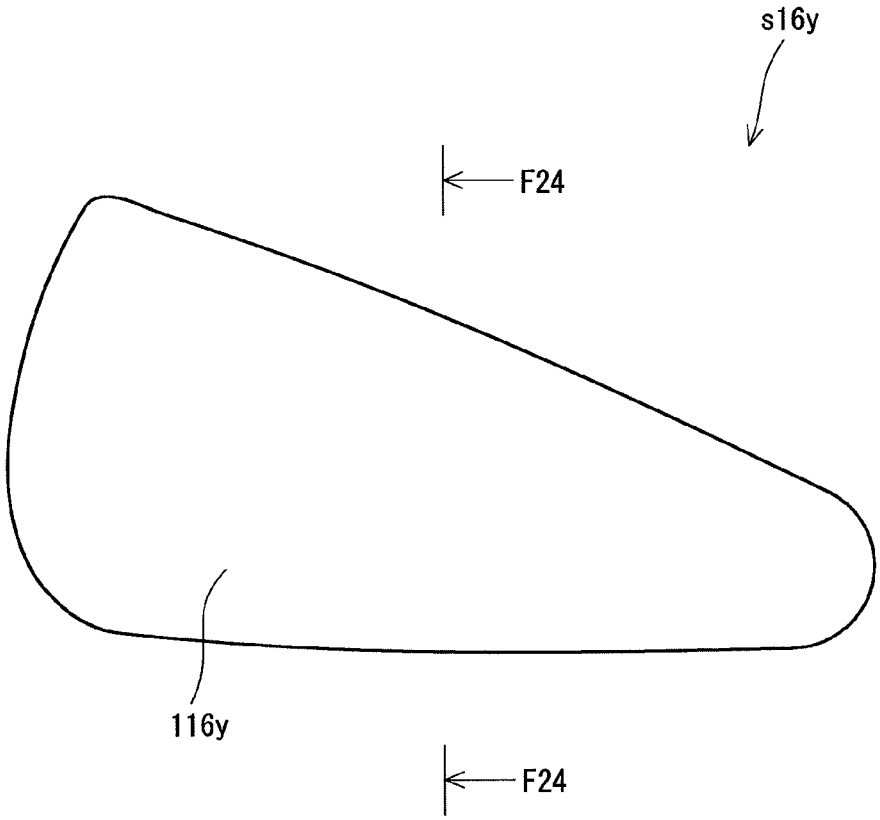
FIG. 23 is a view of an adherend used for Comparative Example 1y as seen from a bonded surface side.
Figure 24:
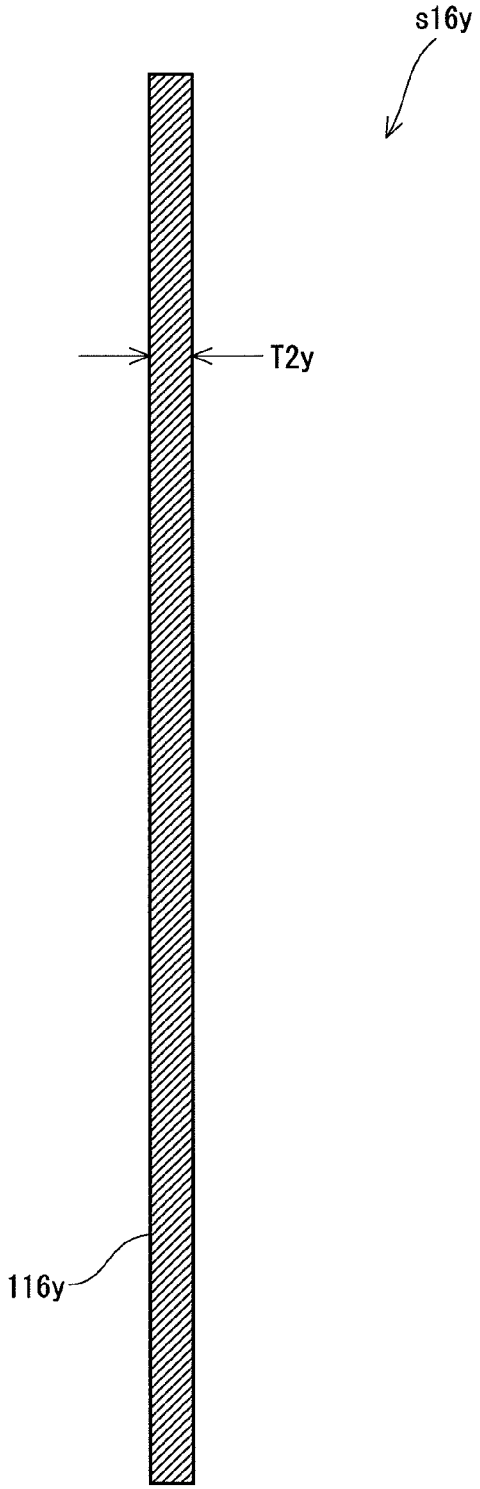
FIG. 24 is a cross sectional view taken along a line F24-F24 in FIG. 23.

FIG. 23 is a view of an adherend s16*y* used for Comparative Example 1y as seen from a bonded surface 116*y* side. FIG. 24 is a cross sectional view taken along a line F24-F24 in FIG. 23. The adherend s16*y* does not have the recessed part. The whole of the bonded surface 116*y* is a plane. A golf club head and a golf club of Comparative Example 1y were obtained in the same manner as in Example 1y except that the recessed part was not formed. The specifications and evaluation results of Comparative Example 1y are shown in the following Table 1.

[Evaluation of Durability]

Each of the clubs was attached to a swing robot produced by Miyamae Kabushiki Kaisha and made to hit golf balls at a head speed of 49 m/s. The state of the head was visually observed every 500 hittings, and the state of the bonded surface of the badge was confirmed. The hitting was finished when the separation was confirmed. Evaluation was finished after 10000 hittings. The evaluation results are shown in the following Table 1.

plate material and further subjecting the plate material to NC processing. The weight of the face opening member was 175 g. The weight of the face member was 75 g. A batch was used as an adherend s1. As the material of the metal member of the batch, an aluminium alloy was used. As the material of the elastic member of the batch, a polyurethane resin was used. The whole of the elastic member was integrally formed. The shore D hardness H1 of the polyurethane resin was set to 50. The metal member and the elastic member were bonded by an adhesive. The maximum thickness At of the metal member was set to 2.0 mm. The thickness v1 of the peripheral part was set to 1.0 mm. The width Ct of the peripheral part was set to 1.0 mm. The thickness Dt of the interposition part was set to 0.5 mm. The inner side extending part was not provided. The weight of the badge was 4.5 g.

As a double-stick tape, "Y-4625" (trade name) produced by Sumitomo 3M Limited was used. The double-stick tape formed into the same shape as that of the batch was stuck on the batch, and the batch was stuck on the head body. Then, the batch was pressed to the head body for 10 seconds to obtain the head with the batch. The thickness of "Y-4625" was 0.25 mm. The head was a five-iron. The head was attached to the tip part of a shaft made of CFRP. As the shaft, "MP-400" (trade name) produced by SRI Sports Limited was used. A grip was attached to the back end part of the shaft to obtain a golf club according to Example 1. "Y-4625" has a five-layered structure. The five layers are an acrylic adhesive layer, an acrylic resin layer which is free of bubbles, a nonwoven fabric layer, an acrylic resin layer which is free of bubbles and an acrylic adhesive layer in this order from an innermost layer.

Examples 2 and 3

A golf club head and a golf club of each of Examples were obtained in the same manner as in Example 1 except that the values shown in Table 2 were changed. The specifications and evaluation results of Examples 2 and 3 are shown in the following Table 2.

A head of an embodiment of Example 3 is the same as the head 120 shown in FIG. 35. In Example 3, the thickness t2 of the back extending part is 1.0 mm.

TABLE 1

Specifications and evaluation results of Examples and Comparative Examples

| | Example 1y | Example 2y | Example 3y | Example 4y | Example 5y | Comparative Example 1y |
|---|---|---|---|---|---|---|
| a1y (mm) | 4 | 1 | 2 | 1 | 1 | 0 |
| T1y (mm) | 0.5 | 0.5 | 0.5 | 0.5 | 0.5 | — |
| T2y (mm) | 1.0 | 1.0 | 1.0 | 1.0 | 1.0 | 1.0 |
| S1y ($cm^2$) | 15 | 15 | 15 | 15 | 15 | 15 |
| S2y ($cm^2$) | 5 | 2 | 3 | 4 | 6 | — |
| S2y/S1y | 0.33 | 0.13 | 0.2 | 0.27 | 0.4 | — |
| Diameter D1y of maximum inscribed circle (mm) | 10 | 5 | 7 | 5 | 5 | — |
| Number of recessed parts (piece) | 1 | 1 | 1 | 2 | 3 | 0 |
| Durability | A part of a bonded surface of a batch was separated after 5500 times of hitting. | A part of a bonded surface of a batch was separated after 8000 times of hitting. | A part of a bonded surface of a batch was separated after 7000 times of hitting. | A part of a bonded surface of a batch was separated after 9000 times of hitting. | There was no separation after 10000 times of hitting. | A part of a bonded surface of a batch was separated after 2500 times of hitting. |

Test 3

Example 1

The same head as the head 2 of the sixth embodiment shown in FIGS. 25, 26 and 27 was produced. However, a head body was formed by joining a face opening member and a flat plate-shaped face member. The joining was carried out by press fitting and swaging. As the material of the face opening member, SUS630 stainless steel was used. As the material of the face member, 6-4 Titanium (Ti-6A1-4V) was used. The face opening member was produced by lost-wax precision casting. The face member was obtained by punching out a Example 4

The same head as the head 100 of the seventh embodiment shown in FIGS. 32, 33 and 34 was produced. The maximum thickness At of the metal member was set to 2.0 mm. The thickness v1 of the peripheral part was set to 1.0 mm. The width Ct of the peripheral part was set to 1.0 mm. The thickness Dt of the interposition part was set to 1.5 mm. The thickness Et of the inner side extending part was set to 1.0 mm. A head and a club of Example 4 were obtained in the same manner as in Example 1 except for the matters described above. The specifications and evaluation results of Example 4 are shown in the following Table 2.

Examples 5 and 6

A golf club head and a golf club of each of Examples were obtained in the same manner as in Example 4 except that the values shown in Table 2 were changed. The specifications and evaluation results of Examples 5 and 6 are shown in the following Table 2.

Example 6 has a back extending part. The thickness t2 of the back extending part of Example 6 is 1.0 mm.

Example 7

The same head as the head 130 shown in FIG. 36 was produced. The maximum thickness At of a metal member was set to 2.0 mm. The metal member is the same as that of Example 1. The thickness v1 of a peripheral part was set to 2.0 mm. The width Ct of the peripheral part was set to 1.0 mm. An interposition part was not provided. An inner side extending part was not provided. A member in which the metal member was fitted into an elastic member was produced. The member and head body were bonded by a double-stick tape. A head and a club of Example 7 were obtained in the same manner as in Example 1 except for the matters described above. The specifications and evaluation results of Example 7 are shown in the following Table 2.

Comparative Example 1

The metal member used in Example 1 was used as an adherend. The adherend was made of only a metal member. That is, the adherend which is free of an elastic member was used. A head and a club of Comparative Example 1 were obtained in the same manner as in Example 1 except for the matters described above. The specifications and evaluation results of Comparative Example are shown in the following Table 2.

Comparative Example 2

Figure 37:
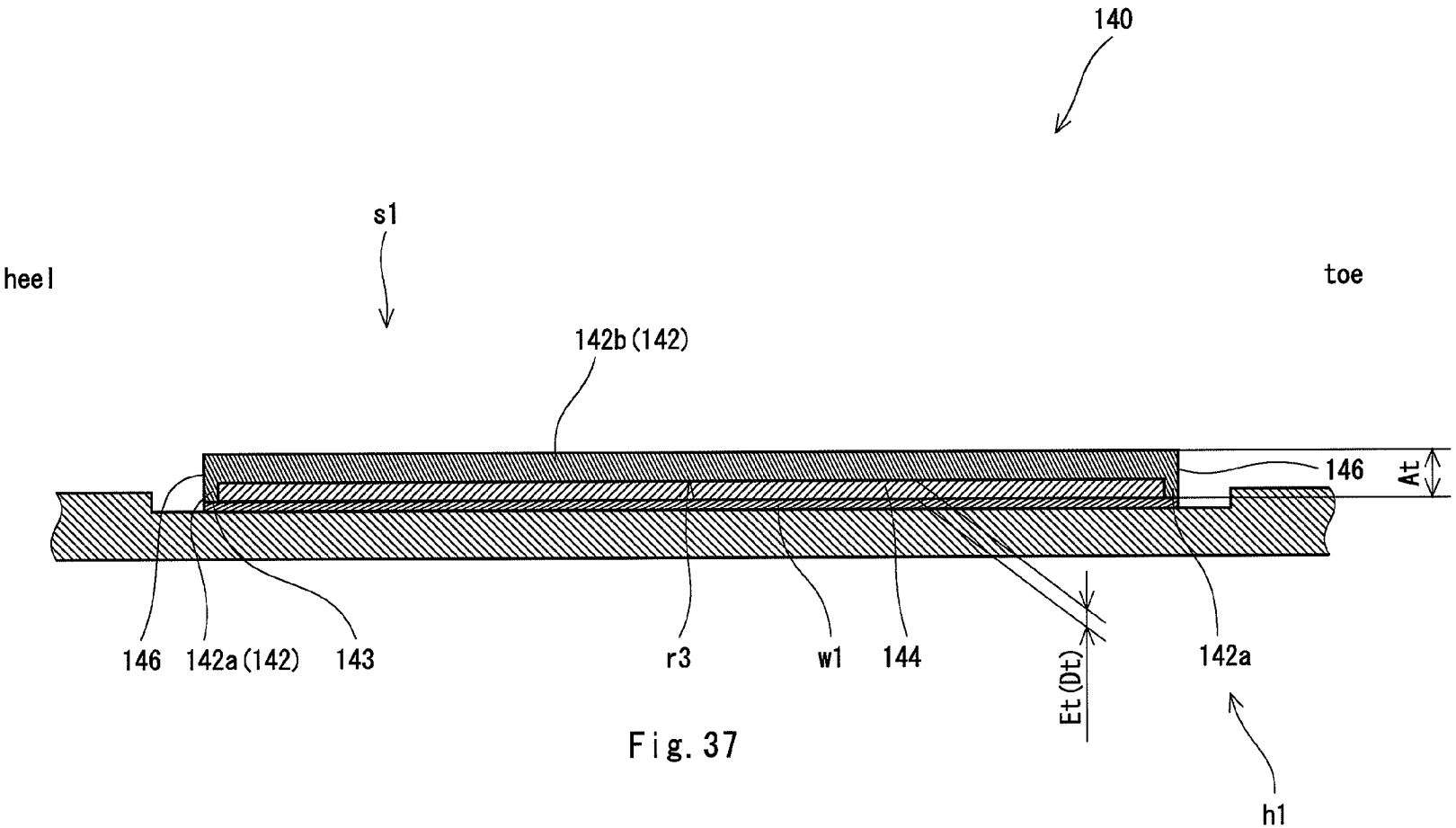
FIG. 37 is a cross sectional view of a golf club head of Comparative Example 2, the position of the cross sectional line of the cross sectional view being the same as that of FIG. 27 in the sixth embodiment.

FIG. 37 is a cross sectional view of a head 140 of Comparative Example 2.

A head body h1 of Comparative Example 2 is the same as that of Example 1.

A metal member 142 has a periphery wall part 142*a* and a main part 142*b*. The periphery wall part 142*a* is circular. The main part 142*b* has a flat plate shape. The metal member 142 consists of the periphery wall part 142*a* and the main part 142*b*. A recessed part r3 is formed by the main part 142*b* and the periphery wall part 142*a*. An end face 143 of the periphery wall part 142*a* is directly brought into contact with a double-stick tape w1.

The metal member 142 of Comparative Example 2 has the recessed part r3. The recessed part r3 is formed on the front surface of the metal member 142. The recessed part r3 is opened to the front of the head 140. The main part 142*b* constitutes the bottom part of the recessed part r3. The thickness of the main part 142*b* is 2 mm. The recessed part r3 is filled with an elastic member 144. The depth of the recessed part r3 is 1 mm. The thickness of the elastic member 144 is 1 mm. Therefore, in the following Table 2, a thickness Dt and a thickness Et are described to be 1 mm. The elastic member 144 does not have a peripheral part which abuts on a side surface 146 of the metal member 142 directly or indirectly.

The metal member 142 of the head of Comparative Example 2 is the same as the metal member of Example 4 except for the thickness of the main part 142*b*.

A head and a club of Comparative Example 2 were obtained in the same manner as in Example 1 except for the matters described above. The specifications and evaluation results of Comparative Example 2 are shown in the following Table 2.

[Feeling Evaluation]

Ten testers hit and evaluated impact shock at the time of hitting balls. Five-step evaluation was carried out based on the following standard. Evaluation was carried out on the basis of Comparative Example 2. The higher scores are, the higher the evaluation is. The average value of ten testers' scores is shown in the following Table 2.

Five score: Impact shock is smaller than that of Comparative Example 2, and hitting feeling is better than that of Comparative Example 2.

Four score: Impact shock is slightly smaller than that of Comparative Example 2, and hitting feeling is slightly better than that of Comparative Example 2.

Three score: Impact shock and hitting feeling are equivalent to those of Comparative Example 2.

Two score: Impact shock is slightly greater than that of Comparative Example 2, and hitting feeling is slightly worse than that of Comparative Example 2.

One score: Impact shock is greater than that of Comparative Example 2, and hitting feeling is worse than that of Comparative Example 2.

TABLE 2

Specifications and evaluation results of Examples and Comparative Examples

| | Unit | Example 1 | Example 2 | Example 3 | Example 4 | Example 5 | Example 6 | Example 7 | Comparative Example 1 | Comparative Example 2 |
|---|---|---|---|---|---|---|---|---|---|---|
| Thickness At | mm | 2.0 | 2.0 | 2.0 | 2.0 | 2.0 | 2.0 | 2.0 | 2.0 | 3.0 |
| Thickness t1 | mm | 1.0 | 2.0 | 3.0 | 1.0 | 2.0 | 3.0 | 2.0 | 0.0 | 0.0 |
| Width Ct | mm | 1.0 | 1.0 | 1.0 | 1.0 | 1.0 | 1.0 | 1.0 | 0.0 | 0.0 |
| Thickness Dt | mm | 0.5 | 0.5 | 0.5 | 1.5 | 1.5 | 1.5 | 0.0 | 0.0 | 1.0 |
| Thickness Et | mm | 0.0 | 0.0 | 0.0 | 1.0 | 1.0 | 1.0 | 0.0 | 0.0 | 1.0 |
| Thickness t2 | mm | 0.0 | 0.0 | 1.0 | 0.0 | 0.0 | 1.0 | 0.0 | 0.0 | 0.0 |
| Feeling evaluation | | 3.6 | 4.0 | 4.2 | 4.1 | 4.3 | 4.5 | 3.2 | 2.2 | — |

As described above, Examples have higher evaluation than those of Comparative Examples. Advantages of the present invention are clearly indicated by these results of evaluation.

The present invention includes a head obtained by combining two or more of aspects selected from the first aspect, the second aspect and the third aspect. That is, the present invention includes a head obtained by combining the first aspect and the second aspect, a head obtained by combining the first aspect and the third aspect, a head obtained by combining the second aspect and the third aspect and a head obtained by combining the first aspect, the second aspect and the third aspect.

The present invention is applicable to all types of golf clubs.

The description hereinabove is merely for an illustrative example, and various modifications can be made in the scope not to depart from the principles of the present invention.

What is claimed is:

1. A golf club head comprising: a head body having a face surface, a back surface located on a back of the face surface, a top surface, and a sole surface, said top surface and sole surface providing permanent weighting in defining a cavity on the back surface of the head body, a double-stick tape, an adherend bonded to the back surface of the head body in said cavity by said double-stick tape, said adherend having a metal member and an elastic member which has a peripheral part directly or indirectly abutting on a side surface of the metal member, wherein the double-stick tape includes a first adhesive layer provided as an innermost layer, a second adhesive layer provided as an outermost layer, and an intermediate layer provided between the first adhesive layer and the second adhesive layer;

the intermediate layer includes a fiber layer and/or a resin layer; the resin layer is free of bubbles;

the head body and the adherend have a bonded surface bonded to the double-stick tape;

the adherend includes a recessed part on an inner surface thereof and a corresponding protruding part on an outer surface thereof;

the inner surface of the adherend comprising the recessed part and the bonded surface are adjacent to each other; and an enclosed space exists between the double-stick tape and the recessed part.

2. The golf club head according to claim 1, wherein the intermediate layer consists of only a nonwoven fabric layer and a resin layer free of bubbles.

3. The golf club head according to claim 1, wherein the intermediate layer consists of only a nonwoven fabric layer.

4. The golf club head according to claim 1, wherein the adherend has an approximately plate shape and an existence region of the adherend includes a back surface point of a sweet spot of the golf club head.

5. The golf club head according to claim 1, wherein the elastic member has an interposition part interposed between the metal member and the back surface of the head body.

6. The golf club head according to claim 5, wherein: the elastic member has a back surface having a recessed part; the metal member is disposed inside the recessed part; a peripheral wall of the recessed part is the peripheral part; and a bottom part of the recessed part is the interposition part.

7. The golf club head according to claim 5, wherein: the metal member has a front surface having a recessed part; and the interposition part of the elastic member extends in the recessed part.

8. The golf club head according to claim 1, wherein the peripheral part of the elastic member extends further backward relative to a back of the side surface of the metal member.

9. The golf club head according to claim 1, wherein: the adherend is bonded to the head body by a double-stick tape; and a thickness of the double-stick tape is equal to or less than 0.4 mm.

10. A golf club head according to claim 1, wherein: a ratio of a projection area of the recessed part to a projection area of the adherend is equal to or greater than 0.13 and equal to or less than 0.4.

11. The golf club head of claim 1, wherein the face surface and the cavity on the back surface of the head body define a wall portion therebetween with a thickness of 1.5-3.0 mm.

12. The golf club head of claim 11, wherein the surface of the cavity contains a recessed part with a depth greater than the thickness of the double-stick tape.

13. The golf club head of claim 1, wherein the double-stick tape has a five-layered structure wherein the intermediate layer is a fiber layer disposed between adjacent resin layers.

14. The golf club head of claim 1, wherein the adherend contains a plurality of recessed parts.

* * * * *